US009840408B2

(12) United States Patent
Ford

(10) Patent No.: US 9,840,408 B2
(45) Date of Patent: Dec. 12, 2017

(54) RETRACTABLE STIRRUP EXTENSION

(71) Applicant: Louise A. Ford, Santa Fe, NM (US)

(72) Inventor: Louise A. Ford, Santa Fe, NM (US)

( * ) Notice: Subject to any disclaimer, the term of this patent is extended or adjusted under 35 U.S.C. 154(b) by 323 days.

(21) Appl. No.: 14/588,729

(22) Filed: Jan. 2, 2015

(65) Prior Publication Data

US 2016/0194196 A1 Jul. 7, 2016

(51) Int. Cl.
*B68C 3/00* (2006.01)
*B68C 1/16* (2006.01)

(52) U.S. Cl.
CPC ..... *B68C 3/00* (2013.01); *B68C 1/16* (2013.01); *B68C 2003/0025* (2013.01); *B68C 2003/0041* (2013.01)

(58) Field of Classification Search
CPC ..... B68C 3/00; B68C 2003/0008; B68C 2003/0025; B68C 2003/0041; B68C 3/02; B68C 3/025
See application file for complete search history.

(56) References Cited

U.S. PATENT DOCUMENTS 143,732 A * 10/1873 Thompson ..... B68C 3/00 54/49
355,695 A * 1/1887 Jones ..... B68C 3/00 267/70
565,478 A * 8/1896 Long ..... B68C 3/00 267/70
717,850 A * 1/1903 Hey ..... B68C 3/00 54/47
911,718 A 2/1909 Haddock
933,958 A 9/1909 Carter
2,772,532 A 4/1951 Tann
2,935,833 A 5/1960 Woodhead
3,276,185 A * 10/1966 Jahn ..... B68C 3/025 54/49
4,761,938 A 8/1988 Townsend
5,347,797 A 9/1994 Seal et al.
5,661,957 A 9/1997 Daly
(Continued)

FOREIGN PATENT DOCUMENTS

CH 511187 A * 8/1971 ..... B68C 3/00
FR 339248 A * 2/1905 ..... B68C 3/025
(Continued)

OTHER PUBLICATIONS https://www.theconnectedrider.com/horse-tack/stirrup-leathers-and-stirrup-irons/rambo-stirrup/, retrieved Sep. 26, 2016.
(Continued)

*Primary Examiner* — Kathleen I Alker
(74) *Attorney, Agent, or Firm* — Robert D. Watson

(57) ABSTRACT

A retractable stirrup extension for use with a saddle and horse. The extendable stirrup assembly includes an conventional fixed stirrup with an upper (top) foot plate for supporting the rider's foot during riding, and a retractable bottom foot plate retractably attached to the upper stirrup with an extension mechanism that provides about 4-8 inches of vertical travel (extension). The bottom foot plate travels easily between an open (extended) and a closed (retracted) position. The bottom foot plate provides a lower "step" for the rider to use when mounting the horse. A latching mechanism can be used when riding the horse.

12 Claims, 50 Drawing Sheets

(56) References Cited

U.S. PATENT DOCUMENTS

| | | | | |
|---|---|---|---|---|
| 5,809,754 | A | 9/1998 | Schulte | |
| 6,026,633 | A | 2/2000 | Burke, Jr. | |
| 6,173,558 | B1 | 1/2001 | Burke, Jr. | |
| 6,330,781 | B1 * | 12/2001 | Meroth | B68C 3/025 54/49 |
| 6,688,088 | B1 | 2/2004 | Aweeka, Jr. | |
| 7,263,817 | B1 | 9/2007 | Smith | |
| D568,549 | S * | 5/2008 | Augsten | D30/142 |
| 7,380,390 | B1 | 6/2008 | Brassfield | |
| 7,386,973 | B2 | 6/2008 | Madill, Jr. | |
| 7,506,493 | B2 | 3/2009 | Zillmer | |
| 7,536,845 | B1 | 5/2009 | Cote et al. | |
| 7,543,427 | B2 * | 6/2009 | Strauss | B68C 3/02 54/47 |
| 7,574,849 | B2 | 8/2009 | Gottlieb | |
| 8,413,411 | B2 | 4/2013 | Gottlieb | |
| 9,233,830 | B2 * | 1/2016 | Braun | B68C 3/025 |
| 2015/0329350 | A1 | 11/2015 | Bowe | |

FOREIGN PATENT DOCUMENTS

| | | | | |
|---|---|---|---|---|
| FR | 2258772 | * | 9/1975 | B68C 3/00 |
| GB | 2544963 | * | 6/2017 | B68C 3/00 |

OTHER PUBLICATIONS https://www.youtube.com/watch?v=zXHkS42JMLk, published Feb. 24, 2015.

http://www.horsetackintemational.com/ez-mount-western-style-stirrups-and-western-riding-equipment.html#. VKCTGADHU, Dec. 28, 2014.

* cited by examiner

Sec. A-A

Sec. A-A

Sec. A-A

RETRACTABLE STIRRUP EXTENSION

BACKGROUND OF THE INVENTION

Field of the Invention

This invention relates to the field of equestrian equipment, and more particularly to an extendable stirrup that permits a rider to more safely and easily mount, ride and dismount a horse, or other rideable animal.

Description of Related Art

Traditionally, stirrups form parts of conventional horse mounting equipment and may be positioned on one or both sides of the saddle. Stirrups are designed not only to assist the rider in mounting, but also in maintaining balance during riding, and when dismounting. For safety while riding, the bottom, foot resting portion of the stirrup is generally located at a level where the rider's feet are comfortably engaged when the rider is in the saddle.

The construction of riding saddles and accessories suited to shorter riders, younger riders, and riders with decreased mobility present special challenges. For various reasons, a person often has difficulty mounting a horse. The primary difficulty is that a person must step very high in order to place their foot into a properly adjusted stirrup. Depending upon the height of the horse and the leg length of the rider, this may result in the stirrup being too high for the rider to easily engage for mounting the horse. Riders often attempt to overcome this difficulty by searching for something to stand on, or having another person physically assist them. Appropriate items, or persons, however, are often not available.

Another possibility is adjusting the stirrup to a lower than functional level for mounting. The stirrup strap normally includes a buckle, which allows the strap to be vertically adjusted to suit the individual rider. Typically, the desired length of the stirrup strap while riding in the saddle is too high for the rider to comfortably step up to mount the horse. Shorter people usually have the greatest difficulty because they must step proportionally higher than taller people, and this disparity is even greater when the horse is a taller horse. An adjustment to the length of the stirrup strap to minimize the step up generally requires the rider to be dismounted. Unfortunately, once adjusted, the height is fixed and now the rider must ride with a stirrup well below his/her foot.

This presents the additional problem of readjusting the stirrup when the rider is sitting in the saddle. Even a highly experienced rider is dangerously exposed to an accident while trying to perform this maneuver. When the rider, in the saddle, attempts to reach down for drawing up the stirrup, the required leaning to one side can lead to a fall. Using traditional stirrups, the only safe way to adjust the height is to have another person, one who is dismounted, adjust them for the rider.

In the alternative, a rider may attempt to climb upon an object such as a bucket, fence, stool, or ladder to reach the stirrup, but this also can lead to injury caused by the instability of the object or the animal moving at a critical time. On a trail ride, for example, one cannot always find something of the right height to stand on. Additionally, a horse is often nervous and fidgety when being asked to stand still next to an inanimate object while being mounted.

Relevant prior art falls into three broad categories. The first involves the use of an extra mounting strap attached to the stirrup strap or to the saddle, having a (adjustable) step fixed at a lower height. Examples of US patents include: U.S. Pat. Nos. 7,386,973; 6,688,088; 7,263,817; and 5,347,797. The second category involves the use of a rigid wire-rack that hooks onto the saddle strap and provides a lower step (see, e.g., U.S. Pat. No. 4,761,938). The third category involves the use of extendable and retractable plates or bars that provide a lower height step when extended. Examples of US patents include: U.S. Pat. Nos. 5,661,957; 7,380,390; 2,935,833; 8,413,411; 7,574,849; 6,173,558; 6,026,633 and 5,809,754.

Disadvantages with many of these devices include: (1) their mechanical complexity, (2) their cost, and (3) the problem with exposed or freely-hanging parts. In particular, devices that hang freely, or that leave the extended lower foot plate (step) in an extended position hanging below the stirrup, expose the rider to hazards from brush or low lying limbs of a tree that may snag the exposed parts of the device, thereby entangling the rider's leg and possibly causing a fall. This results in an undesirable level of risk for the trail rider (or for any riding that takes place outside of the safe confines of the clinical setting of a professional arena).

There is a need, hence, for a device for assisting in the mounting of a saddled animal, such as a horse, that is mechanically simple, low-cost, easily retracted, and safe for the rider as well as the animal. The device should allow a stirrup or foot plate to be easily extended towards the ground so that a short person, a child, or person of reduced mobility may easily mount a saddle positioned on a horse or pony. Once mounted, the rider should be able to be easily and safely retract and stow away the extended foot step. The device should be usable with either English (Eastern) or Western type of saddles and saddle hardware.

Against this background the present invention was developed.

SUMMARY OF THE INVENTION

The present invention, the Step Up Stirrup™, is a retractable stirrup extension for use with a saddle and horse, or other rideable animal. The extendable stirrup assembly includes a conventional stirrup with an upper (top) foot plate for supporting the rider's foot during riding, and which is hung from a saddle with a strap in a known manner; a cushioned foot pad; and a bottom foot plate retractably attached to the upper stirrup with an extension mechanism that provides 4-12 inches of vertical travel (extension). The bottom foot plate travels easily between an open (extended) and a closed (retracted) position. The bottom foot plate provides a lower "step" for the rider to use when mounting the horse. A latching mechanism can be used to lock the assembly in a compact, closed position, after the rider has mounted the horse.

With the Step Up Stirrup™ you don't have to bend over after mounting the horse. Once you are on the horse, you can reach for the stirrup leather at any part that is comfortable for the rider and lift the whole thing into the rider's lap and snap the assembly shut. Then, drop it back down and put the rider's foot in the stirrup. This is much easier to preform then trying to change buckles on the stirrup leather. In fact, some saddles make it almost impossible as they pull the buckle way deep into the saddle and are sort of stuck in there.

BRIEF DESCRIPTION OF THE SEVERAL VIEWS OF THE DRAWING(S)

DETAILED DESCRIPTION OF THE INVENTION

The present invention is a retractable stirrup extension, for use with a saddle and horse, or other rideable animal. The extendable/retractable stirrup assembly includes a conventional fixed stirrup with an upper (top) foot plate and a cushioned foot pad for supporting the rider's foot during riding, and which is hung from a saddle with a strap in a known manner. The stirrup extension further comprises a bottom foot plate extendably/retractably attached to the upper stirrup with an mechanical mechanism that provides, for example, 4-12 inches of vertical travel (extension). The bottom foot plate adjusts its position easily between an open (extended) position and a closed (retracted) position. The bottom foot plate provides a temporary lower "step" for use by the rider when mounting the horse. After mounting the horse, the bottom foot plate is retracted manually by the rider into a closed (retracted) position, which can be latched closed with a locking mechanism.

FIGS. 1-38 illustrate schematic details of various examples and embodiments of the present invention. Note that the terms "open position" and "extended position", as it refers to the bottom foot plate, are equivalent. Likewise, the terms "closed position" and "retracted position", as it refers to the bottom foot plate, are equivalent. We define the term "transverse" as a direction that is oriented perpendicular to the X-Y plane (i.e., the X-Y plane of the paper in FIG. 1).

We define the term "extension ratio" as the ratio of two numbers, i.e. the length of travel, L, that the bottom foot plate travels when fully extended, divided by the width, W, of the foot bed across the top foot plate of the upper stirrup. In other words, the "extension ratio" is L/W. For example, if the width, W, of the top foot bed is 5 inches, then W=5. And, if the bottom foot plate drops down a total of 7 inches when fully extended, L=7, which gives an extension ratio L/W=7/5=1.4.

A useful range of extension ratios, L/W, for the present invention ranges from L/W=1 to 2, but it can be greater than 2 or less than 1.

Figure 1:
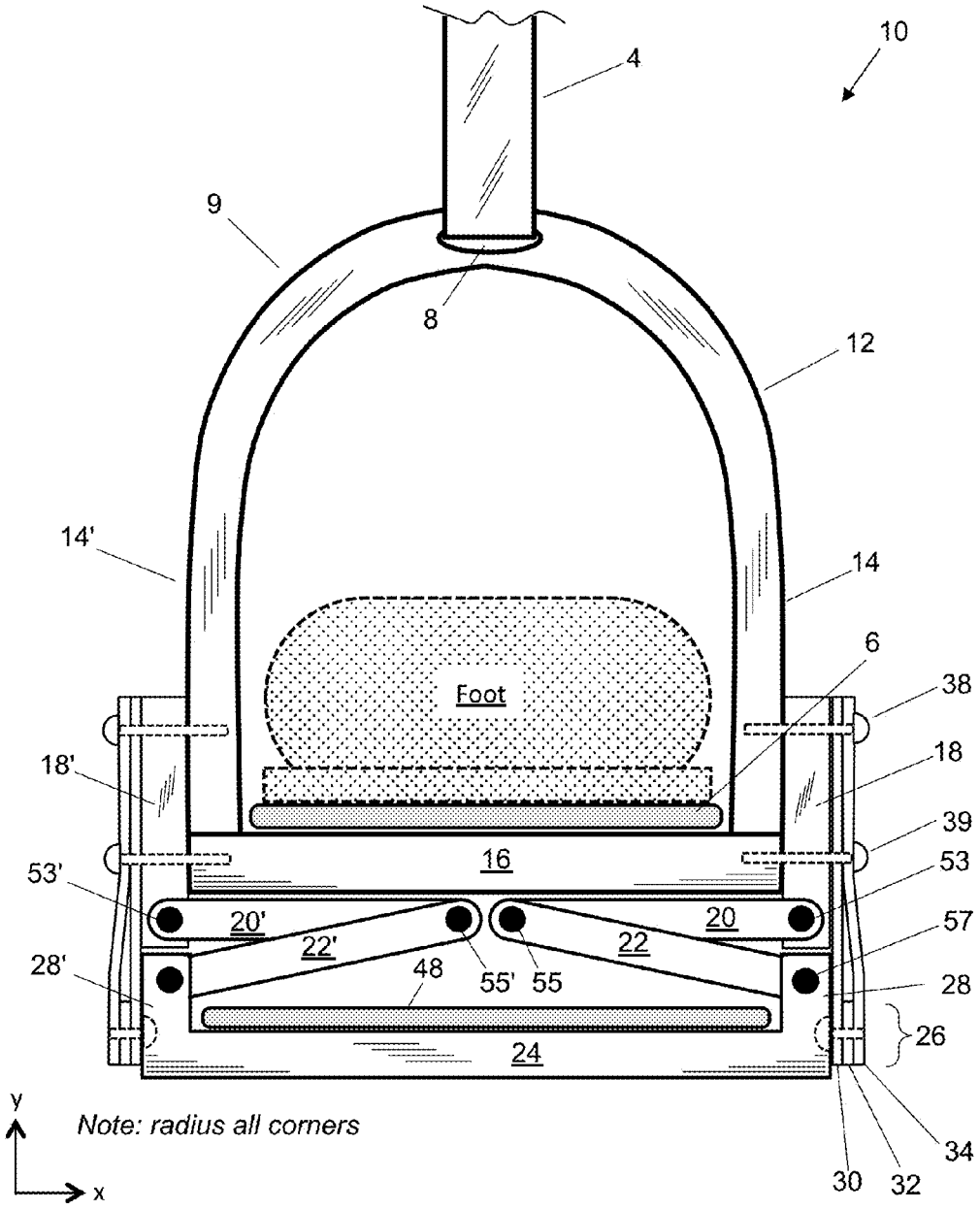
FIG. 1 shows an elevation view of the front side of an example of a retractable stirrup extension in the closed position, according to the present invention.

FIG. 1 shows an elevation view of the front side of an example of a retractable stirrup extension assembly in the closed position, according to the present invention. Retractable stirrup extension assembly 10 comprises a conventional upper stirrup 12 and a retractable lower stirrup 2. Upper stirrup 12 comprises a horizontal top foot plate 16 attached to vertical side stirrup legs 14, 14', which are attached to upper arch 9. Rubber (or other elastomer) foot pad 6 is disposed on top of top foot plate 16. Side legs 14, 14'; top foot plate 16, and upper arch 9 can be manufactured as a single, monolithic casting or machined piece of metal or metal alloy (such as steel or aluminum alloy), zinc alloy, magnesium alloy, polymer, or fiber-reinforced polymer. Stirrup 12 is suspended from a saddle (not shown) via stirrup strap 4 that passes though hole 8 in upper arch 9.

In FIG. 1, stirrup assembly 10 further comprises a rigid bottom foot plate 24 that is retractably attached to stirrup 12, and which is moveable vertically (extends downwards) to provide a lower "step" for the rider to use when mounting a horse (or other rideable animal). The amount of vertical travel (downward vertical extension) of bottom foot plate 24 can, for example, range from 4" to 12", depending on the design. More typically, the extension distance can range from 4" to 8". Bottom foot plate 24 can be made of metal or metal alloy (such as steel, aluminum alloy, zinc alloy, magnesium alloy, etc.), a rigid polymer or plastic, or a rigid fiber-reinforced polymer. An optional lower elastic pad, 48, can be used to cushion the bottom foot plate 24. Alternatively, the upper surface of bottom foot plate 24 can be mechanically roughened to provide extra grip for the foot.

In FIG. 1, bottom foot plate 24 is retractably attached to upper stirrup 12 via a pair of hinged linkages (plates) 20, 22, and 20', 22', respectively that operate in parallel. Each hinge pin assembly comprises a hole (e.g., 40) and a tightly-fitting hinge pin 53, 55, or 57 (see FIG. 8). Hinge pins 53, 55, 57 are typically made of steel, but can also be made of a self-lubricating, plastic material. Side block 18 is attached to side leg 14 and top plate 16 of stirrup 12 via a pair of screws 38 and 39. Upper hinge plate 20 is pivotally attached to side hinge block 18 via first hinge pin 53. Upper hinge plate 20 is also pivotally attached to lower hinge plate 22 via second hinge pin 55. Finally, lower hinge plate 22 is pivotally attached to the vertical side leg 28 of bottom foot plate 24 via third hinge pin 57. The long dimension of upper foot plate 16 defines the X-axis. Each hinge pin 53, 55, 57 is positioned so that its longitudinal axis is oriented transverse (perpendicular) to the X-Y plane of the device (i.e., the X-Y plane of the paper in FIG. 1). Using this configuration of dual (parallel) pairs of linked hinge plates, rotary motion (pivoting) of the linked hinge plates about their respective pivots is converted into linear displacement of the common member (i.e., bottom foot plate 24) up and down along the vertical direction (Y-axis).

In general, making the hinge plates longer increases the vertical travel (extension) of the bottom foot plate 24.

In FIG. 1, dual pairs of linked hinge plates (20, 22) and (22', 22') are made to be as long as possible, but not so long as to be touching or overlapping in the middle.

In general, the retractable stirrup extension assembly of the present invention can optionally comprise a latching mechanism that securely holds the bottom foot plate in a closed position when riding the horse. In one embodiment, a sufficient amount of friction can be provided between moving parts in the assembly so that the bottom foot plate remains in the closed position during riding. Alternatively, one or more high-strength magnets can be strategically placed to provide sufficient magnetic latching/clamping force to hold the bottom foot plate in a secure, closed position when riding the horse. Preferably, the latching mechanism operates automatically and securely without the need for intervention from the rider, other than manually pushing the bottom foot plate into its closed and latched position (the position illustrated, for example, in FIG. 1).

Figure 2:
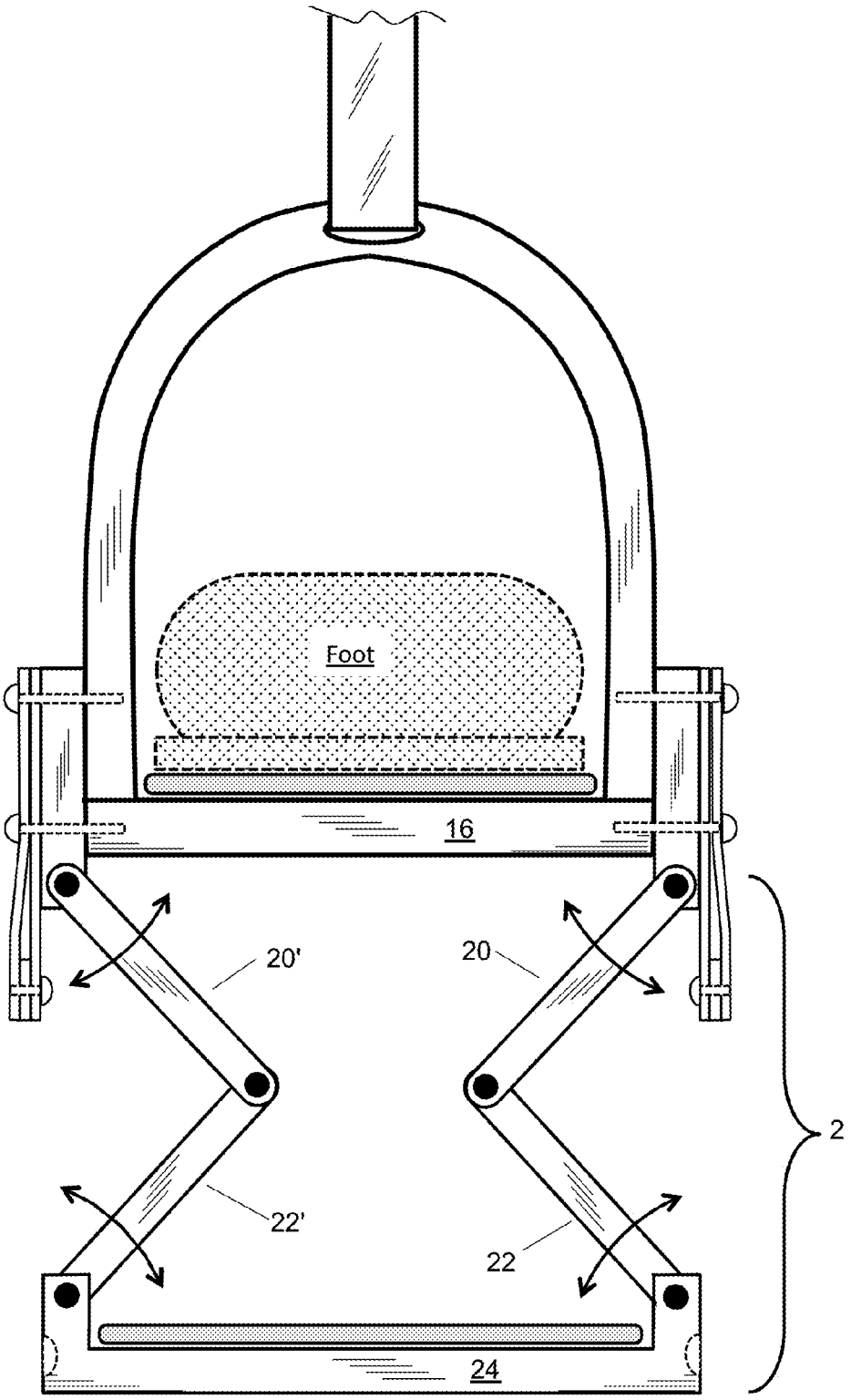
FIG. 2 shows an elevation view of the front side of an example of a retractable stirrup extension in the partially-extended position, according to the present invention.

FIG. 2 shows an elevation view of the front side of the example of a retractable stirrup extension from FIG. 1, in a partially-extended (dropped down) position, according to the present invention.

Figure 3:
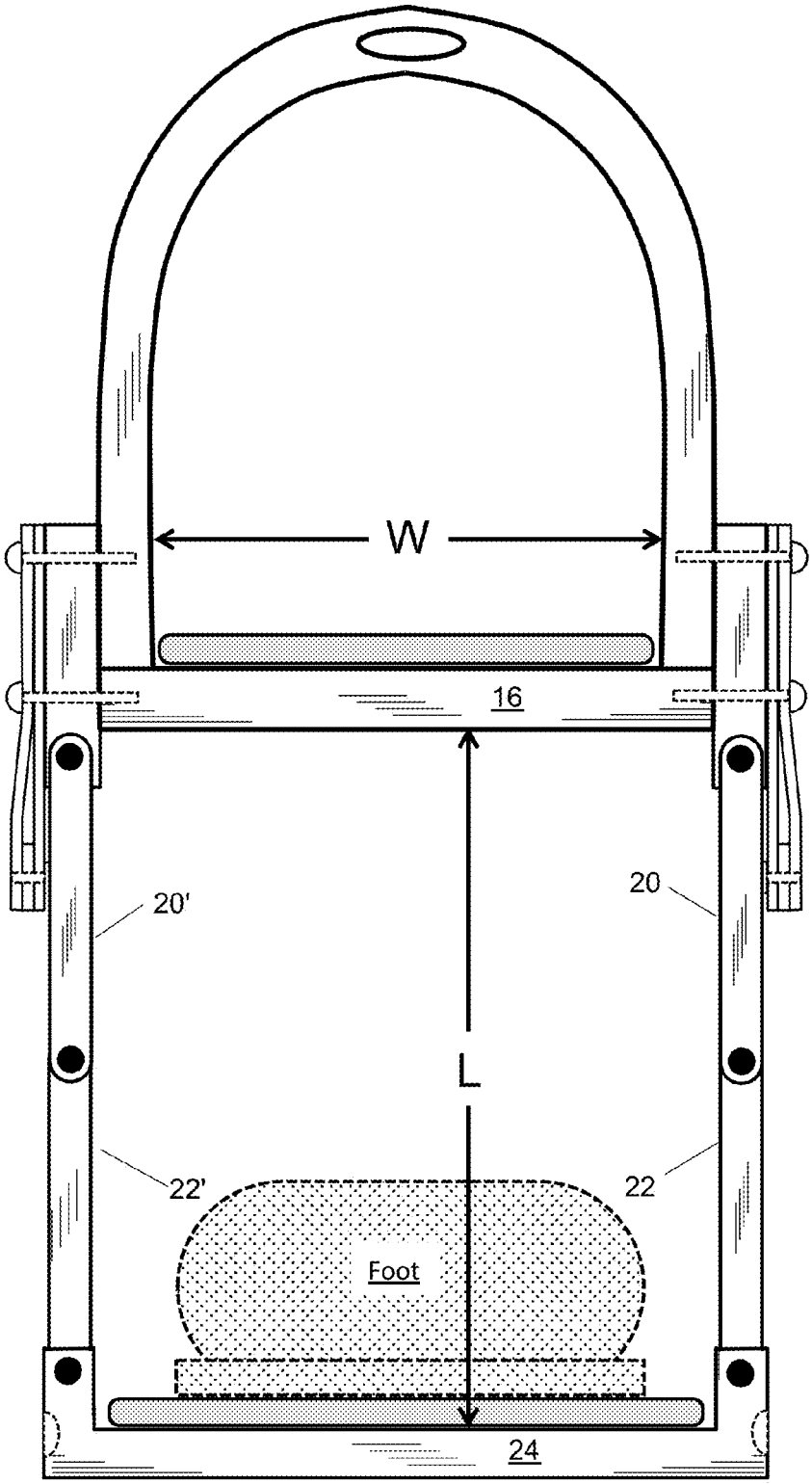
FIG. 3 shows an elevation view of the front side of an example of a retractable stirrup extension in the fully-extended, open position, according to the present invention.

FIG. 3 shows an elevation view of the front side of the example of a retractable stirrup extension from FIG. 1 in the fully-extended (fully-open) position, according to the present invention. In this example, if the inside width of the upper foot plate 16 is 5", this then makes the vertical extension (drop-down distance) equal to about 7". The extension ratio, L/W, is 7/5=1.4.

Figure 4:
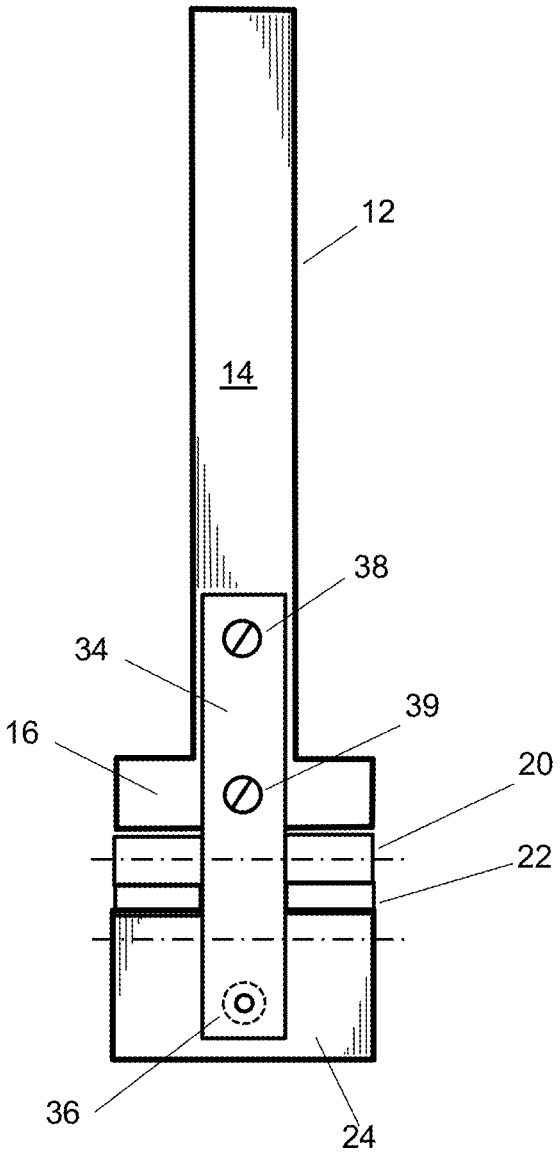
FIG. 4 shows an elevation view of one side of an example of a retractable stirrup extension in the closed position, according to the present invention.

FIG. 4 shows an elevation view of one side of an example of a retractable stirrup extension 10 in the closed position, according to the present invention. Latching spring strip 34 can be seen.

Figure 5:
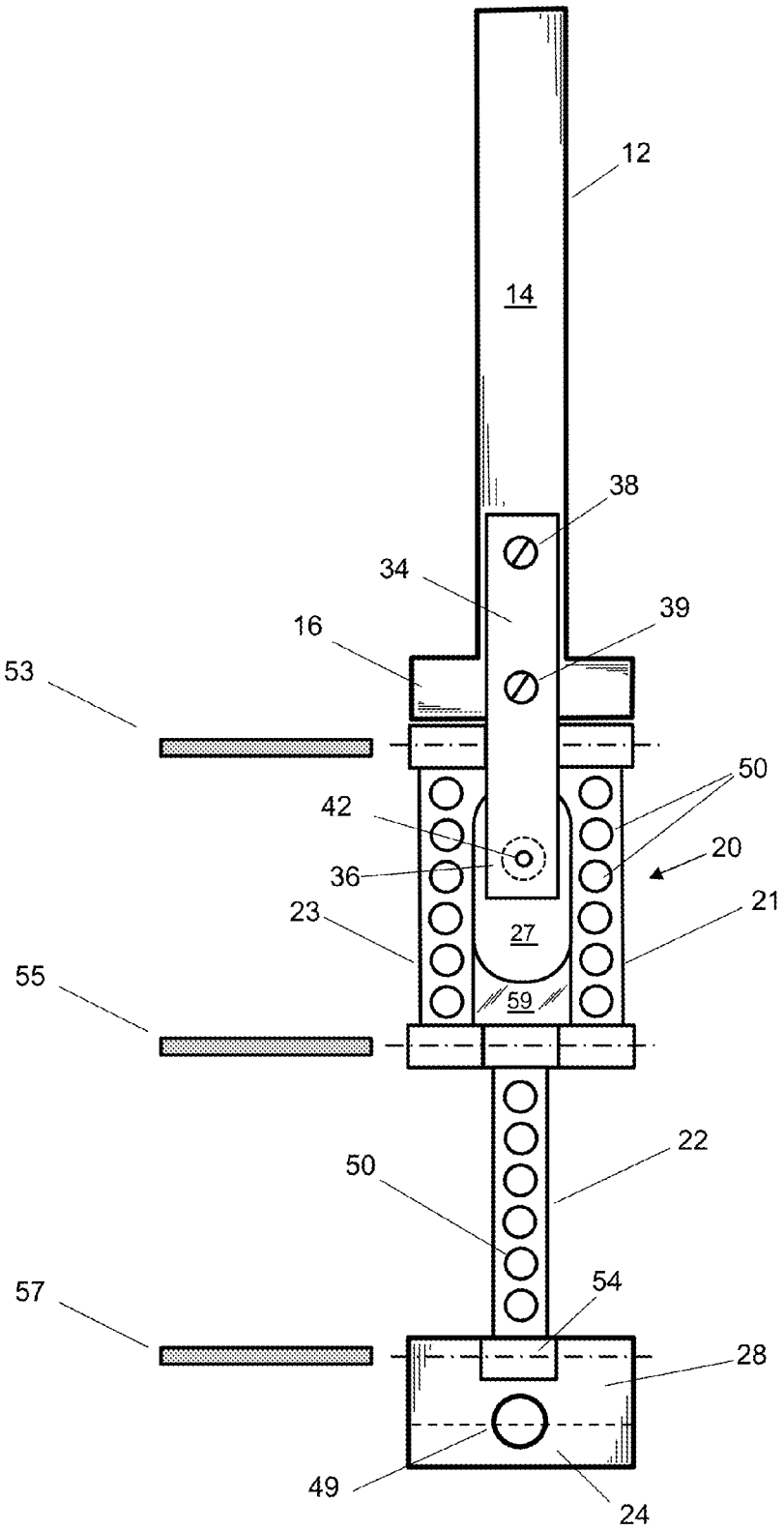
FIG. 5 shows an elevation view of one side of an example of a retractable stirrup extension in the fully-extended, open position, according to the present invention.

FIG. 5 shows an elevation view of one side of an example of a retractable stirrup extension 10 in the fully-extended, open position, according to the present invention. Here, it can be seen that the upper right hinge plate 20 comprises a rigid pair of parallel hinge bars, right hinge bar 21 and left hinge bar 23, joined together by recessed web 59 at the lower end. A series of holes 50 are drilled through each bar to reduce its weight. Upper hinge pin 53 connects upper right hinge plate 20 to stirrup 12. Middle hinge pin 55 connects lower right hinge plate 20 to upper right hinge plate 22. Lower hinge pin 57 connects lower right hinge plate 22 to the vertical right side wall 28 of bottom foot plate 24. Right hinge bar 21 and left hinge bar 23 are joined together by recessed web 59. Open central volume 27 is disposed in-between right hinge bar 21 and left hinge bar 23 to reduce weight, and to accommodate the folded configuration of the lower hinge plate 22 against the upper hinge plate 20. Lower hinge plate 22 comprises a single bar (with drilled holes 50 to reduce weight), and is joined at the top to upper hinge 20 via middle hinge pin 55; and is further joined at the bottom to bottom foot plate 24 via lower hinge pin 57. The use of recessed web 59 allows upper hinge plate 20 to fold tightly and compactly against lower hinge plate 22 (see, e.g., FIG. 1). Semi-spherical recess 49 can be seen.

Figure 6:
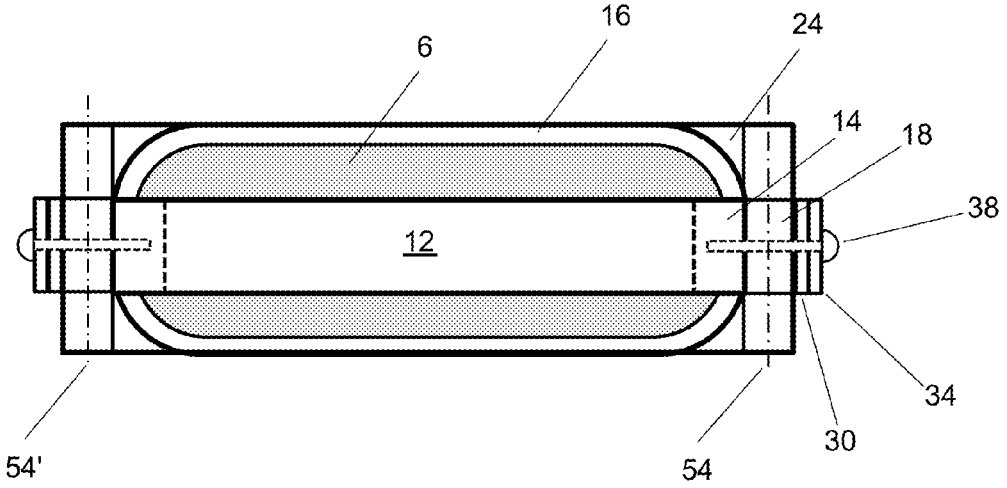
FIG. 6 shows an elevation view of the top of an example of a retractable stirrup extension, according to the present invention.

FIG. 6 shows an elevation view of the top of an example of a retractable stirrup extension 10, according to the present invention. Dashed line 54 and 54' indicates the centerline of the hinge pins 53, 53', respectively.

Figure 7:
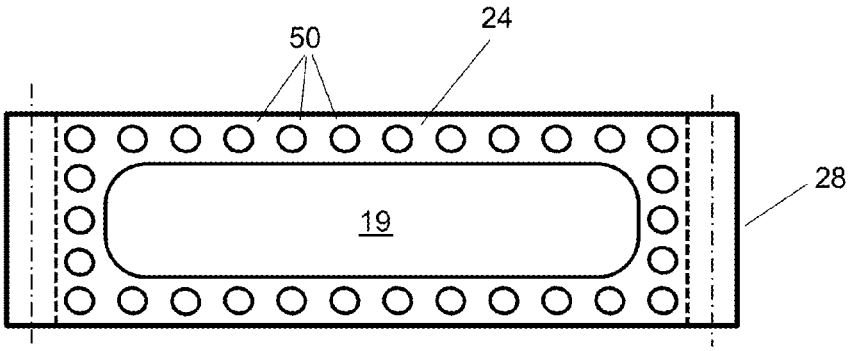
FIG. 7 shows an elevation view of the bottom of an example of a retractable stirrup extension, according to the present invention.

FIG. 7 shows an elevation view of the bottom of an example of a retractable stirrup extension 10, according to the present invention. The bottom view essentially comprises a view of the bottom of bottom foot plate 24. A series of holes 50 are drilled to reduce the weight, and the central volume 19 of the plate is open. Dashed line 54 indicates the centerline of the lower hinge pins 57, 57'.

Figure 8:
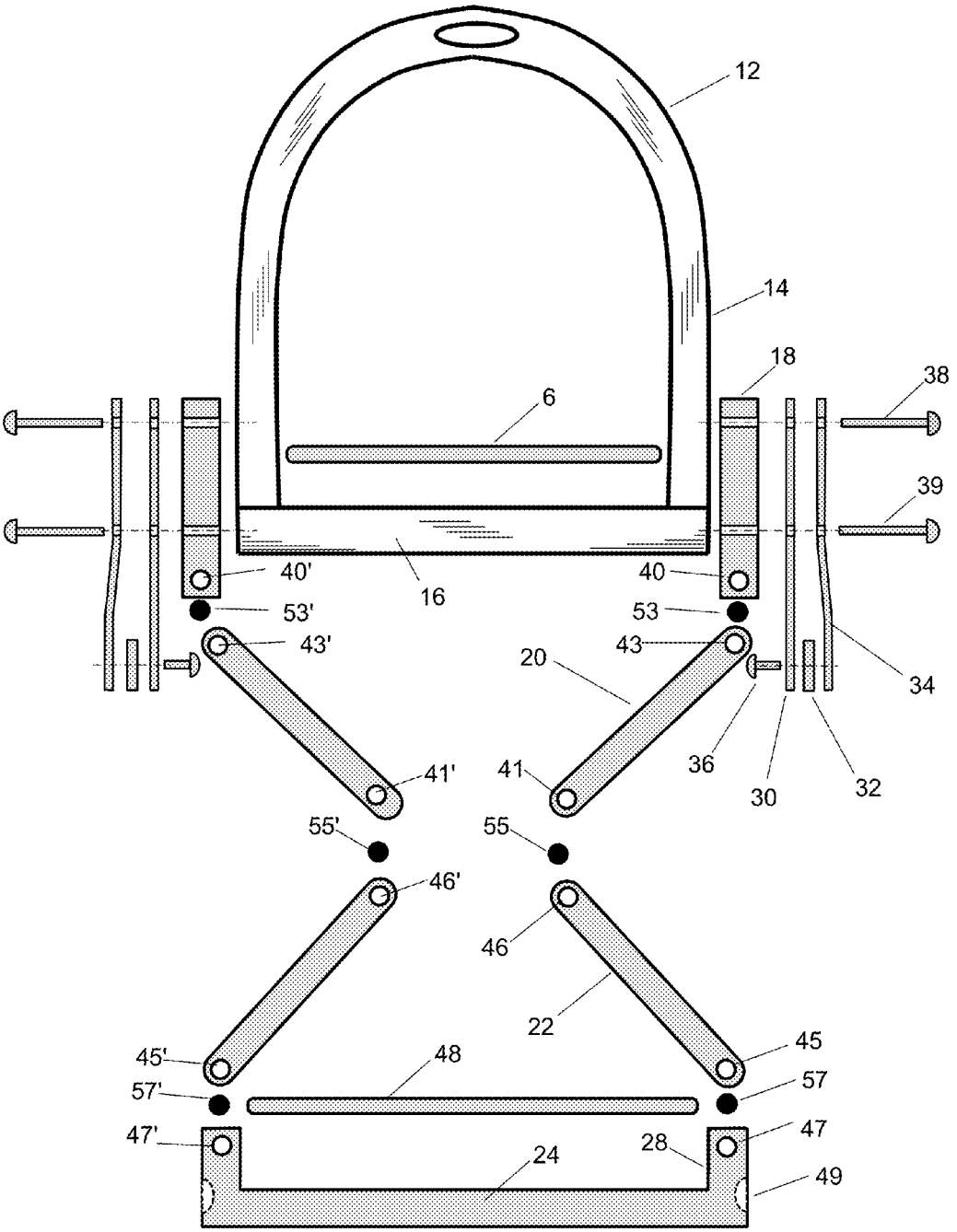
FIG. 8 shows an exploded, elevation view of the front side of an example of a retractable stirrup extension in the partially-extended position, according to the present invention.

FIG. 8 shows an exploded, elevation view of the front side of an example of a retractable stirrup extension 10, laid out in a partially-extended position, according to the present invention.

Figure 9:
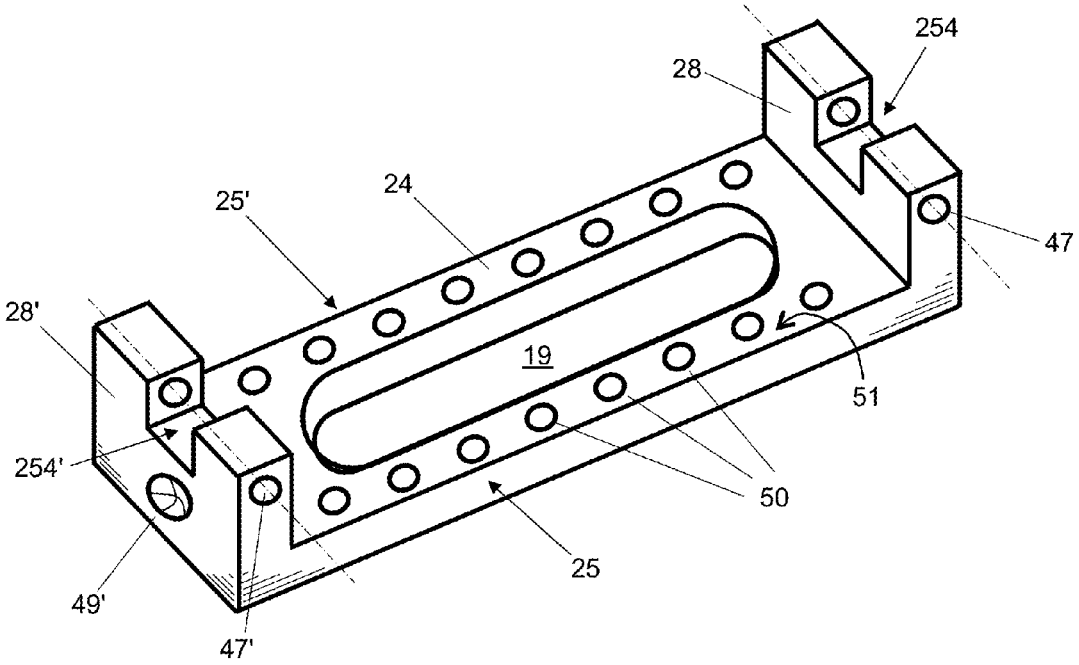
FIG. 9 shows an isometric view of an example of a bottom foot plate, according to the present invention.

FIG. 9 shows an isometric view of an example of a bottom foot plate 24, according to the present invention. A semi-spherical indentation/recess 49' can be seen on the short, vertical side wall 28' of bottom foot plate 24. This recess is disposed for receiving the semi-spherical latching element 36' of latching mechanism 26'. Left- and right-sided recessed notch 254 and 254' are disposed in vertical side wall 28' of bottom foot plate 24 for engaging, mating, and interlocking with the lower hinge pin 57 of lower hinge plate 22. The long sides 25, 25' of plate 24 can be seen. A plurality of through holes 50 are drilled through plate 24 to reduce the weight. A large central open space 19 is disposed in the center of plate 24. Optionally, the upper surface 51 of bottom plate 24 can be mechanically roughened to provide a non-slip surface for the rider's foot or boot. Hinge pin holes 47 and 47' can be seen.

Figure 10:
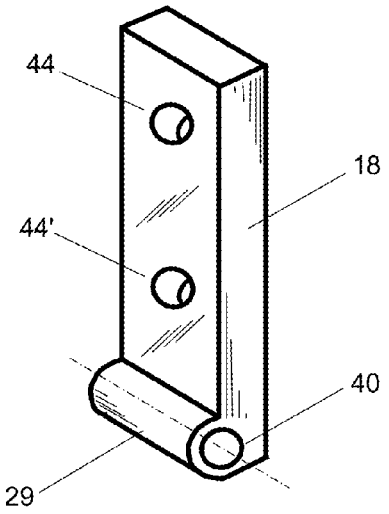
FIG. 10 shows an isometric view of an example of a side hinge block, according to the present invention.

FIG. 10 shows an isometric view of an example of a side hinge block 18, according to the present invention. Screws 38 and 39 (see FIG. 8) attach side hinge block 18 to side leg 14 of stirrup 12 and to top plate 16 through holes 44 and 44'. Block 18 contains an offset side extension tube/cylinder 29, which contains hole 40.

Figure 11A:
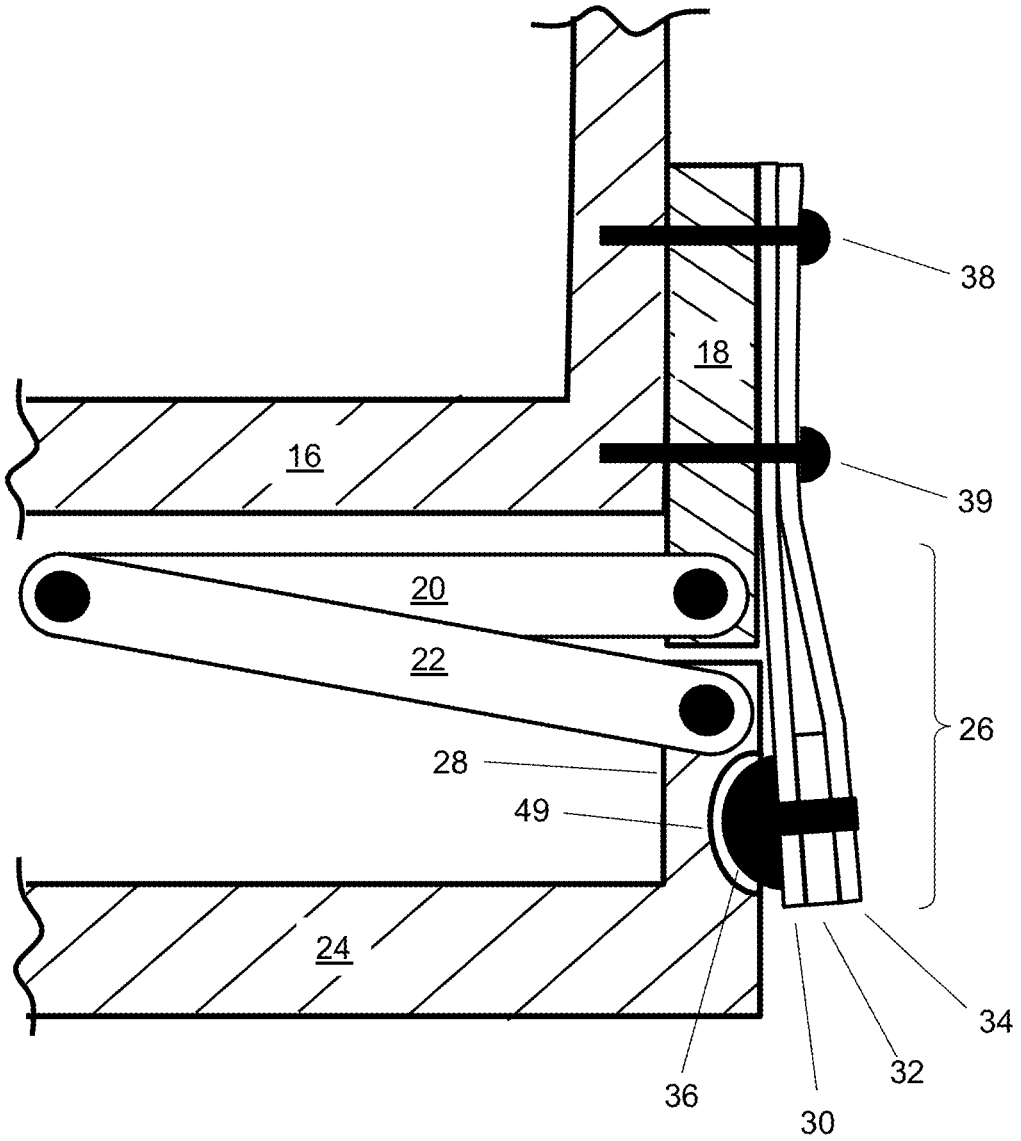
FIG. 11A shows a magnified, elevation view of the front side of an example of a retractable stirrup extension in the closed position, according to the present invention.

FIG. 11A shows a magnified, elevation view of the front side of an example of a retractable stirrup extension 10 in the closed position, according to the present invention. Here, latching mechanism 26 can be seen, which comprises two thin metal, spring-steel (leaf-spring) strips, 30 and 34, of high strength steel, separated by a spacer pad 32. Strips 30 and 34 are attached to side hinge block 18 via screws 38 and 39. Semi-spherical screw-head 36 is screwed into the pair of spring strips 30 and 34. Semi-spherical screw-head 36 serves as the latching element that inserts into the semi-spherical recess 49 in the vertical side wall 28 of bottom foot plate 24. When inserted into recess 49, the screw-head 36 holds (secures) bottom foot plate 24 against top foot plate 16 and prevents motion or vibration of the assembly 10 during riding. The curved shape (e.g., semi-spherical) of screw-head 36, coupled with the use of a chamfered corner on vertical side wall 28 of bottom plate 24 ensures smooth, unassisted operation (i.e., no hands needed to pull outwards on the spring strips 30, 34) of the latching mechanism 26 when closing the assembly 10.

Figure 11B:
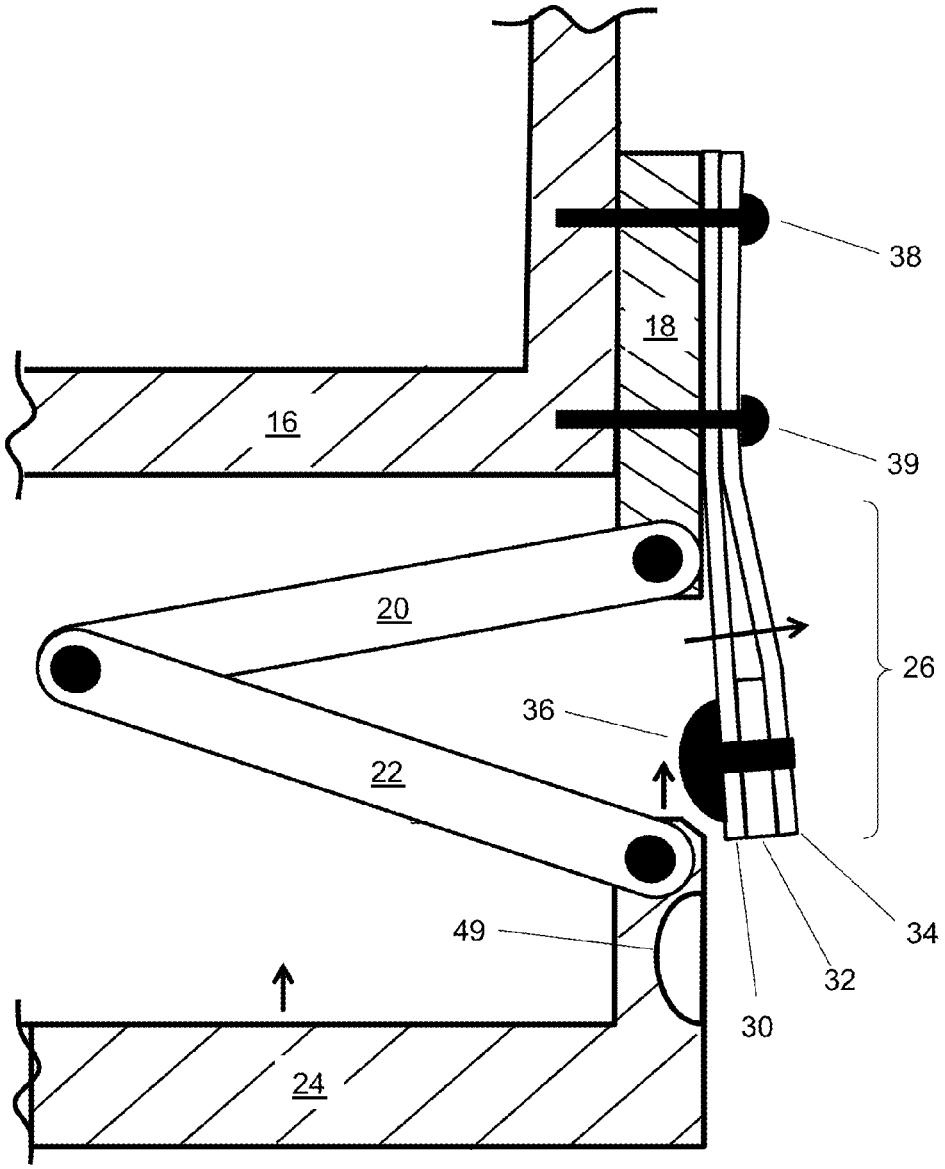
FIG. 11B shows a magnified, elevation view of the front side of an example of a retractable stirrup extension in the closed position, according to the present invention.

FIG. 11B shows a magnified, elevation view of the front side of an example of a retractable stirrup extension 10 in the partially-open position, according to the present invention. Here, the corner of the vertical side wall 28 of bottom foot plate 24 can be seen pushing on the semi-spherical screw-head 36. Note: the corner of bottom foot plate 24 can be machined as necessary to make the latching operation run more smoothly.

In another embodiment, semi-spherical screw-head 36 can be replaced with a strong magnet to provide the latching force. Alternatively, semi-spherical screw-head 36 can be replaced with a wedge or triangle-shaped member to provide the latching function.

Figure 12:
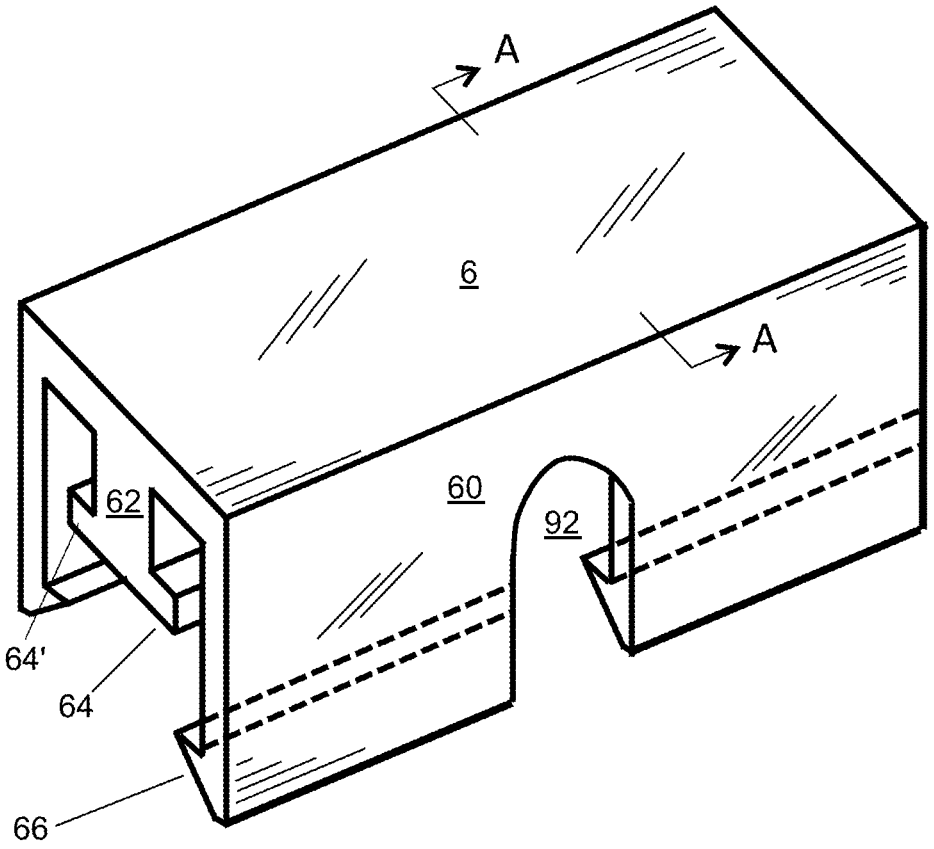
FIG. 12 shows an isometric view of an example of a molded elastomeric top foot pad, according to the present invention.
Figure 13A:
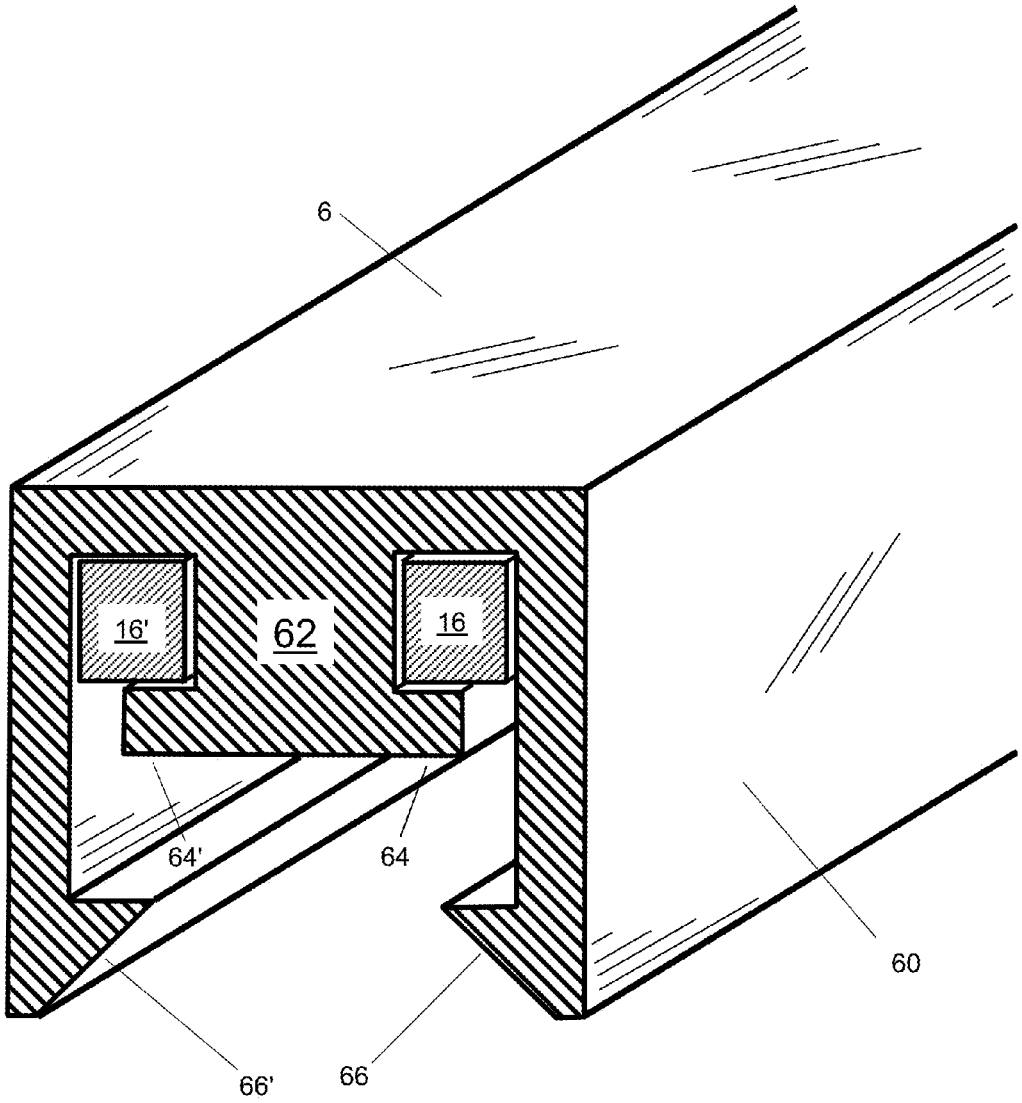
FIG. 13A shows a cross-section isometric view of an example of a molded elastomeric top foot pad inserted into a top foot plate, according to the present invention.

FIG. 12 shows an isometric view of an example of a molded elastomeric top foot pad 6, according to the present invention. In this example, pad 6 (which can be made of rubber or a urethane compound, for example) comprises a pair of side walls 60, 60' that are continuous with the top pad 6. Side walls 60, 60' cover and protect the front gap/opening between the top and bottom foot plates, 16 and 24, respectively. This prevents any small branches or limbs of trees or brushes from accidently sticking into the open gap between the foot plates, possibly causing a fall. Pad 6 further comprises a molded central rib 62 and pair of flanges 64, 64', which form an inverted "T" shape in cross-section. This "T"-shape allows the elastomeric pad 6 to be inserted into an opening in the top foot plate 16 and then secured by pushing the flanges 64, 64' down and underneath top plate 16 (as can be seen in FIG. 13A). Side wall 60 further comprises an optional upside-down "U"-shaped opening 92 that acts a finger-hole for reaching in with a finger for grabbing the bottom foot plate 24 and pulling it down when opening the assembly 10. Optionally, a pair of recessed cutouts (not shown) in the top foot plate 16 can be used to receive and hold the pair of flanges 64, 64'. In this case, the lower surface of flanges 64, 64' is flush with the lower surface of top foot plate 16.

FIG. 13A shows a cross-section isometric view of an example of a molded elastomeric top foot pad 6 inserted into a top foot plate 16, according to the present invention. The top cushion pad 6 comprises a downwardly-protruding central rib 62 that has a pair of sideways-extending flanges 64, 64' that are configured for being pushed into an open channel (not numbered) disposed in the middle of top foot plate 16, in-between front plate segment 16 and rear plate segment 16', that receives and securely holds the central rib 62 and pair of flanges 64, 64'. In this example, the bottom part of side wall 60, 60' comprises a hooked lower end 66, 66', respectively. The hooked lower end 66, 66' functions as a latch for holding assembly 10 in the closed position (See FIG. 13D).

Figure 13B:
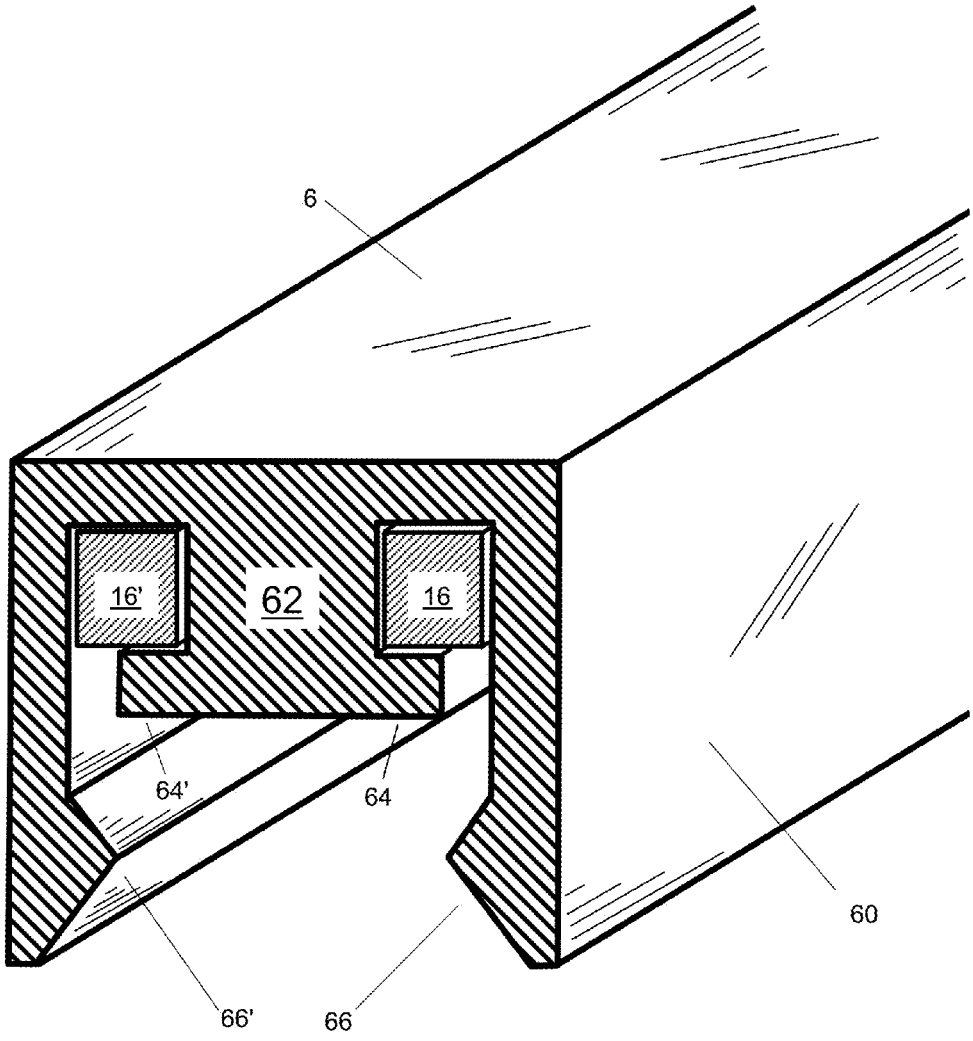
FIG. 13B shows a cross-section isometric view of an example of a molded elastomeric top foot pad inserted into a top foot plate, according to the present invention.

FIG. 13B shows a cross-section isometric view of an example of a molded elastomeric top foot pad 6 inserted into a top foot plate 16 in-between front plate segment 16 and rear plate segment 16', according to the present invention. In this example, the bottom part of sidewall 60, 60' comprises an inside-facing chevron or "Vee"-shaped lower end 66, 66', respectively. The chevron-shaped lower end 66, 66' can function as a friction member for holding assembly 10 in a closed position via friction. The stiffness and rigidity of the material (e.g., urethane) used for pad 6 aids in holding assembly 10 in a closed position.

Figure 13C:
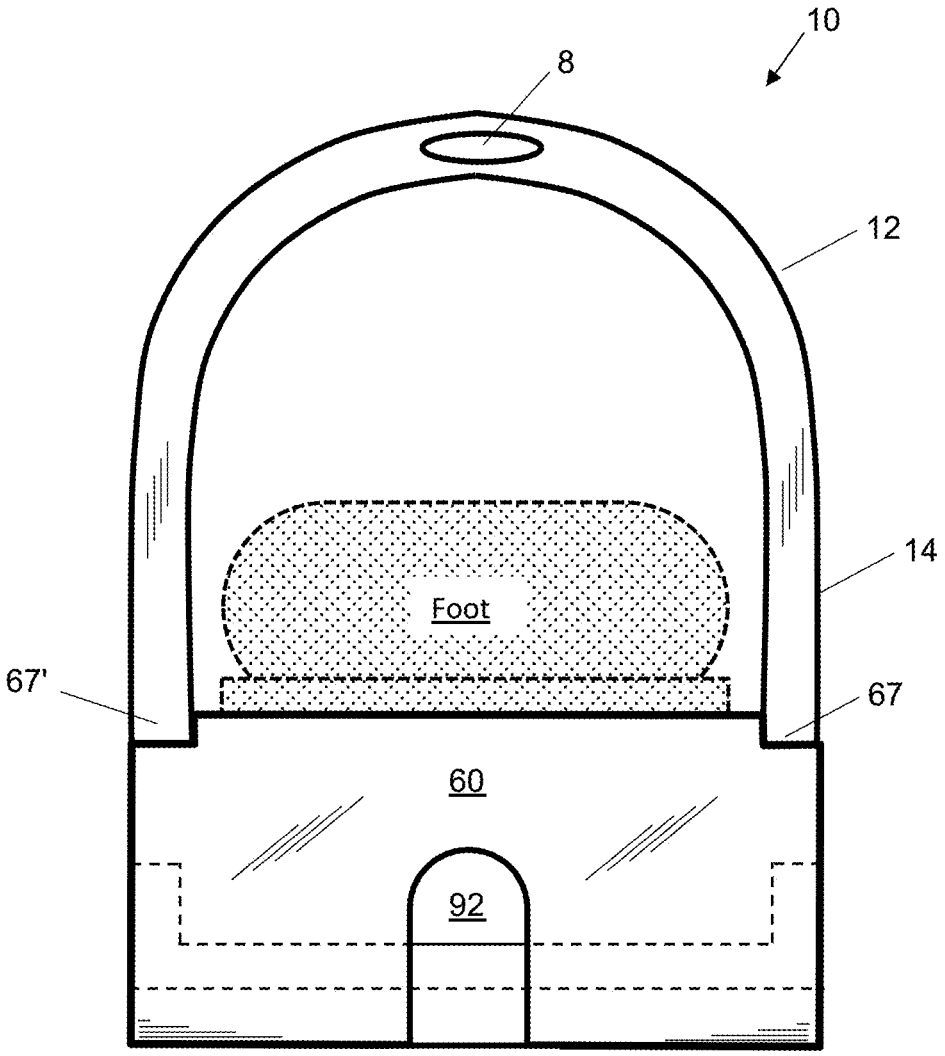
FIG. 13C shows an elevation view of the front side of an example of a retractable stirrup extension in the closed position, with an elastomeric foot pad/protective front cover, according to the present invention.

FIG. 13C shows an elevation view of the front side of an example of a retractable stirrup extension 10 in the closed position, with an elastomeric foot pad/protective front cover 60, according to the present invention. Cover 60 comprises a notch 67, 67'. Cover side wall 60 further comprises an optional upside-down "U"-shaped opening 92 that acts a finger-hole for reaching in with a finger for grabbing the bottom foot plate 24 and pulling it down when opening the assembly 10.

Figure 13D:
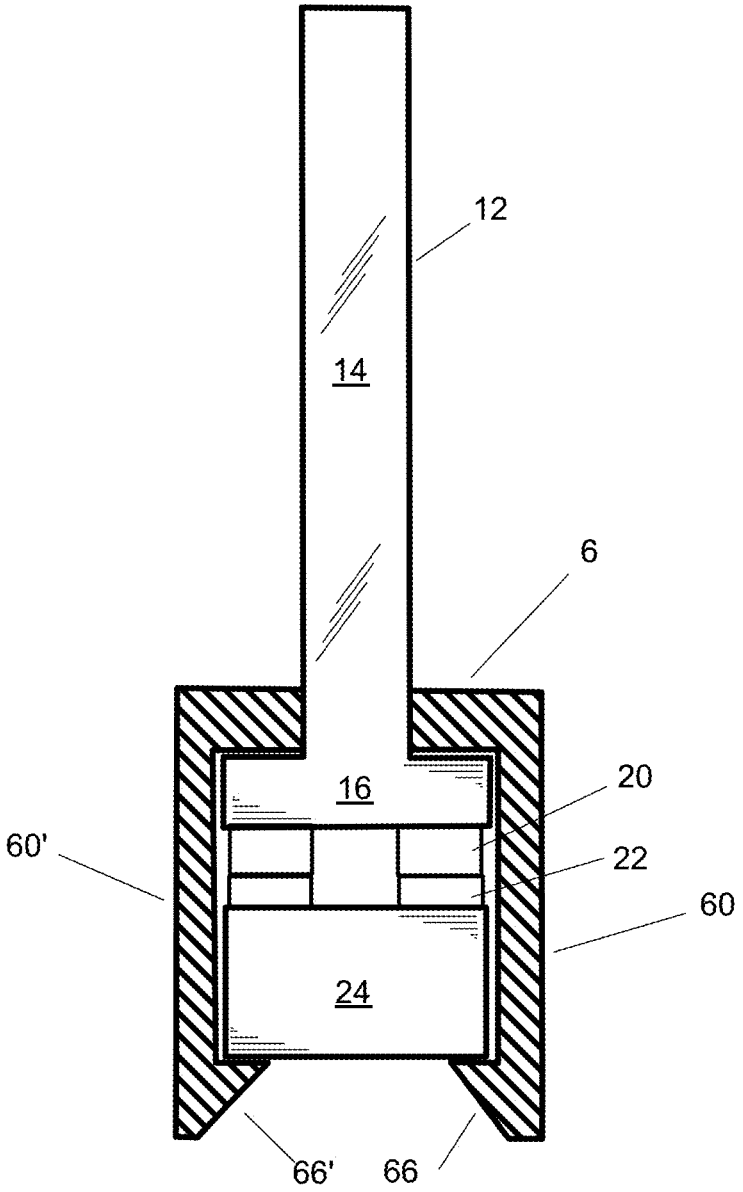
FIG. 13D shows a cross-section elevation end view of an example of a molded elastomeric top foot pad/protective front cover covering an assembly in a closed position, according to the present invention.

FIG. 13D shows a cross-section elevation end view of an example of a molded elastomeric top foot pad/protective front cover 6, 60 covering an assembly 10 in a closed position, according to the present invention. In this example, interior hooks 66, 66' function to latch and hold the bottom foot plate 24 when in the closed position. To release the latch, the rider must reach behind the cover side wall 60, 60' and pull outwards to freely clear the interior hooks 66, 66' from the corners of bottom foot plate 24, before pulling down on bottom foot plate 24.

Figure 13E:
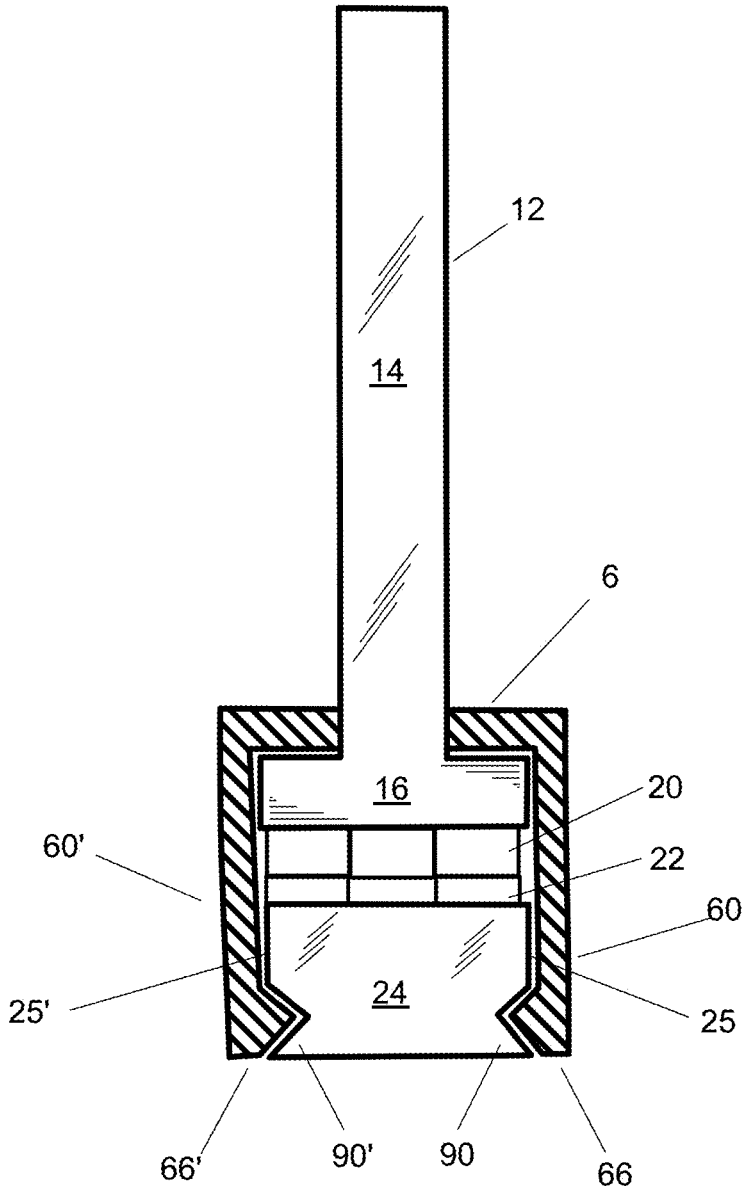
FIG. 13E shows a cross-section elevation end view of an example of a molded elastomeric top foot pad/protective front cover covering an assembly in an open position, according to the present invention.

FIG. 13E shows a cross-section elevation end view of an example of a molded elastomeric top foot pad/protective front cover 6, 60 covering an assembly 10 in a closed position, according to the present invention. In this example, the bottom part of side wall 60, 60' comprises an inside-facing chevron or "Vee"-shaped lower end 66, 66', respectively. The bottom surface of the cover 60 can be flush with the bottom surface of bottom foot plate 24. In some embodiments, longitudinal grooves 90, 90' can be machined into the long side walls 25, 25' of bottom foot plate 24. Chevron-shaped grooves 90, 90' serve to catch and hold the inwardly-facing chevron-shaped protrusions 66 and 66', respectively, to provide a more securing latching function.

Figure 13F:
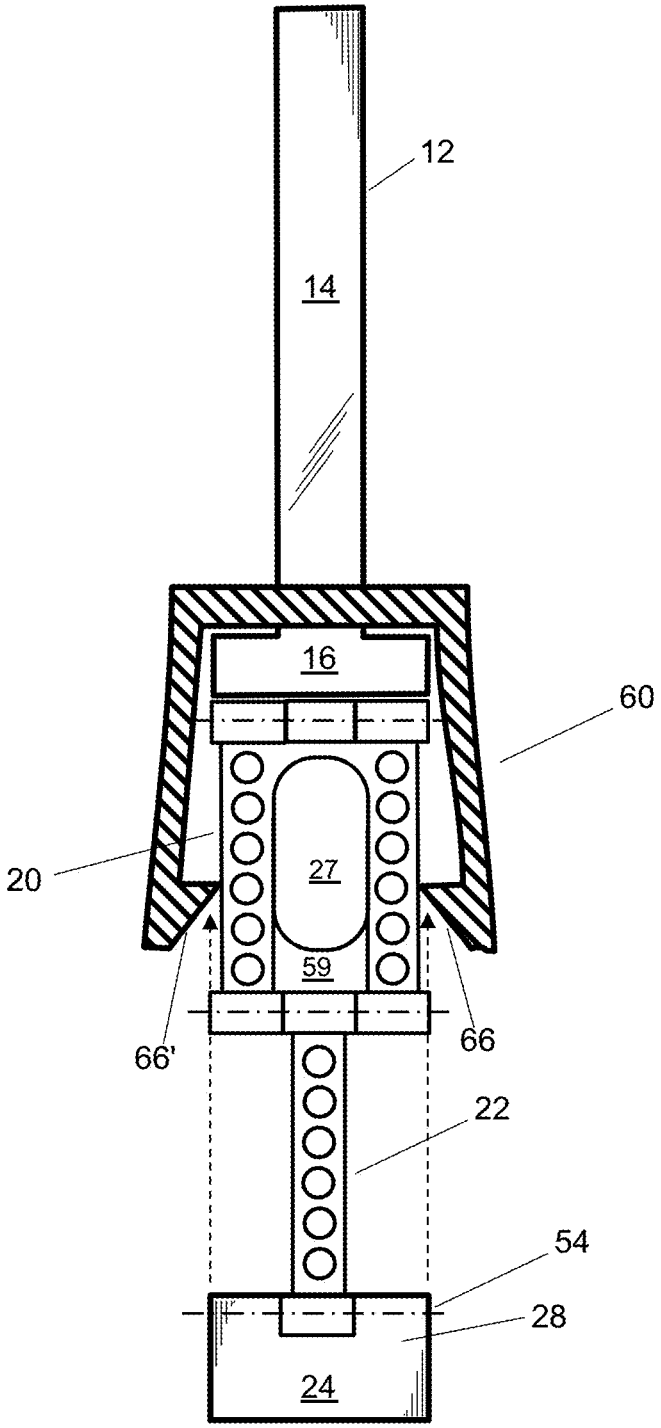
FIG. 13F shows a cross-section elevation end view of an example of a molded elastomeric top foot pad/protective front cover covering an assembly in an open position, according to the present invention.

FIG. 13F shows a cross-section elevation end view of an example of a molded/continuous elastomeric top foot pad/protective front cover 6, 60 covering the assembly 10 from FIG. 13D in an open position, according to the present invention. The sloped, interior ramp of the internal hooks 66, 66' serve to smoothly spring-open the elastic cover plates 60, 60' when bottom foot plate 24 is moved upwards during the closing process.

Figure 13G:
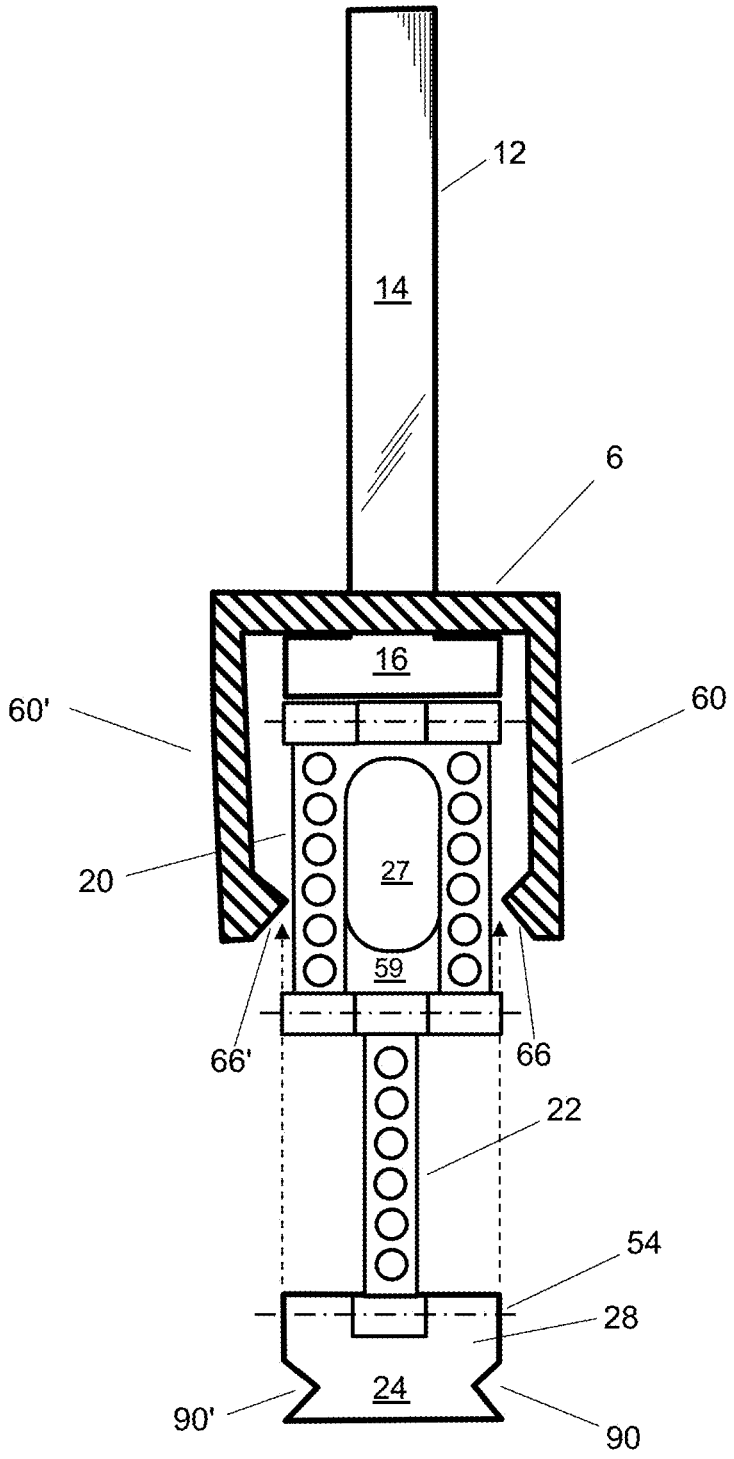
FIG. 13G shows a cross-section elevation end view of an example of a molded elastomeric top foot pad/protective front cover covering an assembly in an open position, according to the present invention.

FIG. 13G shows a cross-section elevation end view of an example of a molded elastomeric top foot pad/protective front cover 6, 60 covering the assembly 10 from FIG. 13E in an open position, according to the present invention. The sloped, interior ramp of the internal chevron-protrusions 66, 66' serve to smoothly spring-open the elastic cover plates 60, 60' when bottom foot plate 24 is moved upwards during the closing process. When the assembly is fully-closed, the interior chevron bumps 66, 66' snap-shut in the bottom plate's longitudinal grooves 90 and 90', respectively.

Figure 14:
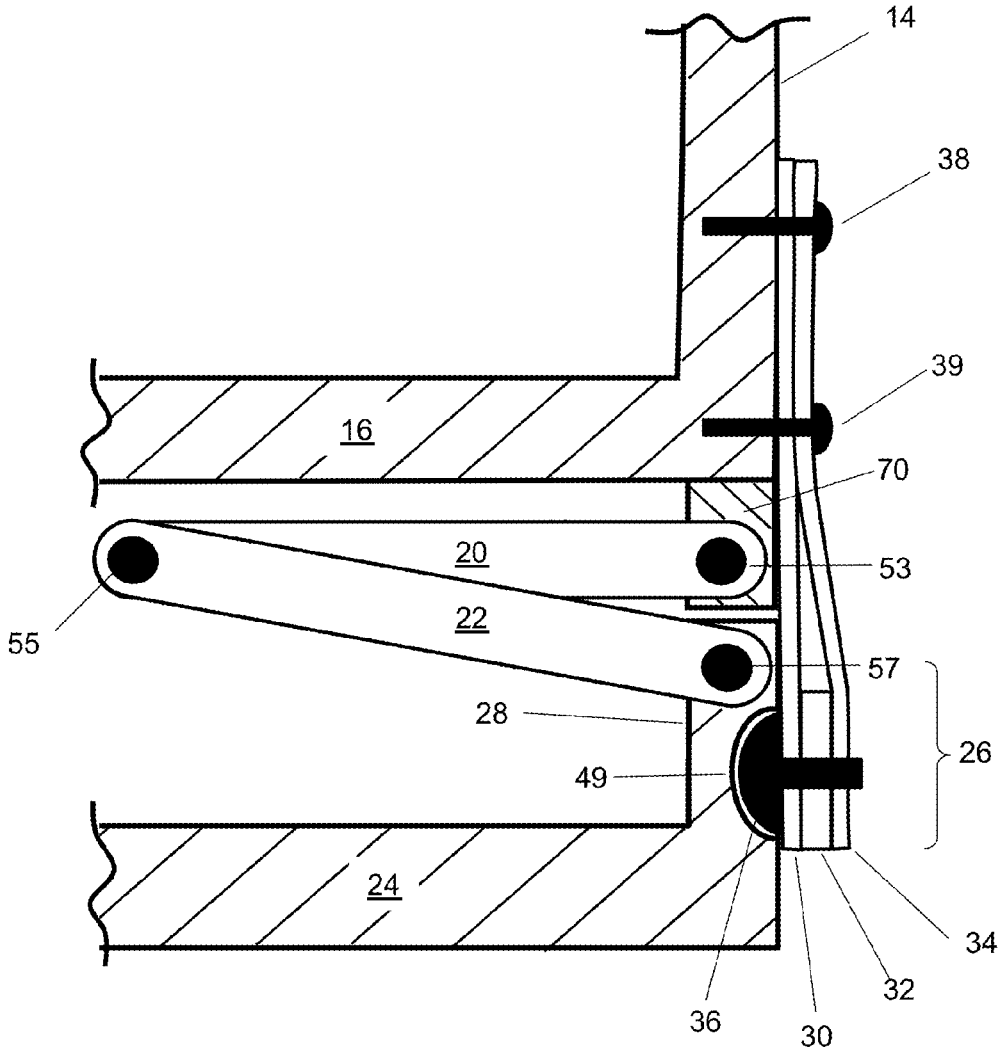
FIG. 14 shows an elevation view of the front side of an example of a retractable stirrup extension in the closed position, according to the present invention.

FIG. 14 shows an elevation view of the front side of an example of a retractable stirrup extension 10 in the closed position, according to the present invention. In this example, side hinge block 18 has been removed, and stirrup 12 has been made wider to accommodate the missing material. Additionally, a pair of hinge mounting tabs 70, 70' have been added to the underside of top foot plate 16. The mounting tabs 70, 70' are made continuously integral (e.g., cast, integrally-machined, 3-D printed) with the top foot plate 16. Upper hinge plate 20 is rotatably mounted to mounting tab 70 via hinge pin 53.

Figure 15A:
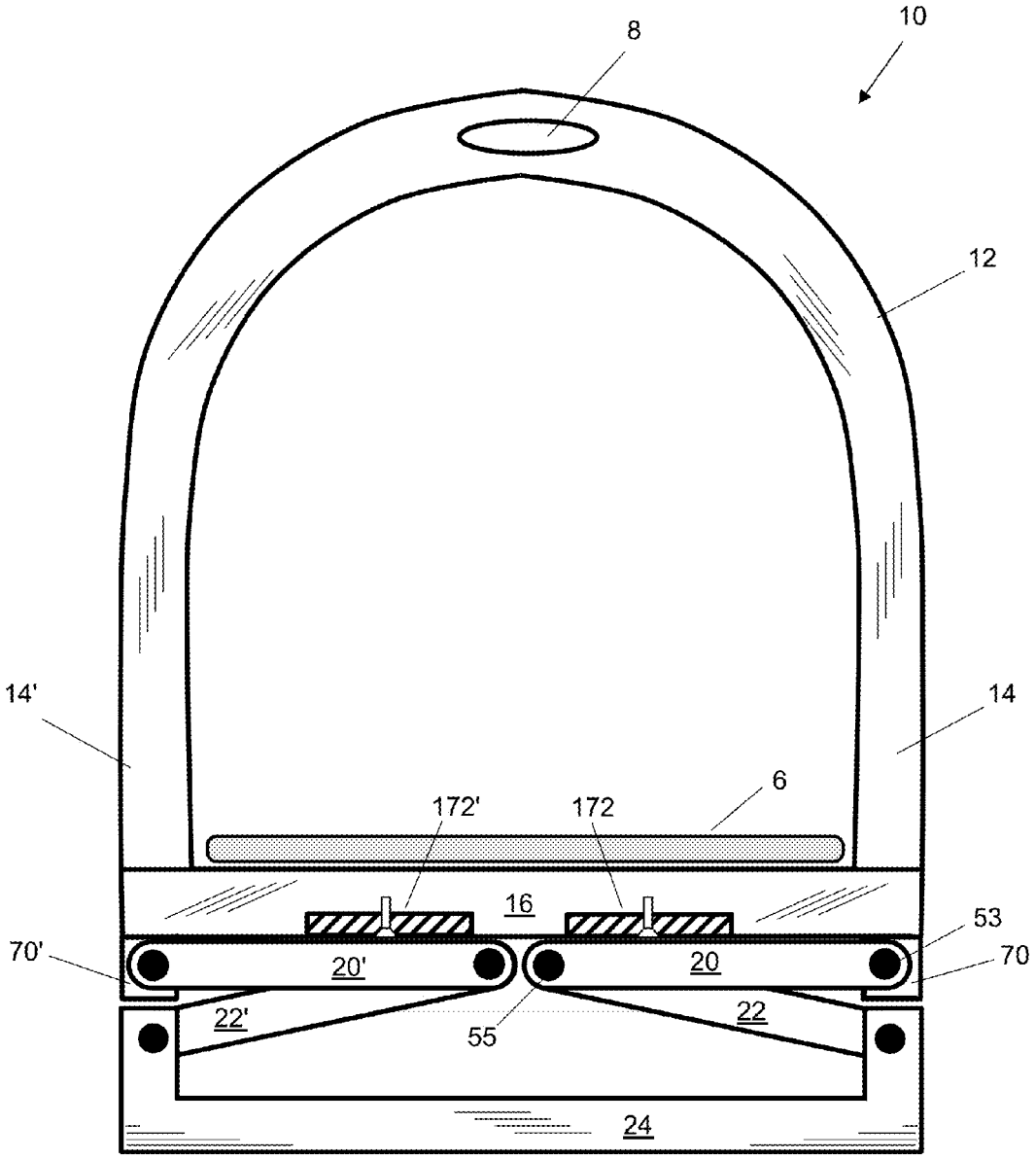
FIG. 15A shows an elevation view of the front side of an example of a retractable stirrup extension in the closed position, according to the present invention.

FIG. 15A shows an elevation view of the front side of an example of a retractable stirrup extension 10 in the closed position, according to the present invention. In this example, side hinge block 18 has been removed, and stirrup 12 has been made wider. Additionally, a pair of hinge mounting tabs 70, 70' have been added to the underside of top foot plate 16. The mounting tabs 70, 70' are made continuously integral (e.g., cast, machined, 3-D printed) with the top foot plate 16. Upper hinge plate 20 is rotatably mounted to mounting tab 70 via hinge pin 53. A pair of recessed magnets, 172, 172' are disposed in a recess on the underside of top foot plate 16. Magnets 172, 172' securely hold upper hinge plate 20, 20', respectively, when the assembly 10 is folded in the closed position. In this case, upper hinge plates 20, 20', must be made of a ferromagnetic material (e.g., steel).

Figure 15B:
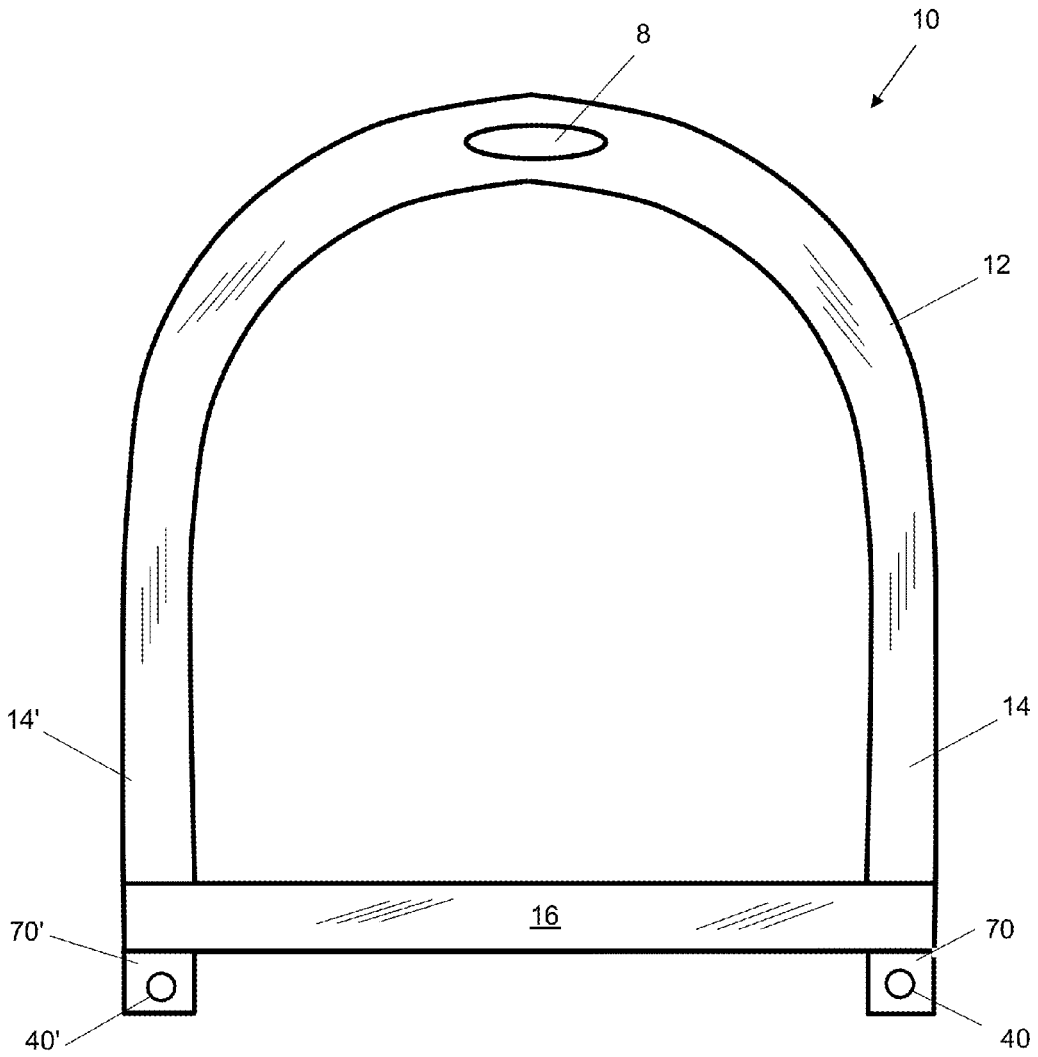
FIG. 15B shows an elevation view of the front side of an example of a retractable stirrup extension in the closed position, according to the present invention.

FIG. 15B shows an elevation view of the front side of an example of a retractable stirrup extension in the closed position, according to the present invention. Retractable stirrup extension assembly 10 comprises a conventional upper stirrup 12 and a retractable lower stirrup 2. Upper stirrup 12 comprises a horizontal top foot plate 16 attached to vertical side stirrup legs 14, 14', which are attached to upper arch 9. In this example, side hinge block 18 has been removed, and stirrup 12 has been made wider. Additionally, a pair of hinge mounting tabs 70, 70' have been added to the underside of top foot plate 16. The mounting tabs 70, 70' are made integral (e.g., cast, machined) with the top foot plate 16.

Figure 16:
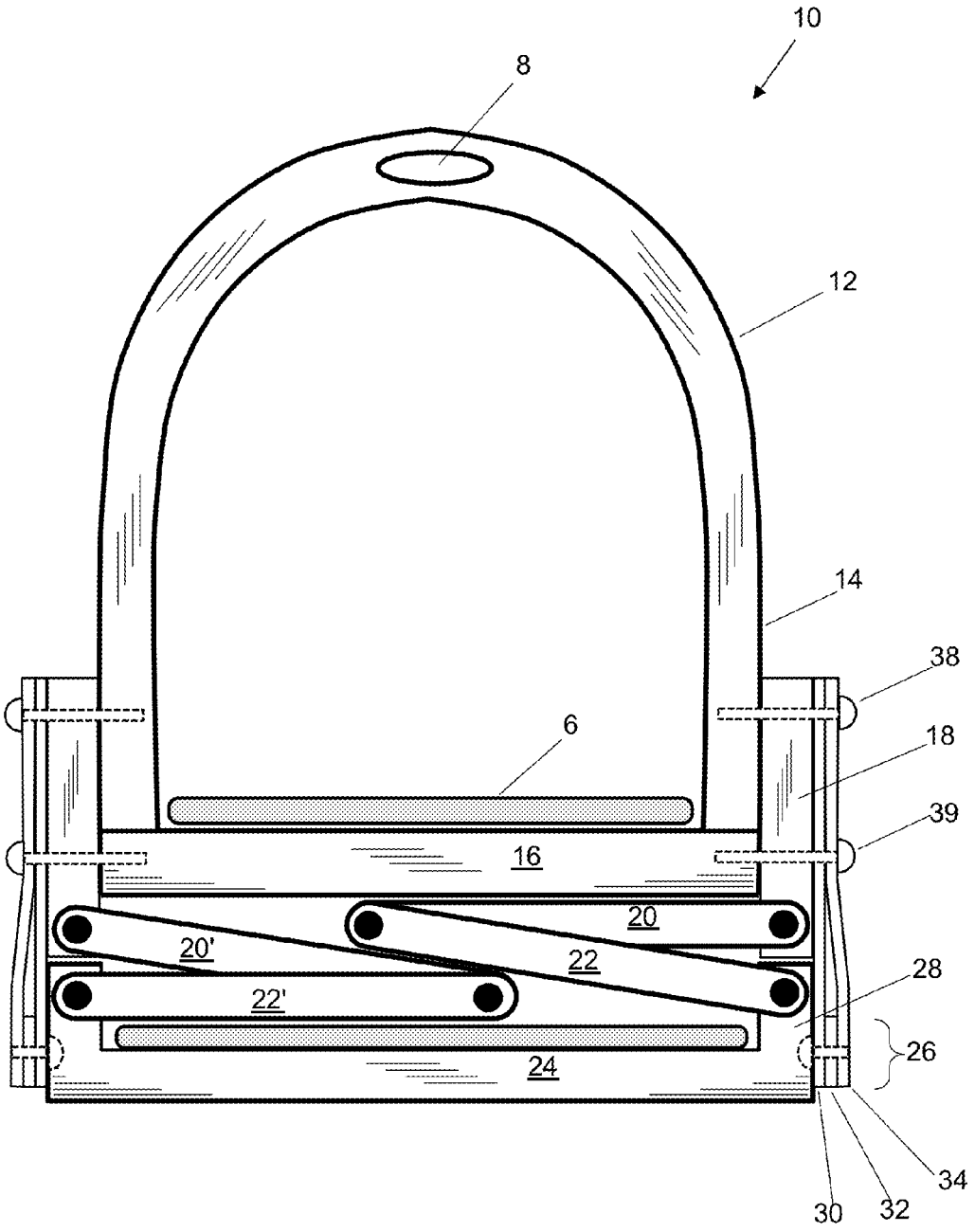
FIG. 16 shows an elevation view of the front side of an example of a retractable stirrup extension in the closed position, according to the present invention.

FIG. 16 shows an elevation view of the front side of an example of a retractable stirrup extension 10 in the closed position, according to the present invention. In this example, hinge plates 20, 20', and 22, 22' are made longer than those previously shown (e.g., FIG. 1). In this case, the right, linked pair of upper and lower hinge plates 20, 22 overlap the left linked pair of upper and lower hinge plates 20', 22' by an overlap distance equal to about 25% to 75% of the length of one of the hinge plates. In other embodiments (not illustrated), the hinge plates can overlap as much as 75% of their length. Allowing for the hinge plates to overlap allows a greater vertical travel (extension) of the bottom foot plate 24, while still having a compact configuration when closed.

Figure 17:
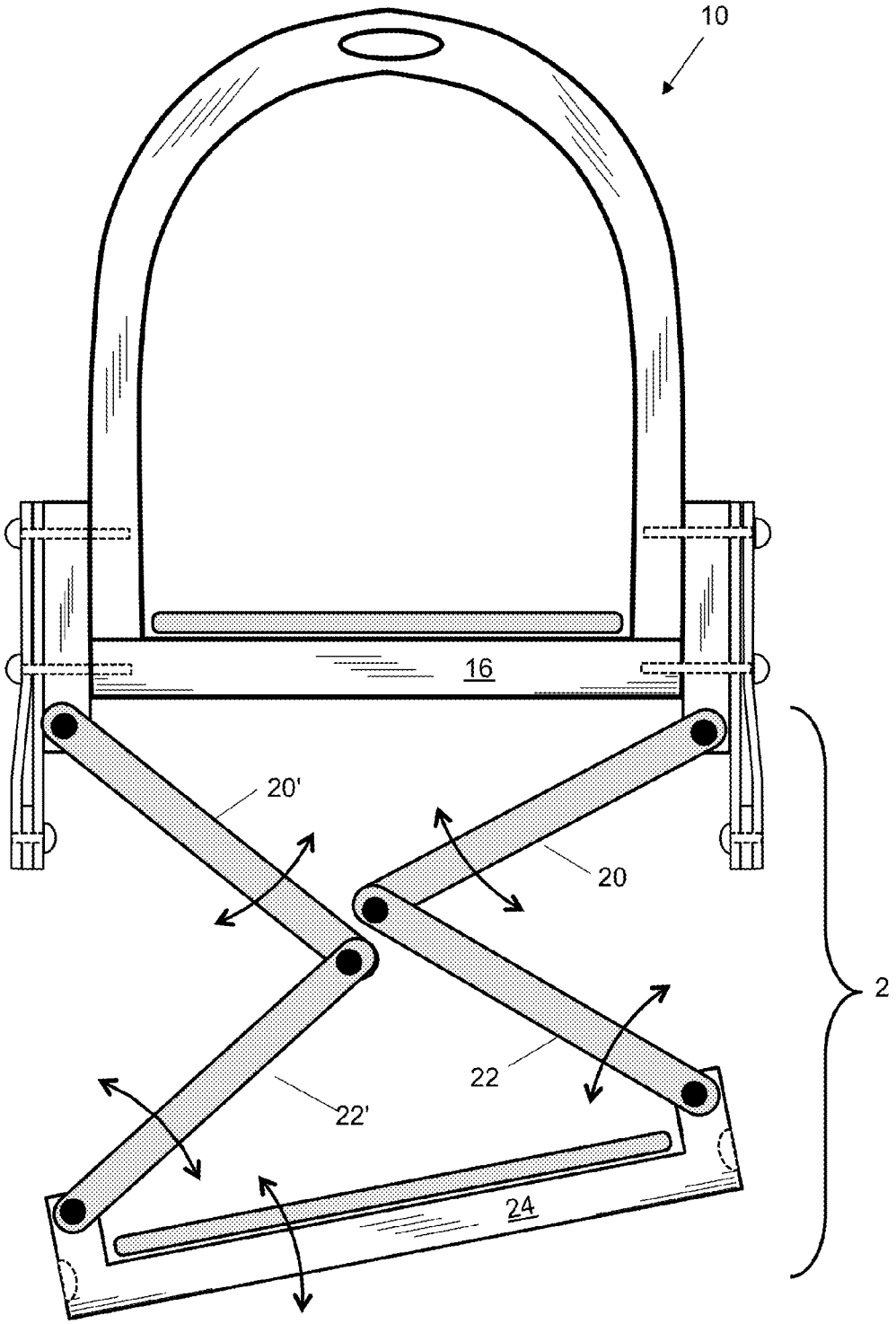
FIG. 17 shows an elevation view of the front side of the example of FIG. 16 of a retractable stirrup extension in a partially-open position, according to the present invention.

FIG. 17 shows an elevation view of the front side of the example of FIG. 16 of a retractable stirrup extension 10, with overlapping hinge plates, in a partially-open position, according to the present invention. Because the hinge plates at long enough that they overlap when closed, a rotation of the bottom foot plate 24 of about 10° is required to prevent binding (touching) of the middle hinge pins when partially-extended.

Figure 18:
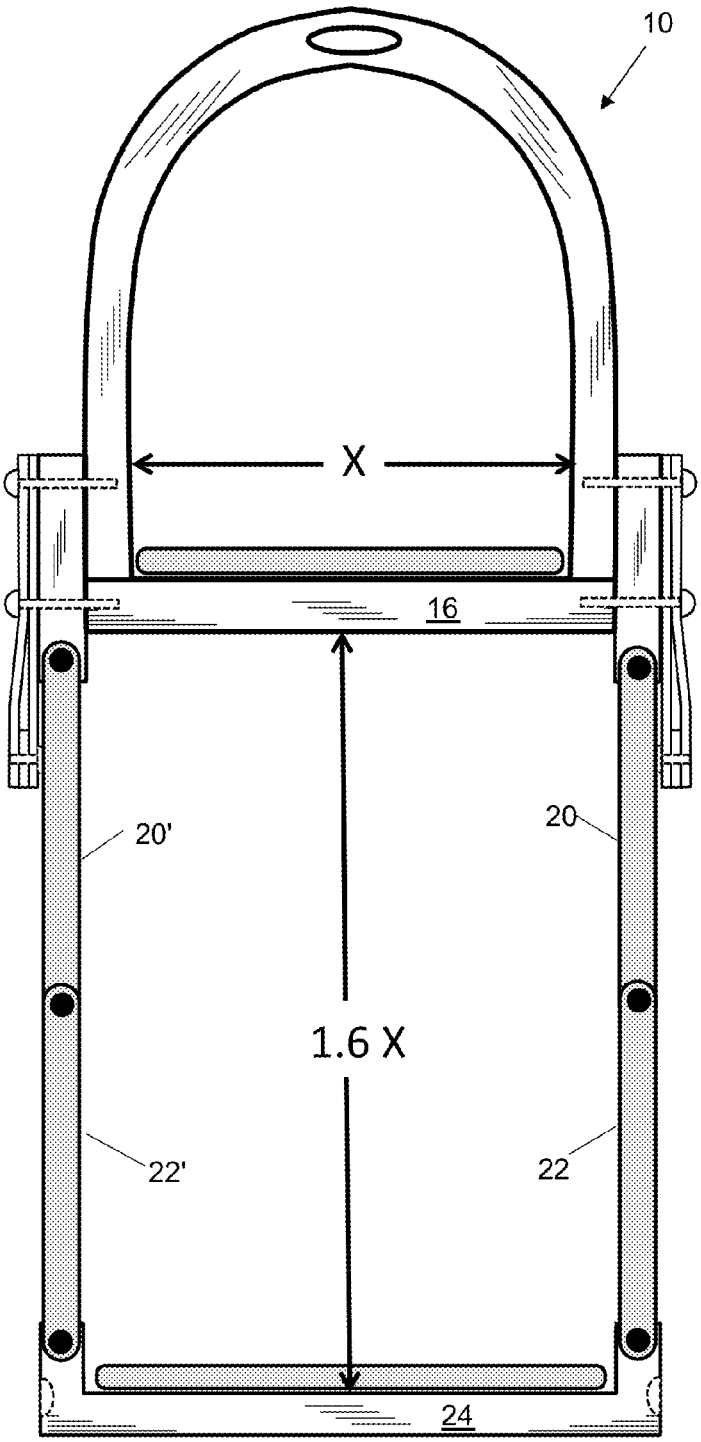
FIG. 18 shows an elevation view of the front side of the example of FIG. 16 of a retractable stirrup extension in the open position, according to the present invention.

FIG. 18 shows an elevation view of the front side of the example of FIG. 16 of a retractable stirrup extension 10, with overlapping hinge plates, in the open position, according to the present invention. In this example (which has 25% overlapping hinge plates), for a width=X of the upper stirrup (above top foot plate 16), this translates to a vertical extension=1.6 X. For example, if the width of the top foot plate is 5", this translates to a vertical extension of 8" when the assembly is fully open. The extension ratio is 8/5=1.6.

Figure 19:
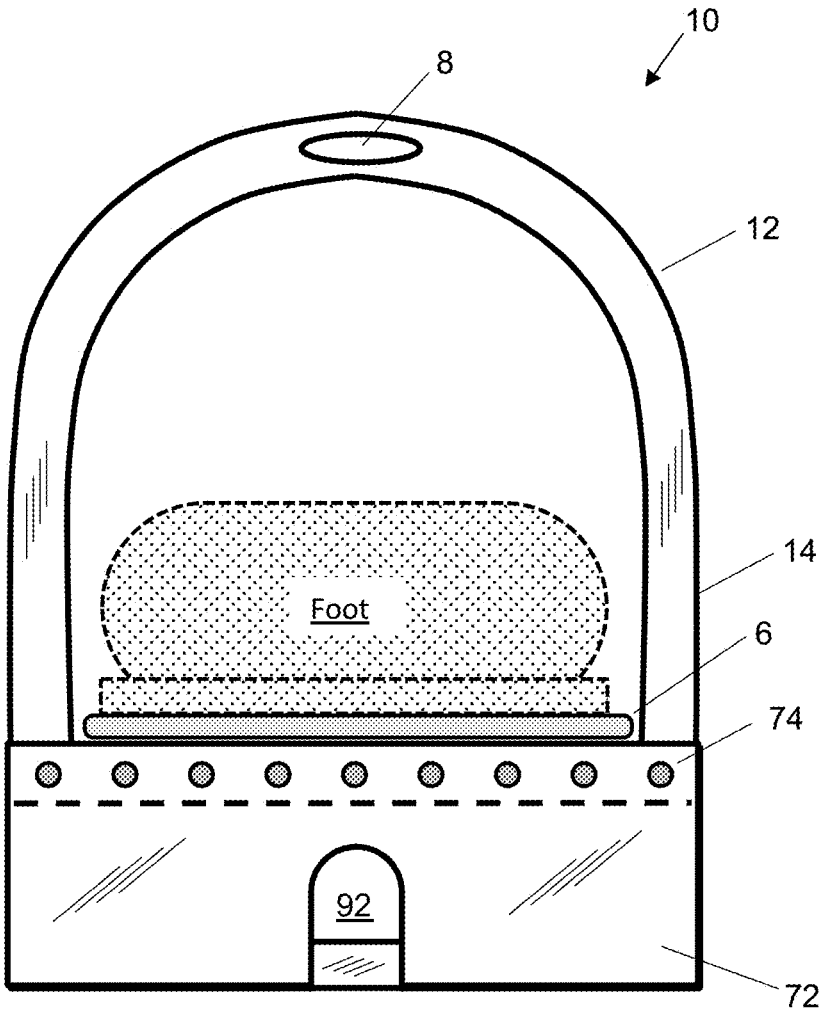
FIG. 19 shows an elevation view of the front side of an example of a retractable stirrup extension in the closed position, with a protective front cover, according to the present invention.

FIG. 19 shows an elevation view of the front side of an example of a retractable stirrup extension 10 in the closed position, with a protective front cover 72, according to the present invention. Front cover 72 is made of sheet metal, and can be spot-welded to the top foot plate 16 via spot welds 74 (or attached with screws, not shown). Front cover plate 72 prevents any small branches or limbs of trees or brushes from accidently sticking into the open gap between the top and bottom foot plates, possibly causing a fall. Front cover 72 can comprise a finger hole 92 for aiding the release of bottom foot plate 24.

Figure 20:
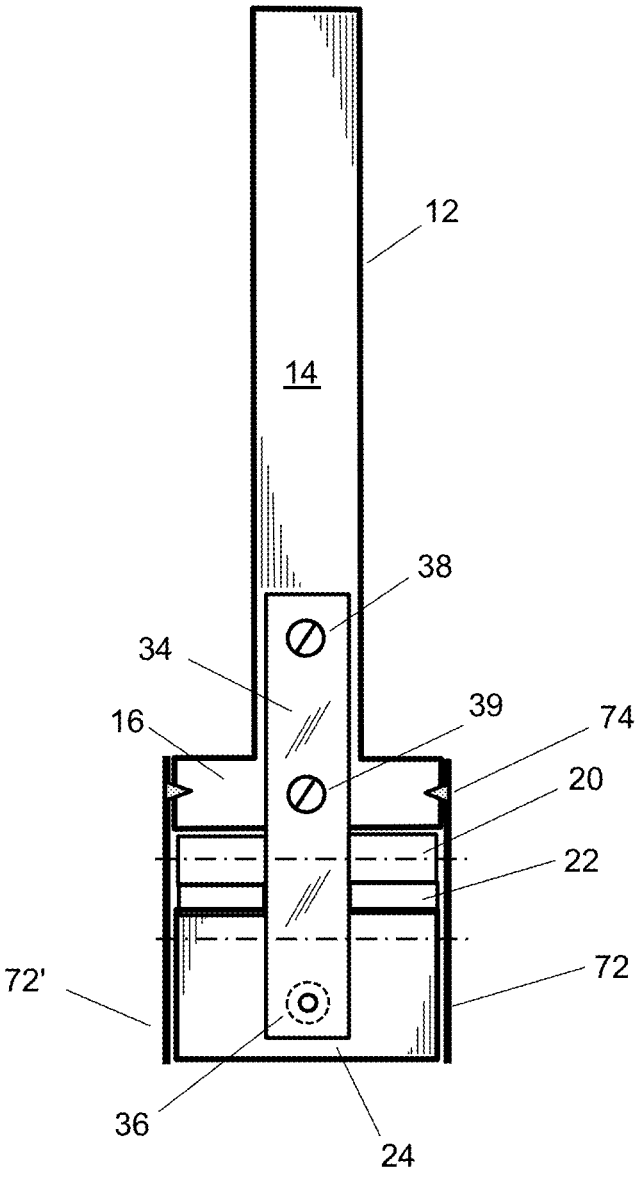
FIG. 20 shows an elevation view of the end of an example of a retractable stirrup extension in the closed position, with a protective front cover, according to the present invention.

FIG. 20 shows an elevation view of the end of an example of a retractable stirrup extension in the closed position, with a protective front cover 72, 72' according to the present invention. Front cover 72 is made of sheet metal, and can be spot-welded to the top foot plate 16 via spot welds 74. In this example, front cover 72, 72' simply serves as a protective cover, and does not have a latching function.

Figure 21:
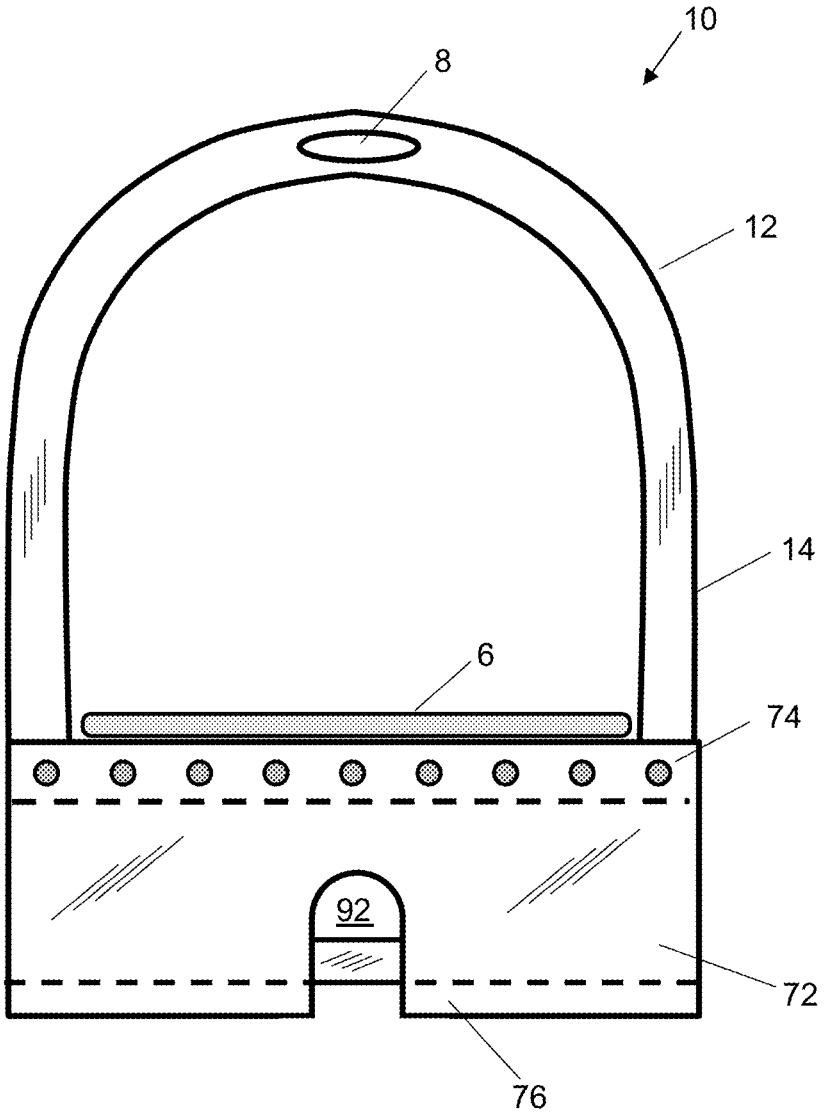
FIG. 21 shows an elevation view of the front side of an example of a retractable stirrup extension in the closed position, with a protective, latching front cover, according to the present invention.

FIG. 21 shows an elevation view of the front side of an example of a retractable stirrup extension in the closed position, with a protective, latching front cover 72, according to the present invention. Front cover 72 is made of sheet metal, and can be spot-welded to the top foot plate 16 via spot welds 74. The bottom edge 76 of cover 72 is turned up in the shape of a "J", which acts as a hook to latch the bottom foot plate 24 when closed.

Figure 22A:
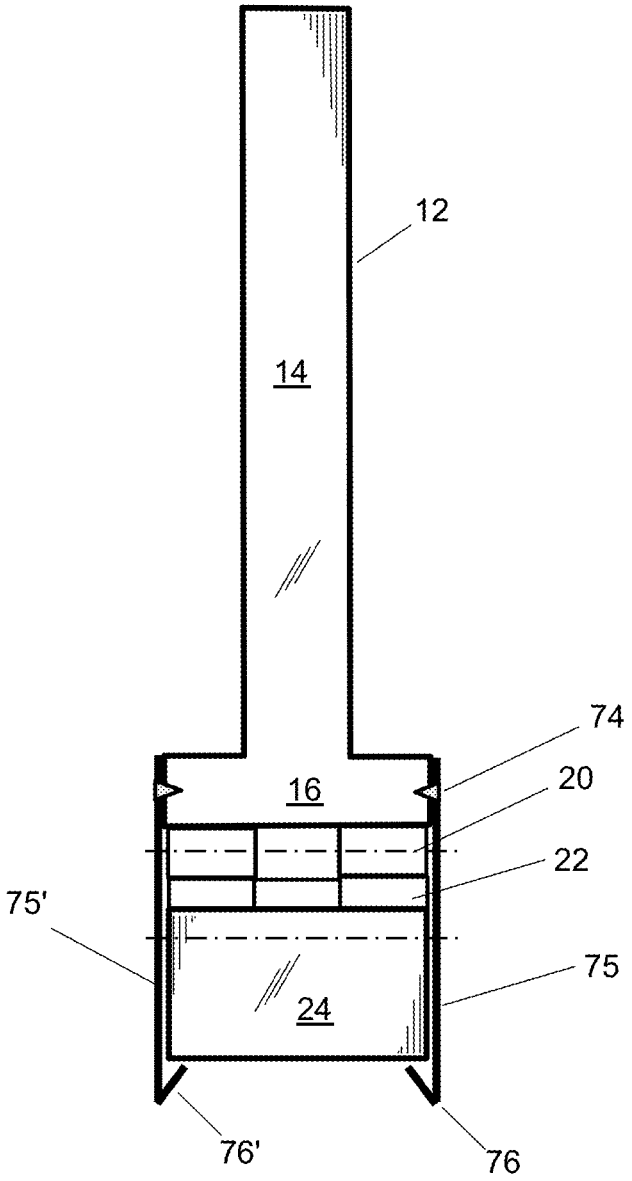
FIG. 22A shows an elevation view of the end of an example of a retractable stirrup extension in the closed position, with a latching front cover, according to the present invention.

FIG. 22A shows an elevation view of the end of an example of a retractable stirrup extension in the closed position, with a latching front cover 75, according to the present invention. Hooked ends 76, 76' grab the bottom surface of bottom foot plate 24 and holds it securely when in the closed position. Assembly 10 is released by reaching behind the cover plate 75 and pulling outwards on the hooked end 76.

Figure 22B:
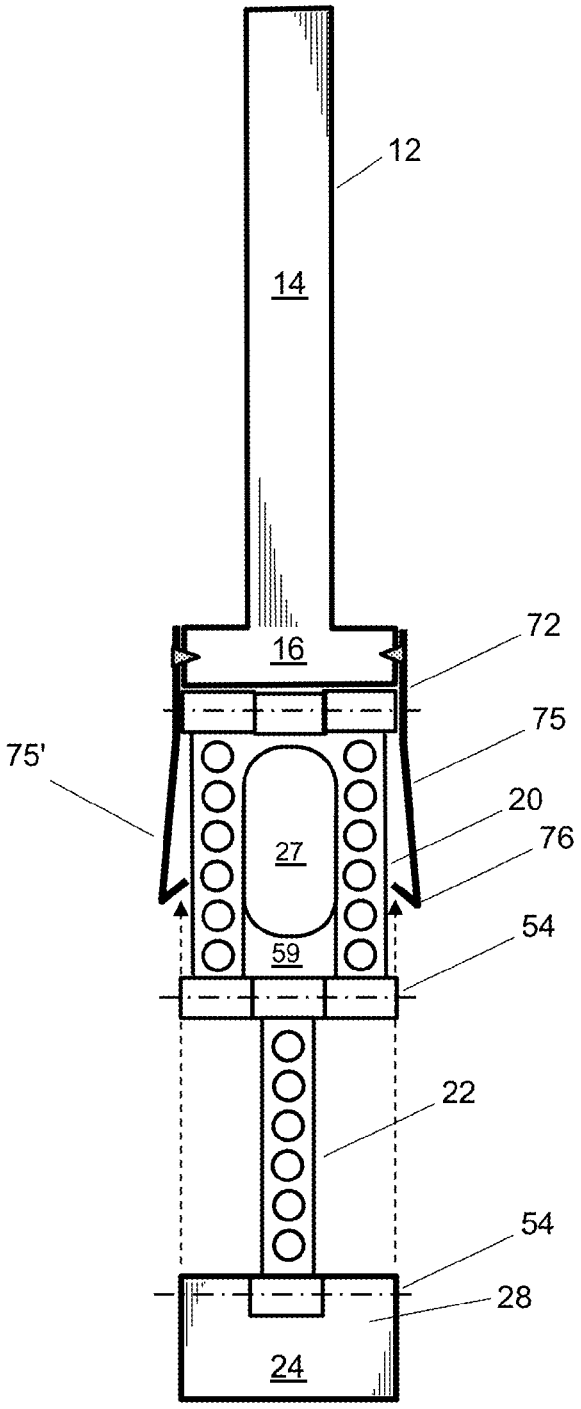
FIG. 22B shows an elevation view of the end of an example of a retractable stirrup extension in the open position, with a latching front cover, according to the present invention.

FIG. 22B shows an elevation view of the end of an example of a retractable stirrup extension 10 in the open position, with latching front cover plates 75, 75' according to the present invention.

Figure 23:
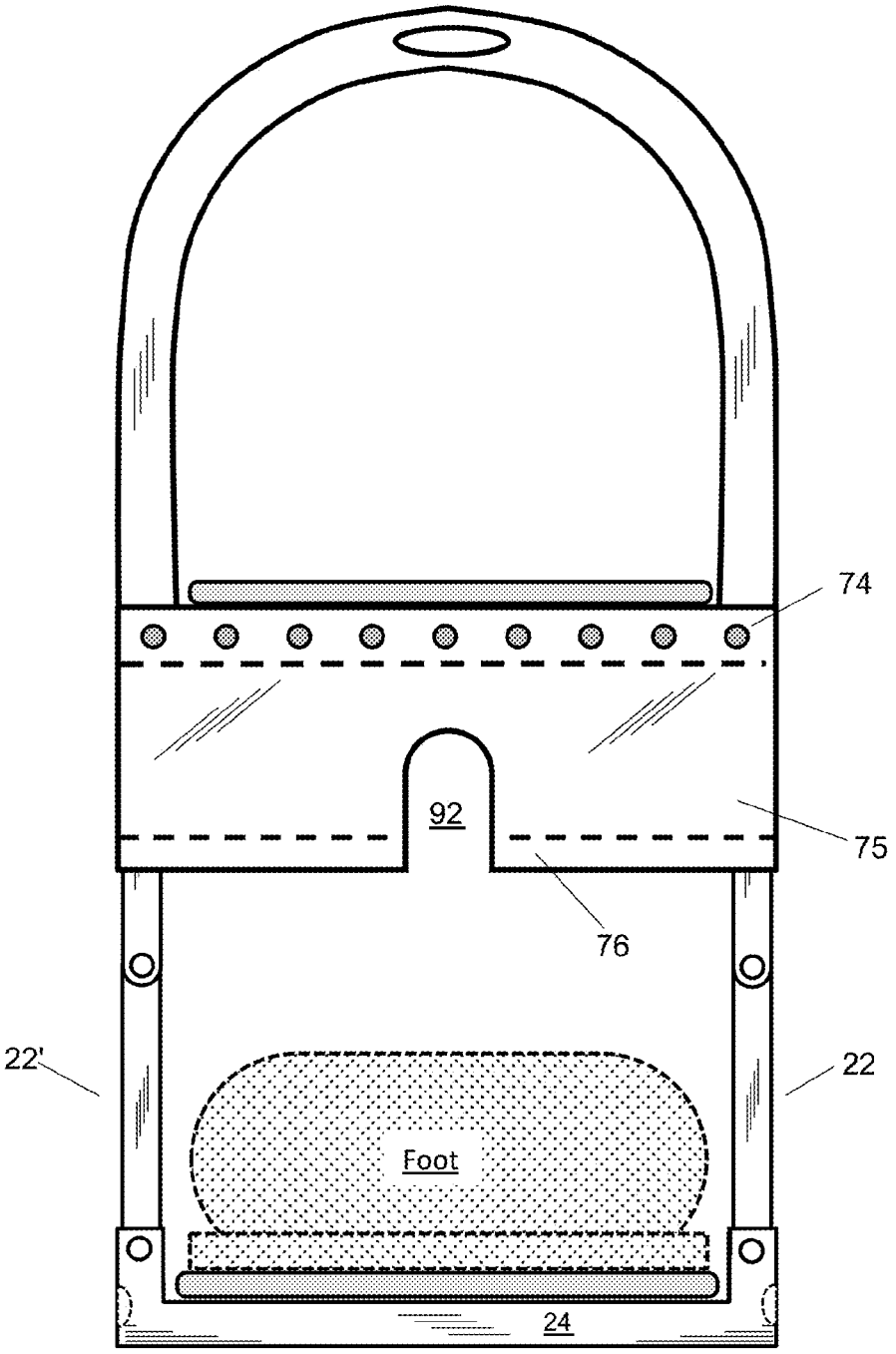
FIG. 23 shows an elevation view of the end of an example of a retractable stirrup extension in the open position, with a protective, latching front cover, according to the present invention.

FIG. 23 shows an elevation view of the front of an example of a retractable stirrup extension in the open position, with a protective, latching front cover plate 75, according to the present invention.

Figure 24:
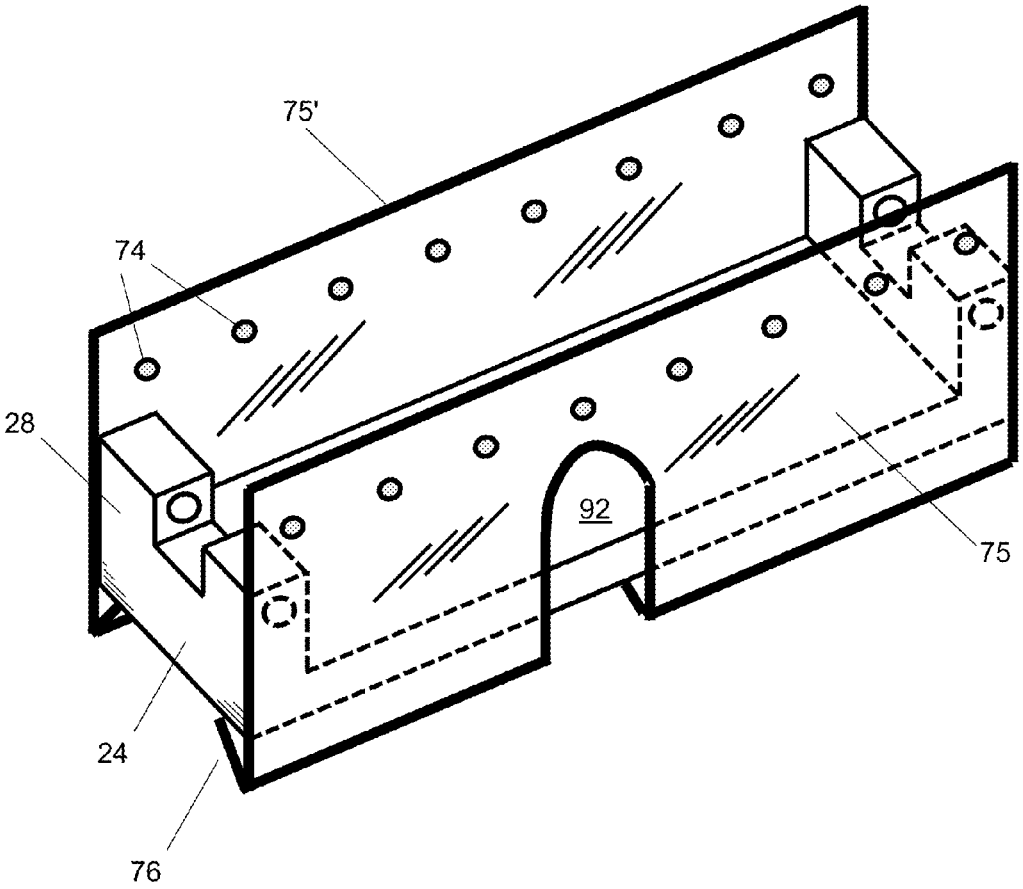
FIG. 24 shows an isometric perspective view of the end of an example of a bottom foot plate, with a pair of protective, latching front cover plates, according to the present invention.

FIG. 24 shows an isometric perspective view of the end of an example of a bottom foot plate 24, with a pair of protective, latching front cover plates 75, 75', according to the present invention, and J-hooks 76, 76'.

Figure 25:
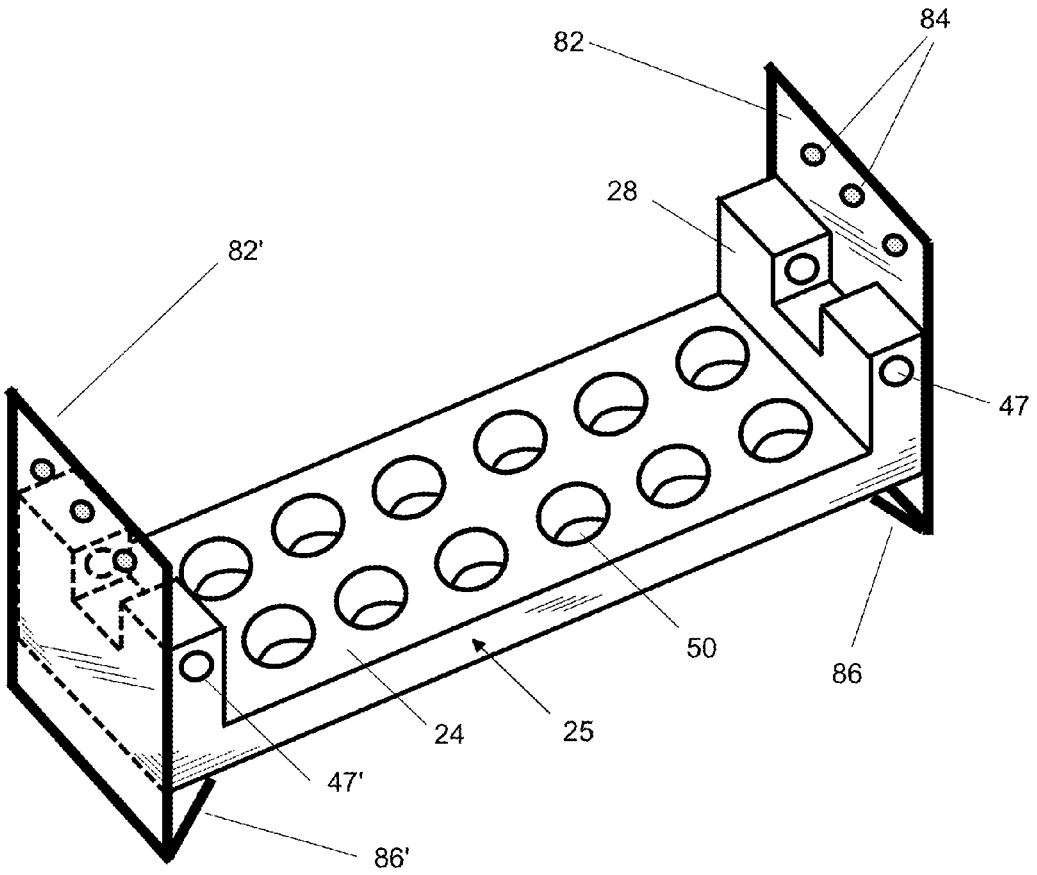
FIG. 25 shows an isometric perspective view of the end of an example of a bottom foot plate, with a pair of protective, latching end strips, according to the present invention.

FIG. 25 shows an isometric perspective view of the end of an example of a bottom foot plate 24, with a pair of protective, latching end strips 82, 82', according to the present invention. Latching end strips 82, 82' are made of sheet metal, and have a turned-up "J" hook 86, 86' on the bottom edge, which serves to latch the bottom foot plate 24 when in a closed position. Assembly 10 is released by reaching behind the latching strips 82, 82' and pulling outwards on the hooked ends 86, 86'.

Optionally (not illustrated) a pair of protective front cover plates (see, e.g., cover plates 75 and 75' from FIG. 24) can be added to the protective, latching end strips shown in FIG. 25, in order to cover the open gap between the top and bottom plates 16, 24 respectively. In this case, all four sides of the hinge plates would be fully covered (e.g., with sheet metal plates, or urethane rubber covers).

Figure 26A:
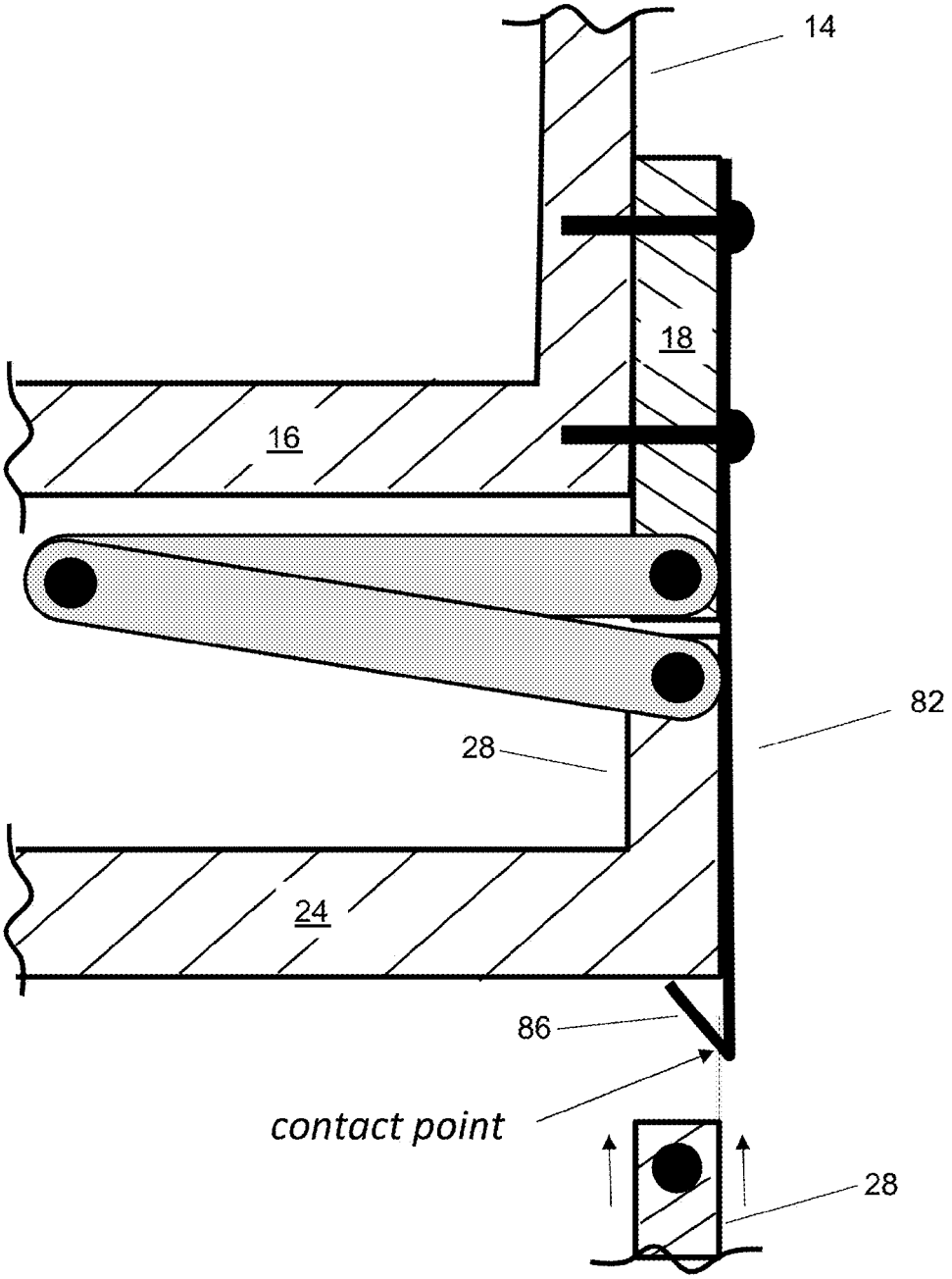
FIG. 26A shows an elevation view of the end of an example of a retractable stirrup extension in the closed position, with a protective, latching end strip, according to the present invention.

FIG. 26A shows an elevation view of the end of an example of a retractable stirrup extension 10 in the closed position, with a protective, latching end strip 82, according to the present invention. When moving the bottom foot plate 24 in an upwards direction from a partially-extended position, contact of the plate's corner with the sloped, ramp of the hooked, latching end 86 of strip 82 causes the latching end 86 to move to the right and spread open. Continual motion of the bottom foot plate 24 upwards causes the assembly 10 to close, up until the point is reached where the latching end 86 springs free of the bottom right hand corner of plate 24 and snaps shut underneath the bottom of bottom foot plate 24, thereby latching closed the assembly 10.

Figure 26B:
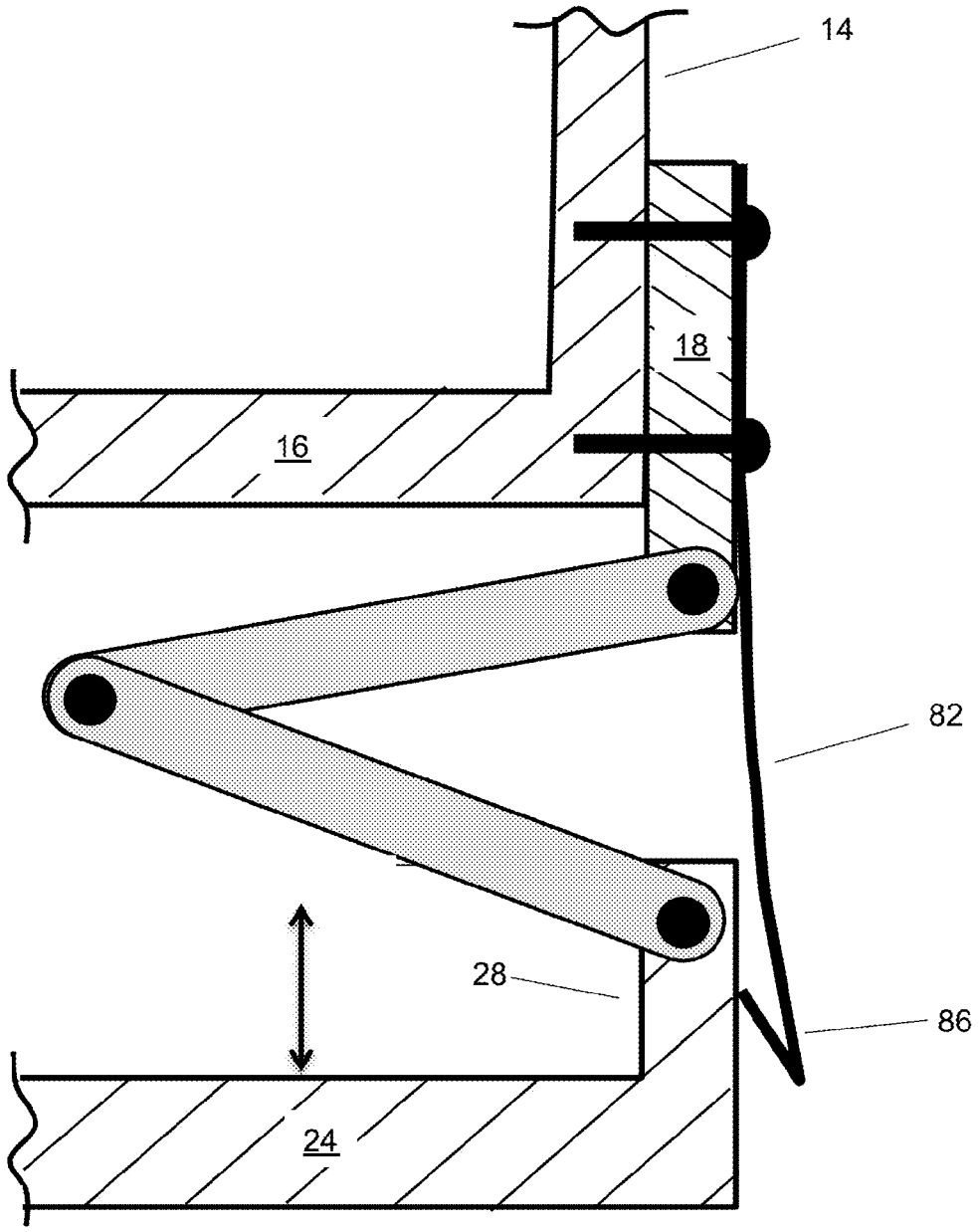
FIG. 26B shows an elevation view of the end of an example of a retractable stirrup extension in a partially-extended position, with a protective, latching end strip, according to the present invention.

FIG. 26B shows an elevation view of the end of an example of a retractable stirrup extension in a partially-extended position, with a protective, latching end strip 82, according to the present invention.

Figure 26C:
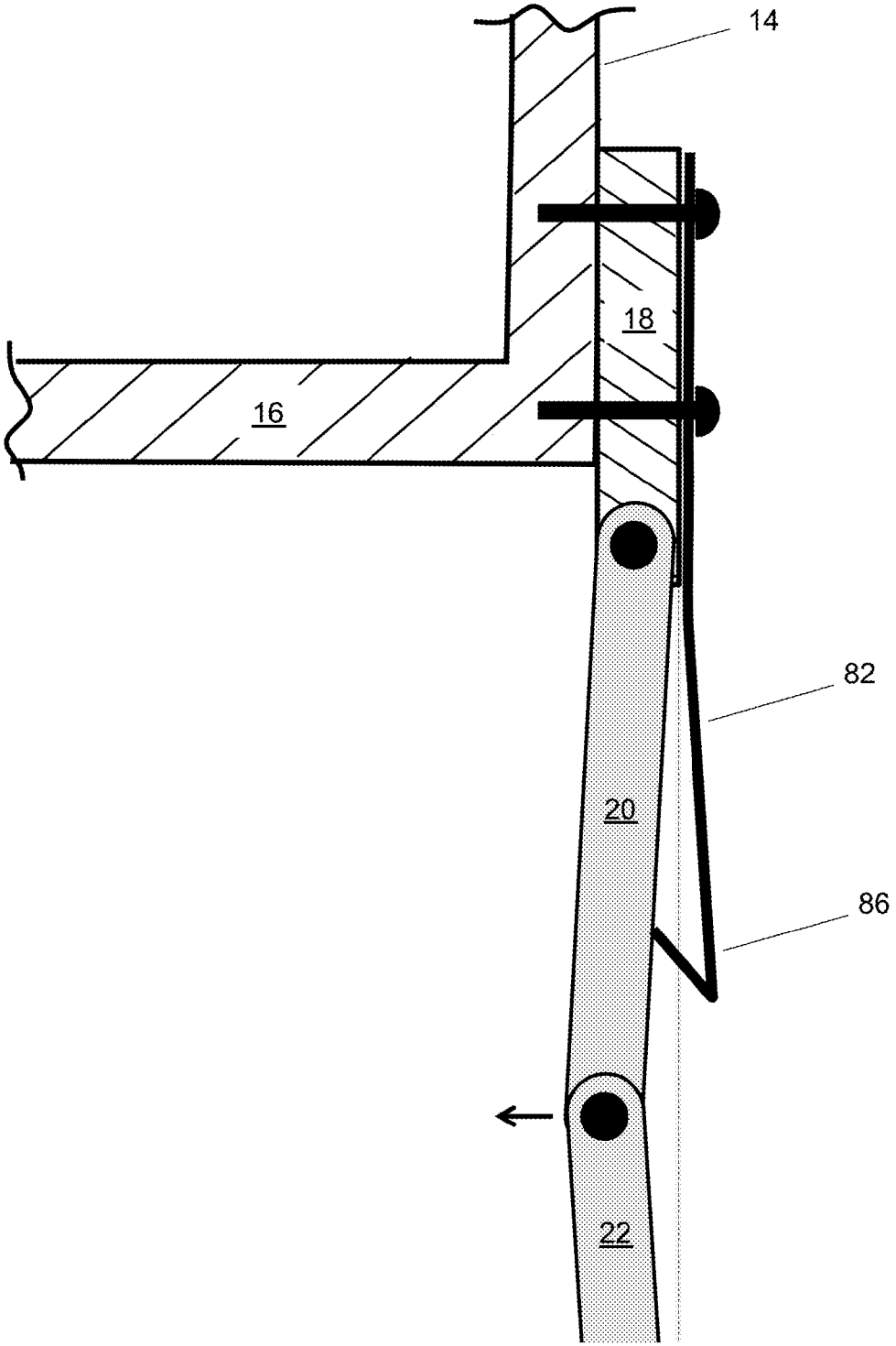
FIG. 26C shows an elevation view of the end of an example of a retractable stirrup extension in the open position, with a protective, latching end strip, according to the present invention.

FIG. 26C shows an elevation view of the end of an example of a retractable stirrup extension 10 in the open position, with a protective, latching end strip 82, according to the present invention. Note that the hooked lower end 86 of latching strip 82 touches the side of upper hinge plate 20 when the assembly is nearly 100% open. Stepping into the bottom foot plate 24 will provide enough force to fully open assembly 10, thereby deflecting spring strip 82 outwards. However, after the foot has been removed, spring strip 82 will push back on upper hinge plate 20 and cause a small of rotation of hinge plate 20 back towards the closed position. This is a useful feature, because when a hand is placed on the bottom foot plate 24 and then force applied by the hand to push the bottom plate 24 upwards, the hinge assembly (20, 22, and 20', 22') is already "pre-compressed" a small amount, which increases the ease of closing the assembly 10.

Figure 27:
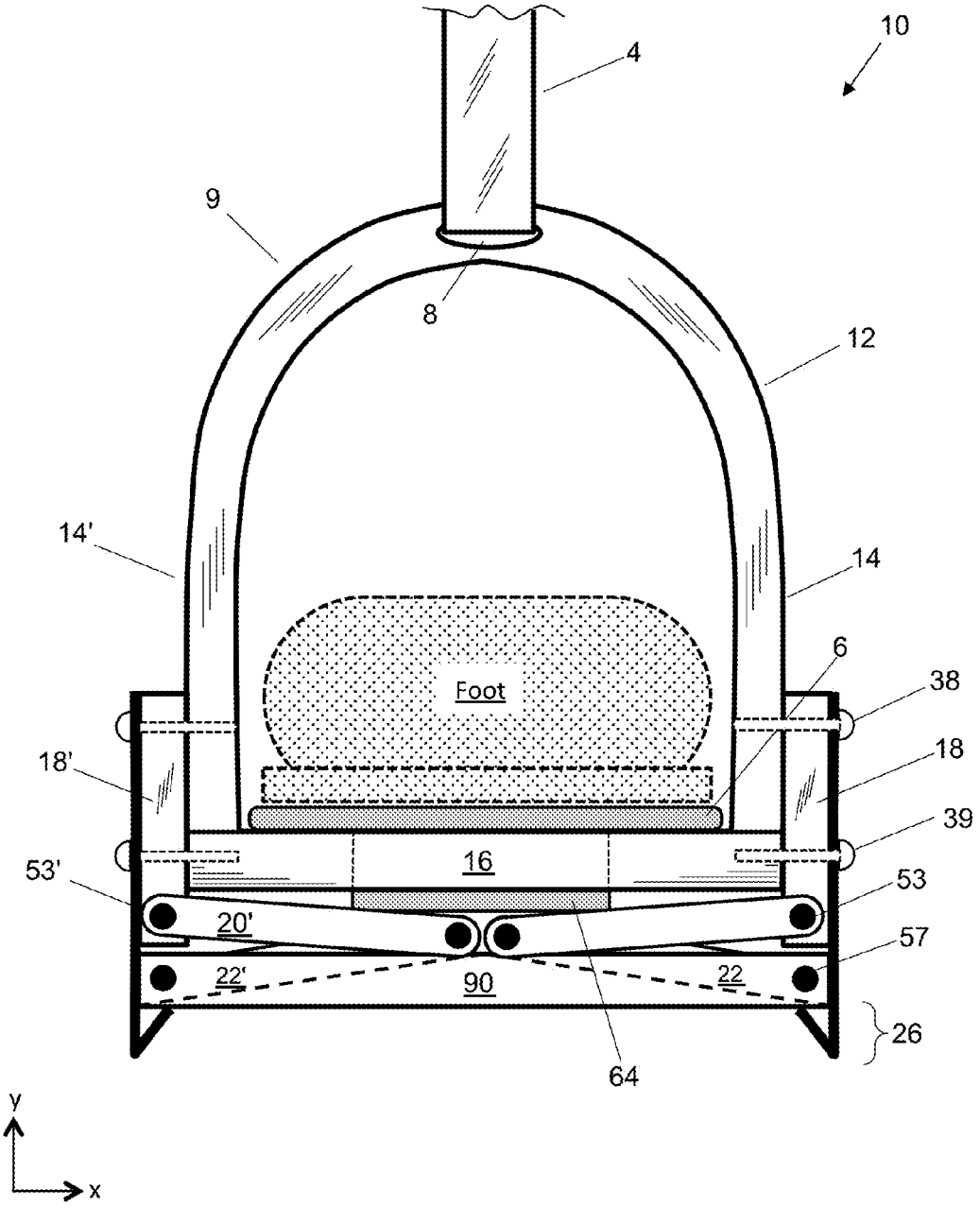
FIG. 27 shows an elevation view of the front side of an example of a retractable stirrup extension in the closed position, according to the present invention.

FIG. 27 shows an elevation view of the front side of an example of a retractable stirrup extension in the closed position, according to the present invention. In this example, bottom foot plate 90 has a pair of left and right machined (or cast or 3-D printed) recessed ramps (ramped at about 10° from the horizontal) that allows a more compact configuration of hinge plates when folded up. Note: flange 64 of top pad 6 is shown, disposed just underneath top foot plate 16. Top hinge plates 20, 20' are rotated downwards slightly to accommodate the placement of flange 64.

Figure 28A:
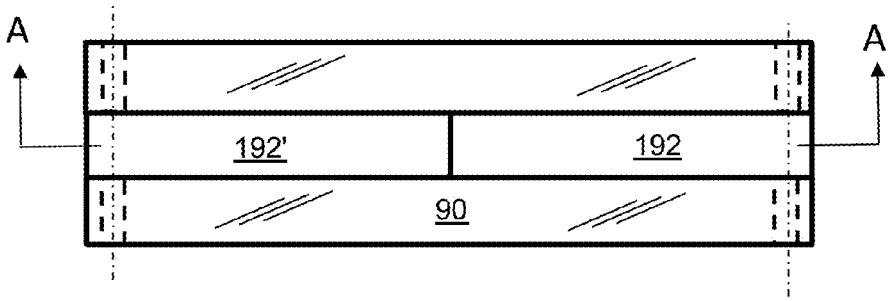
FIG. 28A shows a top view of the top side of an example of a bottom foot plate with a pair of recessed ramps, according to the present invention.

FIG. 28A shows a top (plan) view of the top side of an example of a bottom foot plate 90 with a pair of left and right recessed ramps 192, 192' down the center, according to the present invention. Recessed ramps 192, 192' are angled at about 10° from the horizontal. The ramps provide extra, more compact space for holding the lower hinge plates 22, 22', respectively.

Figure 28B:
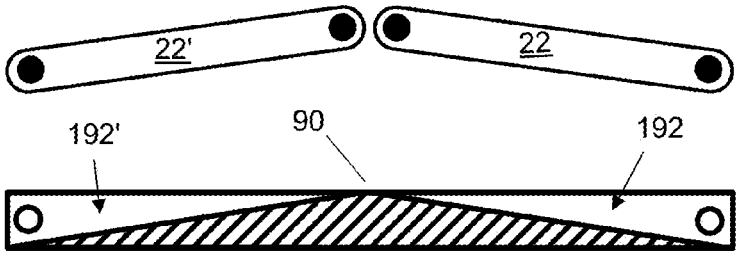
FIG. 28B shows an elevation cross-section view of the side of an example of a bottom foot plate with a pair of recessed ramps, according to the present invention.

FIG. 28B shows an elevation cross-section view of the side of an example of a bottom foot plate 90 with a pair of recessed ramps 192, 192' down the center, according to the present invention. Note that hinge pin holes 57, 57' are located in the broad plane of plate 90 (as opposed to previously lying out of the plane and up on vertical side walls 28, 28' of bottom foot plate 24 (See, e.g., FIG. 1). This also allows for a more compact configuration.

Figure 29:
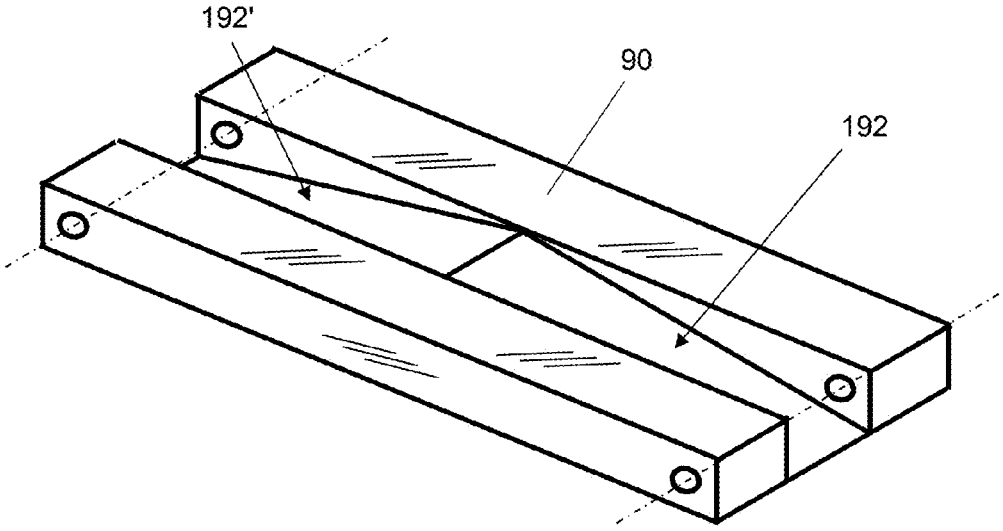
FIG. 29 shows an elevation end view of the side of an example of a bottom foot plate with a pair of recessed ramps, according to the present invention.

FIG. 29 shows an isometric perspective view of the side of an example of a bottom foot plate 90 with a pair of recessed ramps 192, 192' down the center, according to the present invention.

Figure 30:
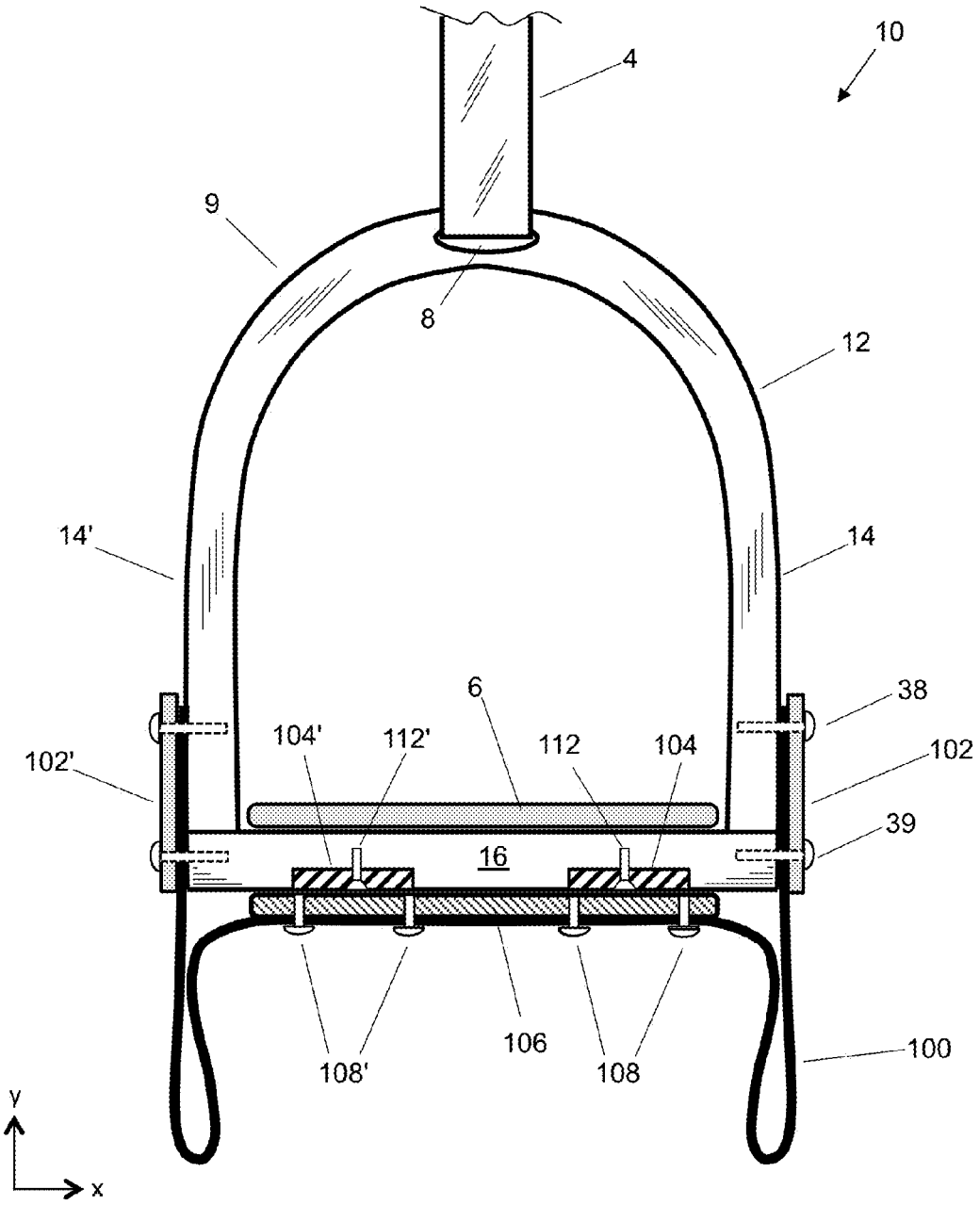
FIG. 30 shows an elevation view of the front side of an example of a retractable stirrup extension in the closed position, according to the present invention.

FIG. 30 shows an elevation view of the front side of an example of a retractable stirrup extension 10 in the closed position, according to the present invention. In this example, a pair of magnets 104, 104' are disposed within a pair of recesses on the underside of top foot plate 16. Magnets 104, 104', which function as the latching mechanism, are attached to top foot plate 16 with screws 112, 112'. Bottom foot plate 106, which is made of a ferromagnetic material (e.g., steel), is held tight against the top foot plate 16 by magnetic force from the pair of magnets 104, 104'. The lower, retractable stirrup 101 is made of a thin, flexible braided or woven material 100, such as: a strong, fiber-based (polyamide) Kevlar® cloth, Spectra® Cloth, Nylon® cloth, or a flexible, composite fiber-reinforced elastomeric material (such as rubber, urethanes, reinforced with fiberglass, polyamide, or steel fibers), which hangs freely in the middle as a loop of the flexible material 100. The ends of lower stirrup 101 are attached to the vertical legs 14, 14' of the upper stirrup 12 via clamping plates 102, 102', which are, in turn, attached via screws 38 and 39, respectively. The middle of flexible material 100 is attached to bottom foot plate 106 via a plurality of rivets 108, 108'. Note that the length of flexible stirrup 101 is unlimited, meaning that the distance of travel (extension) of bottom foot plate 106 is also unlimited (when unfolded).

Figure 31:
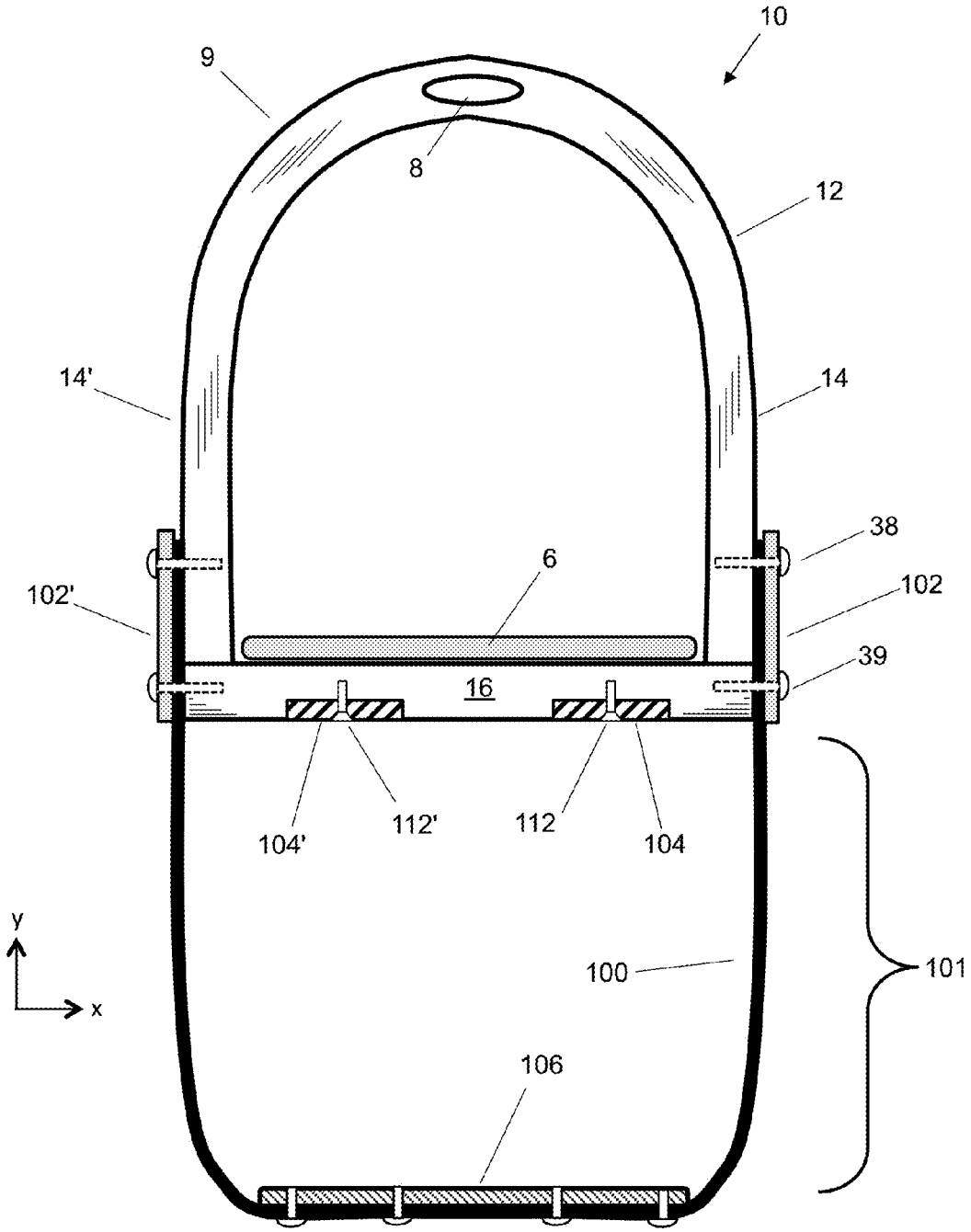
FIG. 31 shows an elevation view of the front side of an example of a retractable stirrup extension in the open position, according to the present invention.

FIG. 31 shows an elevation view of the front side of an example of a retractable stirrup extension 10 in the closed position, according to the present invention. When detached from the magnets 104, 104', the bottom foot plate 106 falls down by gravity, and the flexible material 100 drapes into a natural "U" shape that comprises the lower stirrup 101.

Figure 32:
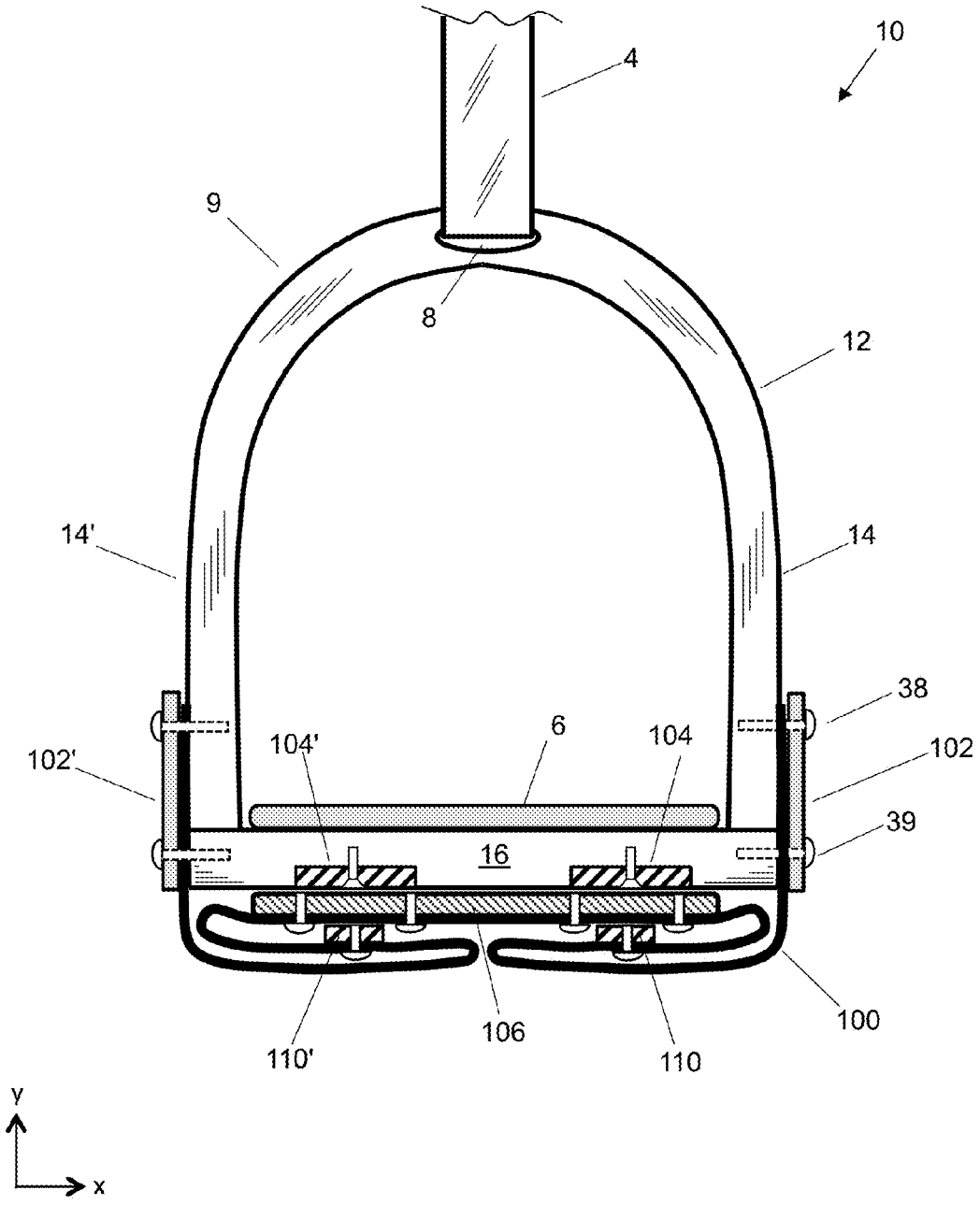
FIG. 32 shows an elevation view of the front side of an example of a retractable stirrup extension in the closed position, according to the present invention.

FIG. 32 shows an elevation view of the front side of an example of a retractable stirrup extension 10 in the open position, according to the present invention. In this example, the flexible material 100 that forms the lower stirrup 101 is folded up into a compact configuration. The extra folds of material 100 are held against the underside of bottom foot plate 106 via a second pair of magnets, i.e., side magnets 110, 110'. Note: this more compact configuration is less likely to accidently catch breaches or limbs than the version shown in FIG. 30 (which has a pair of open loops of the flexible material 100 hanging from the sides). Note: in all of these embodiments, an optional front cover plate (not illustrated) can be used protect and cover the folded flexible material 100, as previously illustrated.

Figure 33:
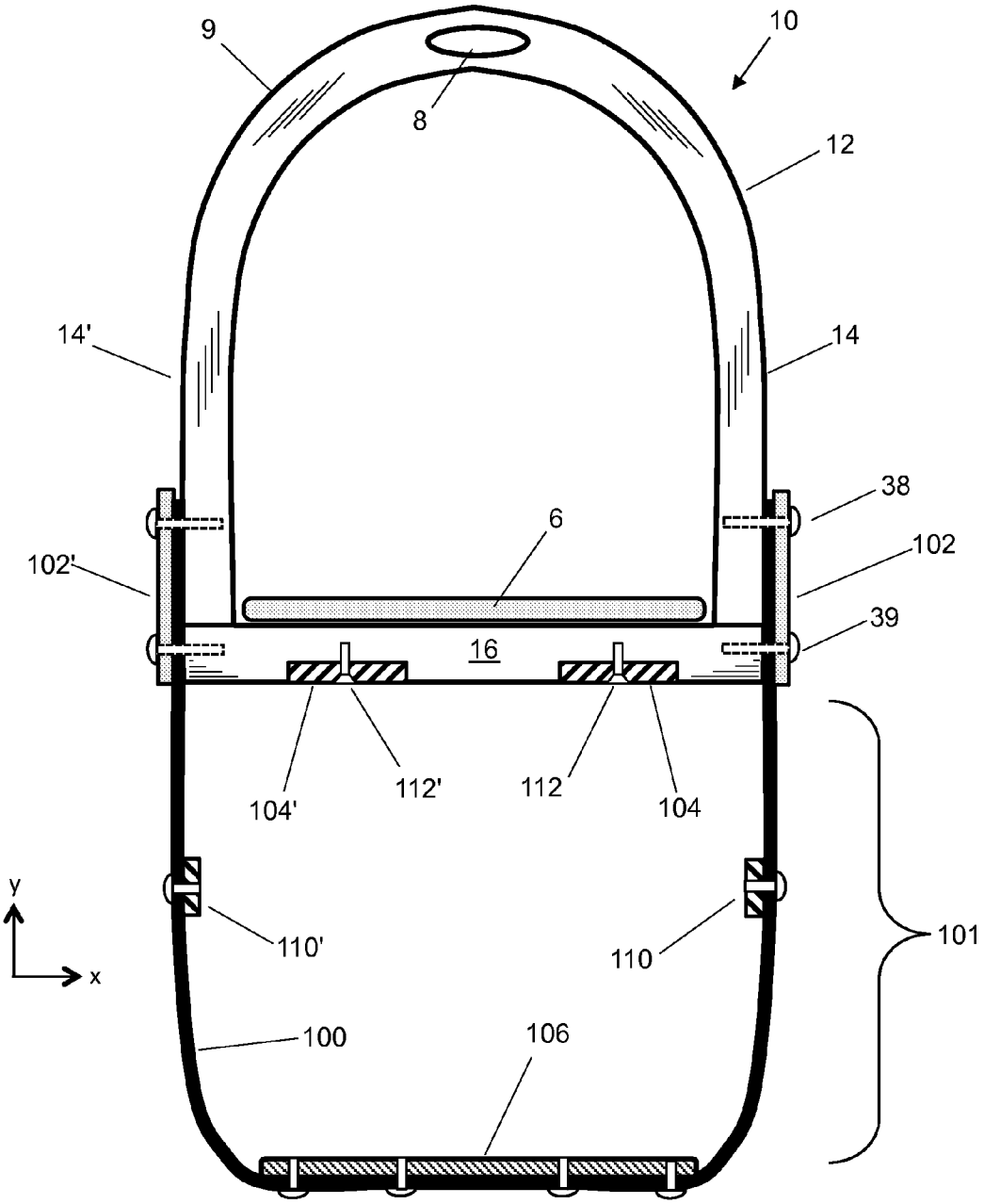
FIG. 33 shows an elevation view of the front side of an example of a retractable stirrup extension in the open position, according to the present invention.

FIG. 33 shows an elevation view of the front side of an example of a retractable stirrup extension 10 in the open position, according to the present invention. The pair of side magnets 110, 110' are attached roughly 50% of the way down each side of the open loop of flexible material 100.

Figure 34:
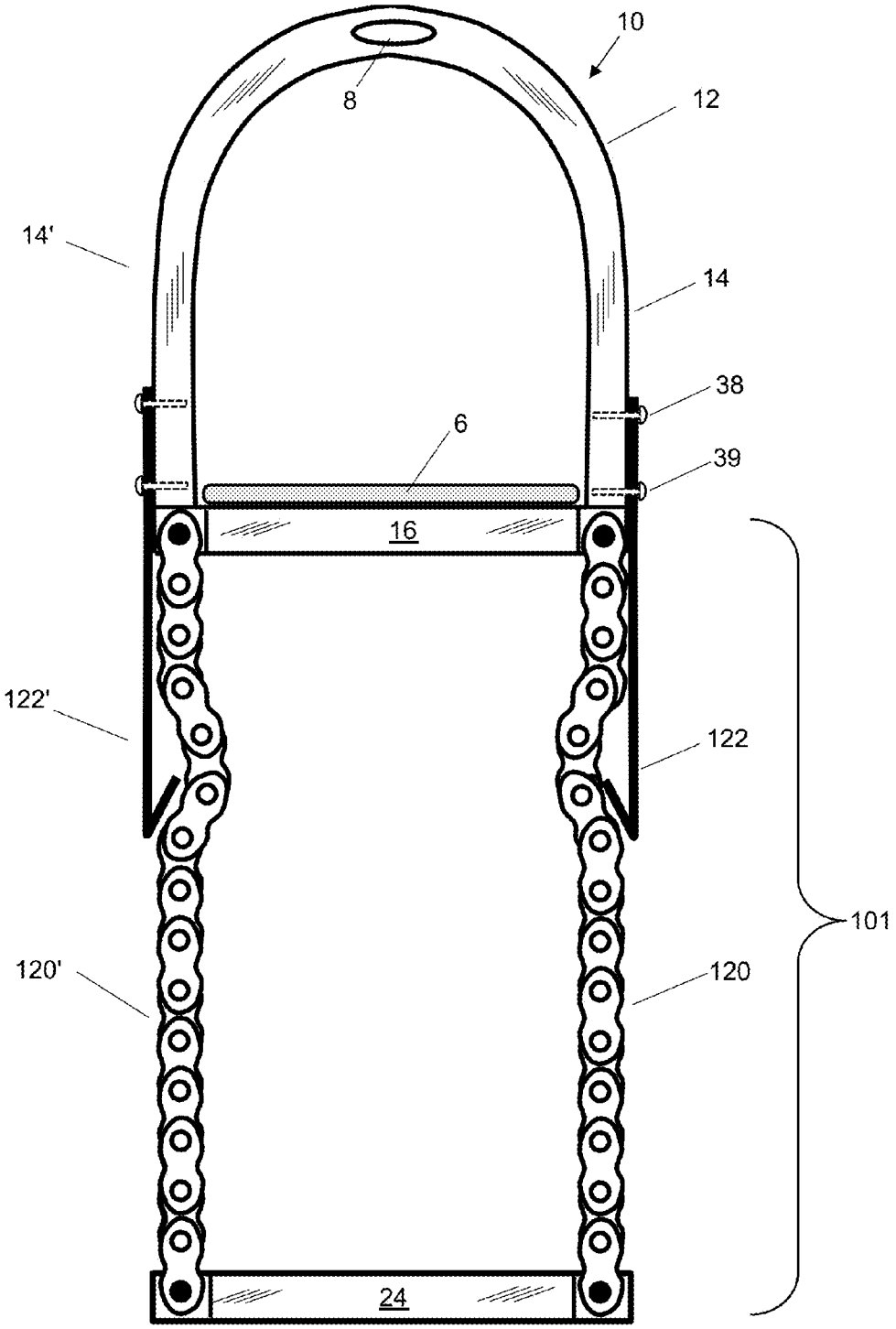
FIG. 34 shows an elevation view of the front side of an example of a retractable stirrup extension in the open position, according to the present invention.

FIG. 34 shows an elevation view of the front side of an example of a retractable stirrup extension 10 in the open position, according to the present invention. In this example, the lower, retractable stirrup 101 comprises a bottom foot plate 24 that is flexibly and retractably attached to upper foot plate 16 via a pair of flexible, parallel bicycle chains 120, 120'. The upper ends of chains 120, 120' are pivotally attached directly to the left and right ends of upper foot plate 16, respectively. A pair of latching end strips 122, 122' are attached to legs 14, 14' of upper stirrup 12 via screws 38, 39. Note that the length of bicycle chains 120, 120' is unlimited, meaning that the distance of travel (extension) of bottom foot plate 16 is also unlimited. Specifically, for the example illustrated in FIG. 34, for a width, W, of the top foot plate of 5", the vertical drop down distance, L, is 9.2". This gives an extension ratio, L/W=9.2/5=1.85. In other words, the drop down extension distance is almost twice the inside width of the top foot plate.

Note: the term "bicycle chain" is a generic term meant to include any type or form of "light duty roller chain" construction that has a large number of flexible linkages which are spaced a small distance apart. Generally, the material is made of steel, but plastic/polymer chains can be used as well. Bicycle-type chain links have the property of folding up in a single, flat plane, which aids the folding up of these chains up into a compact volume that sits just underneath the top foot plate 16.

Figure 35:
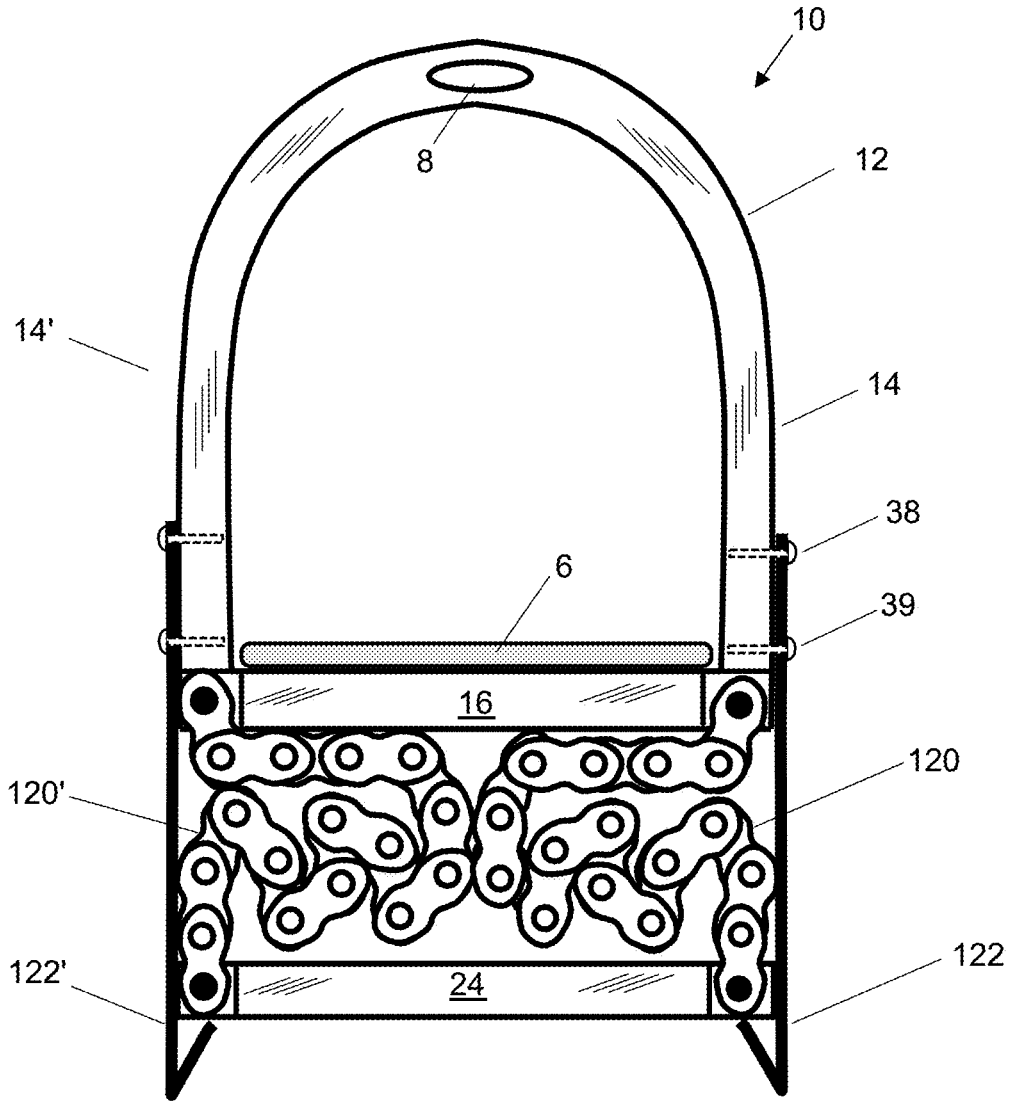
FIG. 35 shows an elevation view of the front side of an example of a retractable stirrup extension in the closed position, according to the present invention.

FIG. 35 shows an elevation view of the front side of an example of a retractable stirrup extension 10 in the closed position, according to the present invention. In this example, bicycle chains 120, 120' are folded up (stowed away) in a compact configuration. Bottom foot plate 16 is securely held (latched) with the pair of latching end strips 122, 122' attached to legs 14, 14' of upper stirrup 12 via screws 38, 39. An optional front cover plate (not illustrated) can be used protect and cover the folded set of chains 120, 120'.

Figure 36A:
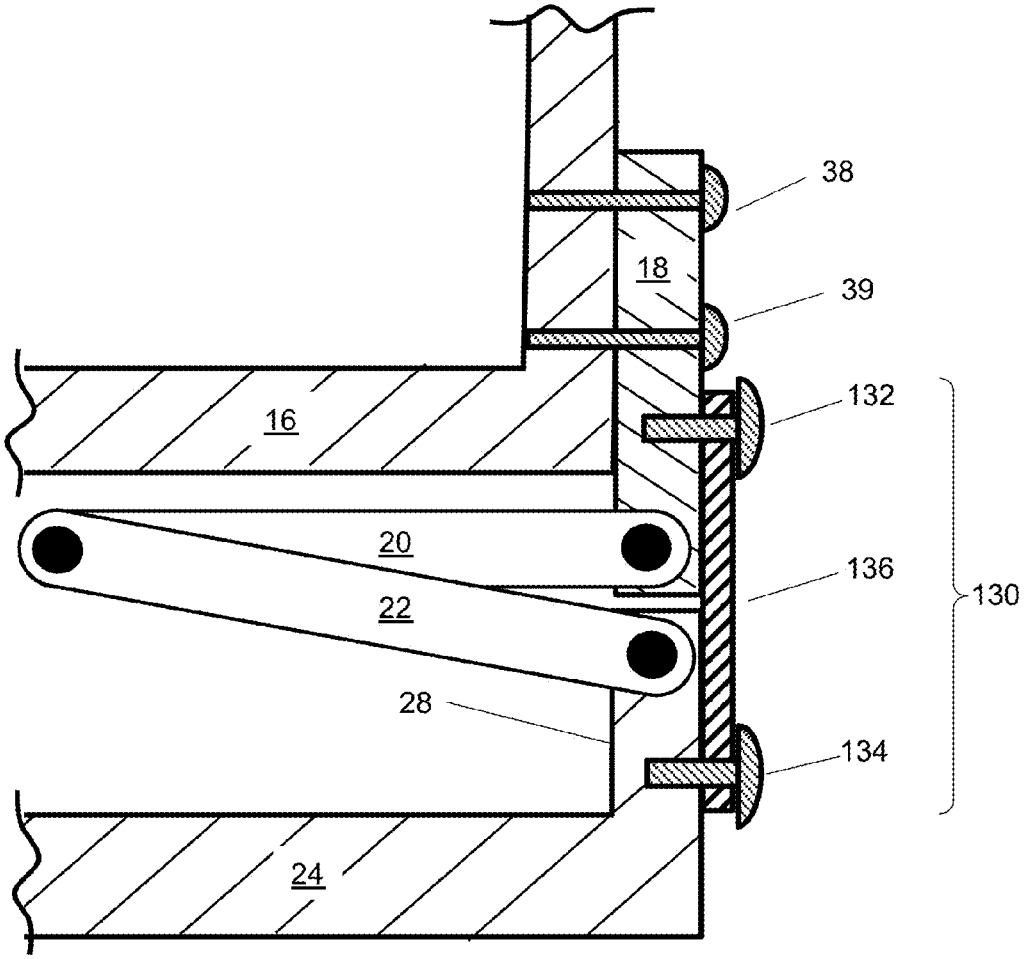
FIG. 36A shows an elevation view of the front side of an example of a retractable stirrup extension in the closed position, according to the present invention.

FIG. 36A shows an elevation view of the front side of an example of a retractable stirrup extension in the closed position, according to the present invention. Latching mechanism 130 comprises a pair of spaced-apart pins 132, 134 and a rubber (or other elastomeric material, e.g., urethane) band/tether/latch 136 hooked around both pins; wherein upper pin 132 is disposed on the side hinge block 18 (which is attached to top foot plate 16 via screws 38 and 39) and lower pin 134 is disposed on the vertical end 28 of bottom foot plate 24. Rubber band 136 serves to elastically latch and hold together the bottom and top foot plates. Rubber band/tether 136 can comprise a molded tab at one end that fits tightly around the upper pin 132 so that the rubber band/tether doesn't fall off when not in use (i.e., when not latched). Alternatively, a crimp can be used to secure the one end of the rubber band to one of the pins. Alternatively, pins 132 and 134 can be hooks (not illustrated).

Figure 36B:
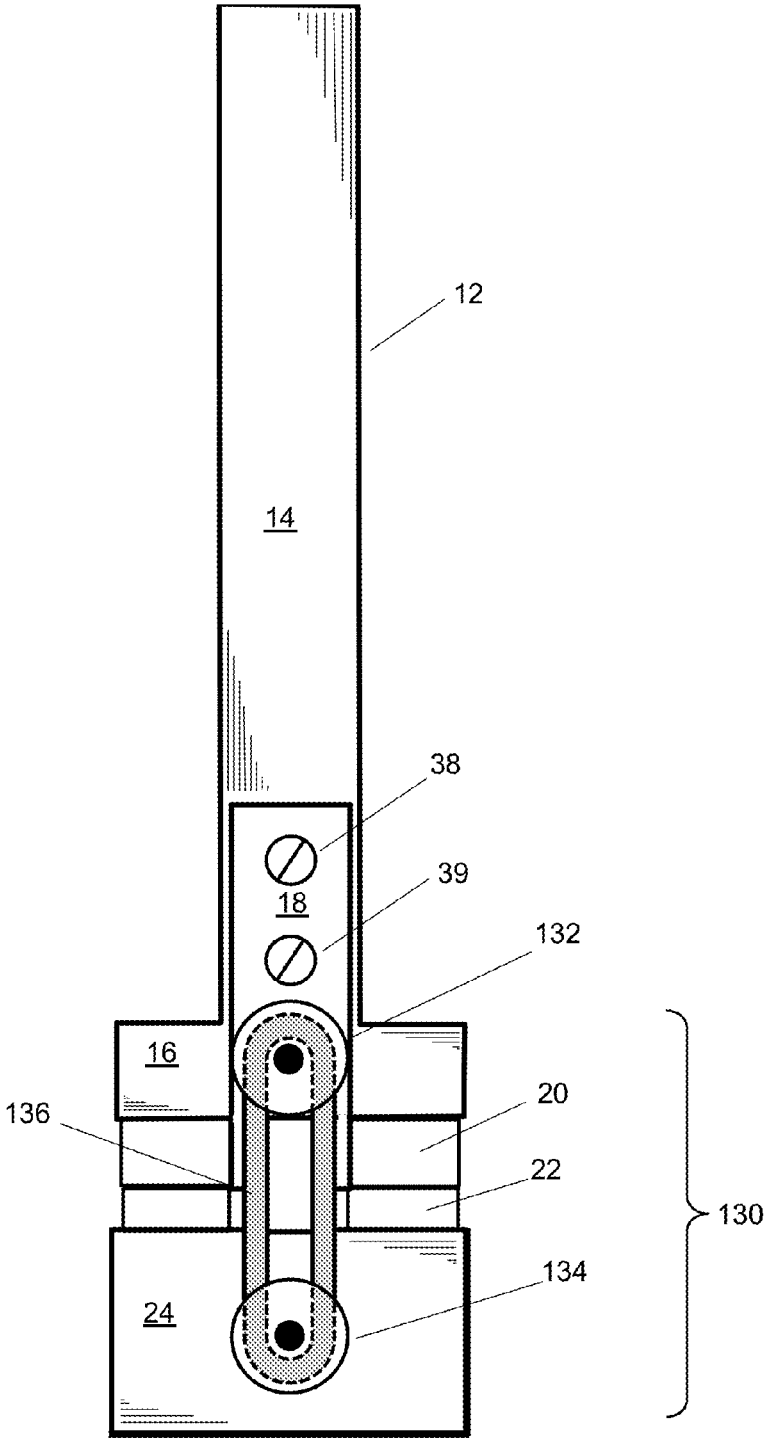
FIG. 36B shows an elevation view of the side of an example of a retractable stirrup extension in the closed position, according to the present invention.

FIG. 36B shows an elevation view of the side of an example of a retractable stirrup extension 10 in the closed position, according to the present invention. Latching mechanism 130 comprises an elastic latching member 136 hooked around two pins 132 and 134 disposed on top foot plate 16 and bottom foot plate 24, respectively. Pins 132, 134 comprise domed heads for keeping the elastic member 136 from slipping off. In this example, elastic member 136 is depicted as a rubber band or loop of other elastic material.

Figure 36C:
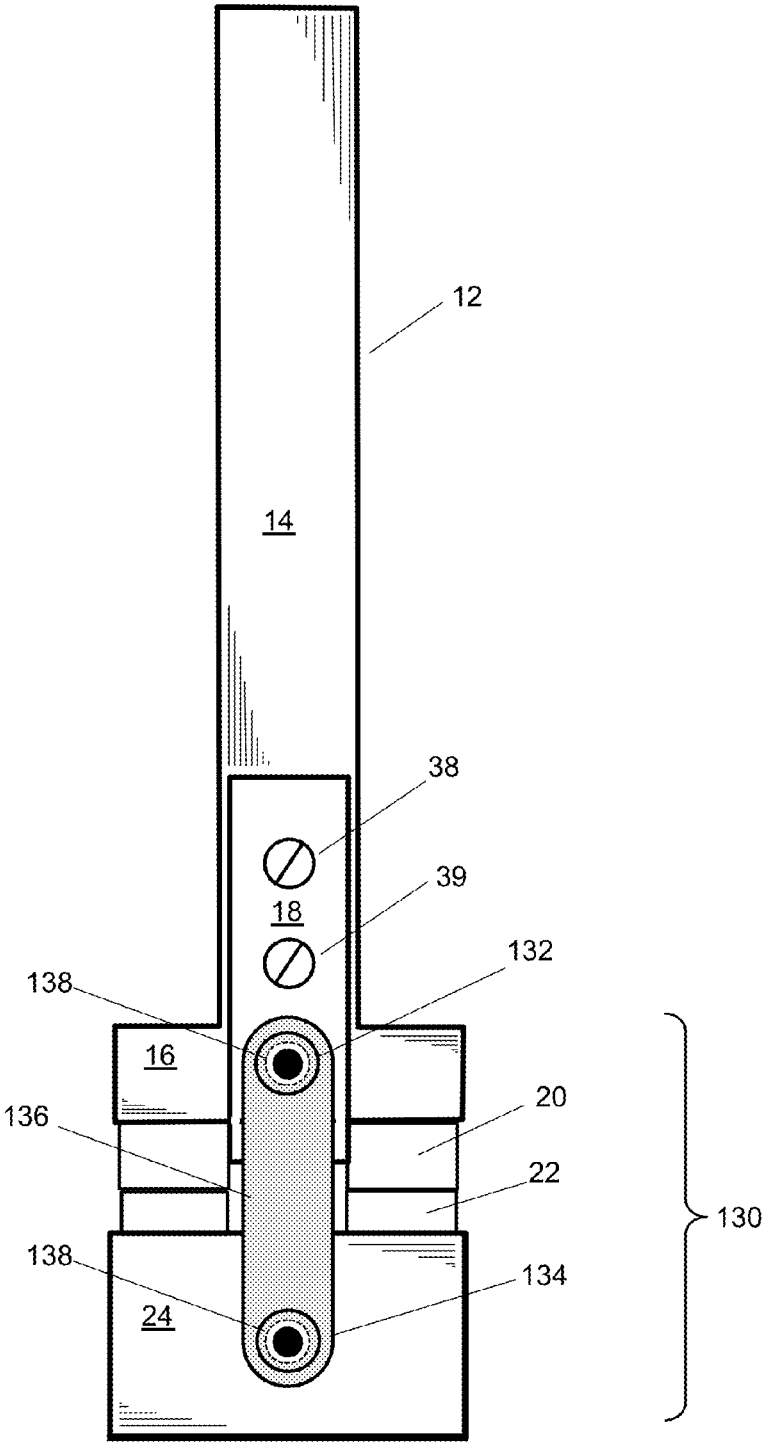
FIG. 36C shows an elevation view of the side of an example of a retractable stirrup extension in the closed position, according to the present invention.

FIG. 36C shows an elevation view of the side of an example of a retractable stirrup extension in the closed position, according to the present invention. This example is similar to that shown in FIG. 36B, except that the elongated latching member 136 comprises an elastomeric material (e.g., rubber or urethane) with holes 138, 139 at each end sized for conveniently stretching and slipping over upper and lower pin heads 132 and 134, respectively. This configuration assures that the elastic member 136 is retained by the upper pin head (button) when not in use (i.e., when assembly 10 is extended).

Figure 36D:
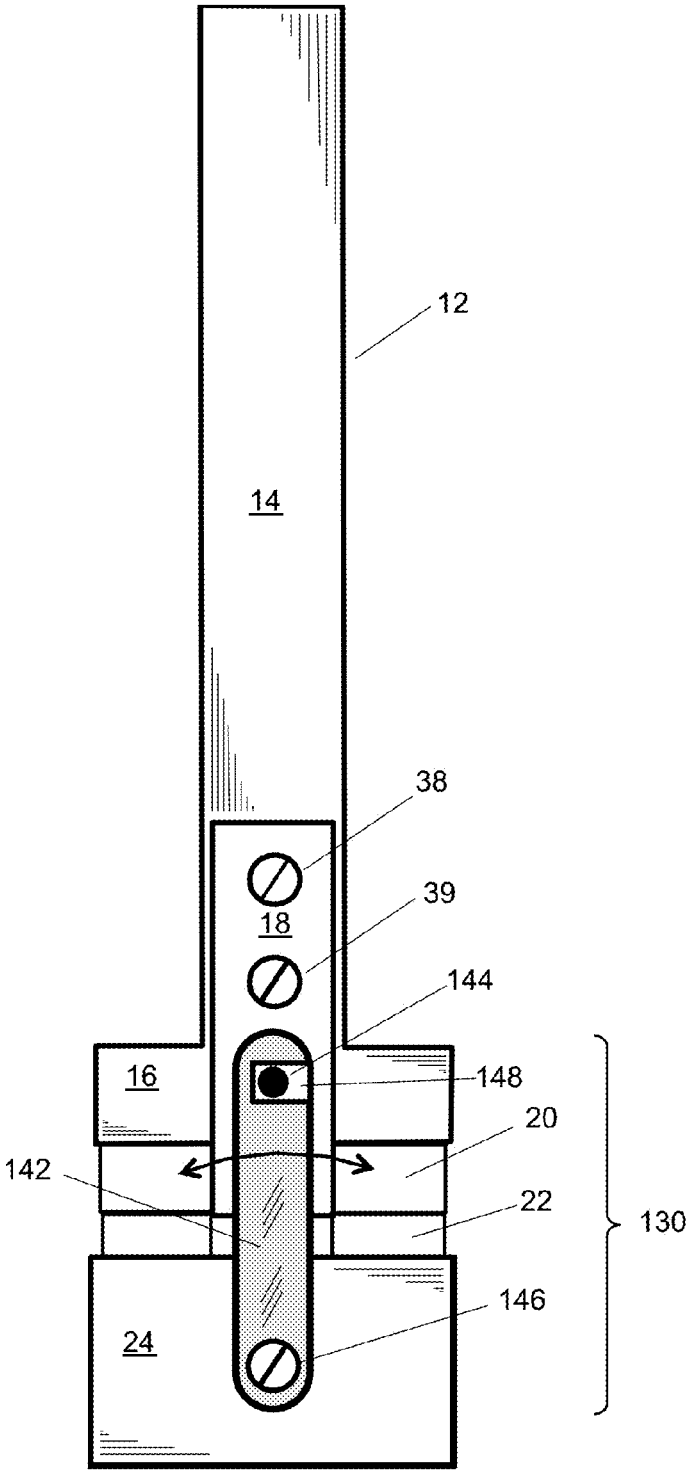
FIG. 36D shows an elevation view of the side of an example of a retractable stirrup extension in the closed position, according to the present invention.

FIG. 36D shows an elevation view of the side of an example of a retractable stirrup extension 10 in the closed position, according to the present invention. This example is similar to that shown in FIG. 36B, except that the latching mechanism 130 comprises a swinging (pivoting) latching member (i.e., clasp) 142 that pivots about the lower screw pin 146 and that has a hooked opening 148 at the upper end for latching/hooking onto upper pin 144.

Figure 36E:
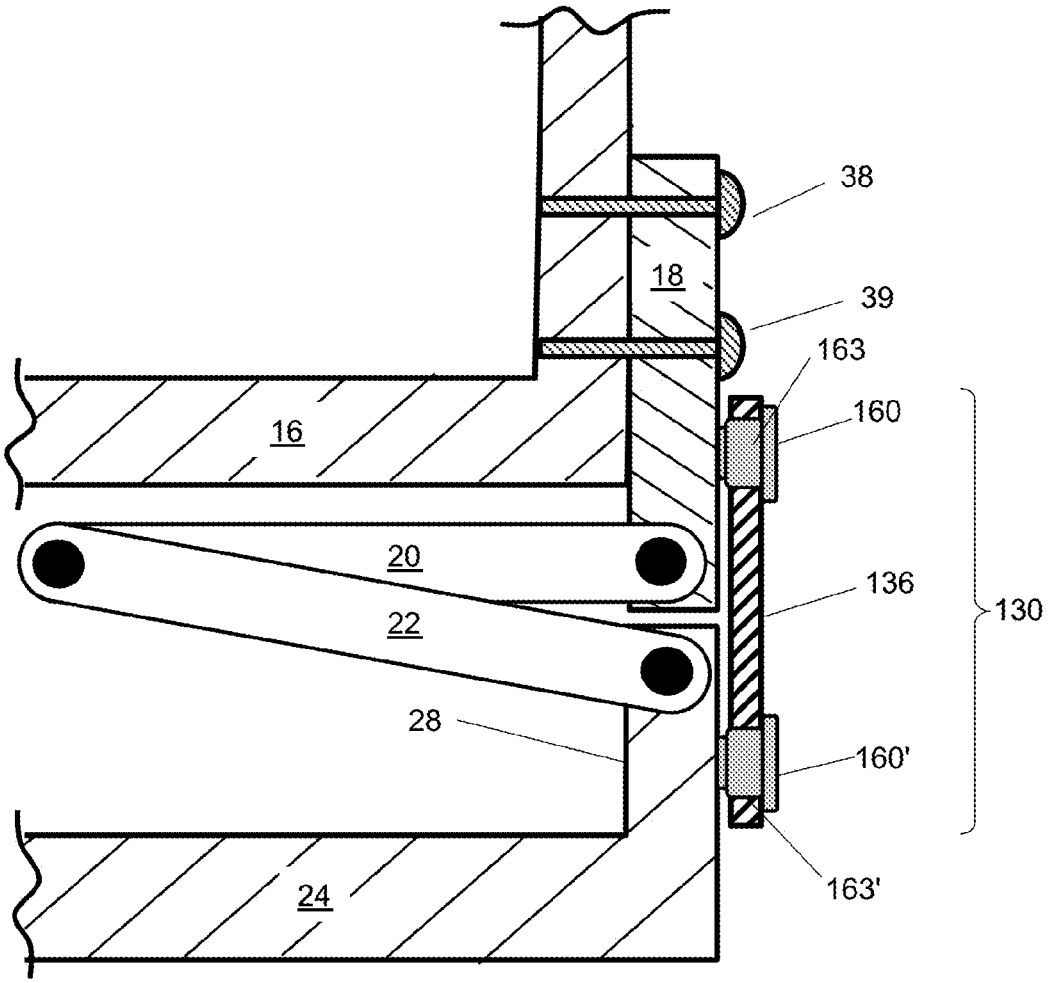
FIG. 36E shows an elevation view of the side of an example of a retractable stirrup extension in the closed position, according to the present invention.

FIG. 36E shows an elevation view of the side of an example of a retractable stirrup extension 10 in the closed position, according to the present invention. This example is similar to that shown in FIG. 36B, except that the latching mechanism 130 comprises a strip of flexible material (e.g., leather, rubber, elastomer, braided or woven polyamide fiber cloth) 136 with snap closures 160, 160' at both ends that attached to mating snaps 163, 163' mounted on the top and bottom foot plates 16 and 24, respectively.

Figure 37:
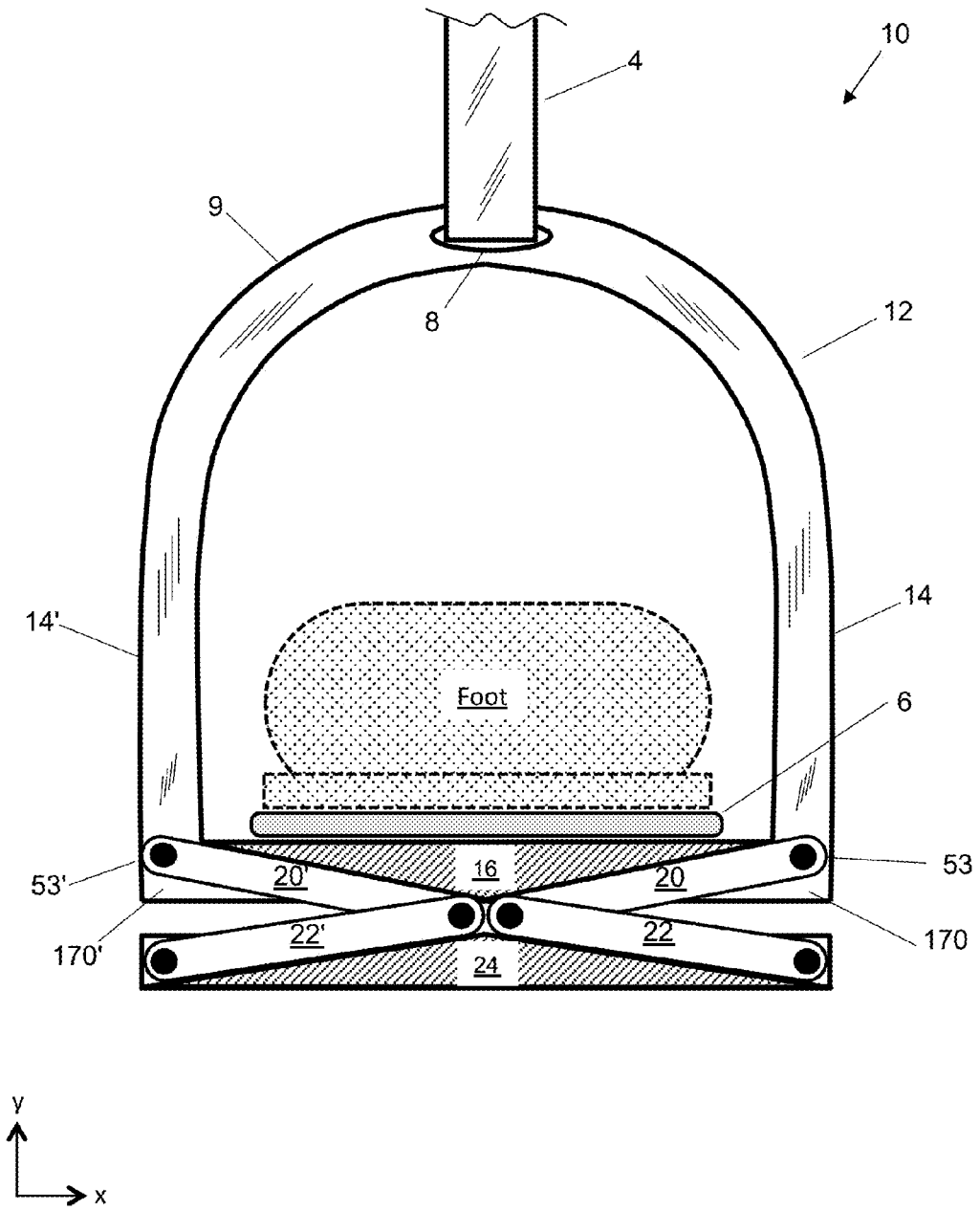
FIG. 37 shows an elevation view of the front of an example of a retractable stirrup extension in the closed position, according to the present invention.

FIG. 37 shows an elevation view of the front of an example of a retractable stirrup extension 10 in the closed position, according to the present invention. Reference is made back to FIGS. 28 and 29, which show a pair of continuously machined (or cast or 3-D printed) recessed ramps 192, 192' along the central spine of the bottom foot plate 16. This is what is shown in FIG. 37, where both the top and bottom foot plates 16, 24, respectively have recessed ramps cutout in the plates. This allows the dual pairs of hinge plates 20, 22 and 20', 22' to be stowed in a compact configuration when closed. The ramps are cut at about a 10° angle from the horizontal. For the top foot plate 16, there are two pairs of ramps 170, 170' that are continuously machined (e.g., cast, 3-D printed) into the plate, one pair of ramps 170, 170' on the front side, and one pair of ramps (not shown) on the back side of the plate (i.e., not down the central spine). Note: a latching mechanism is not illustrated in this Figure.

Figure 38:
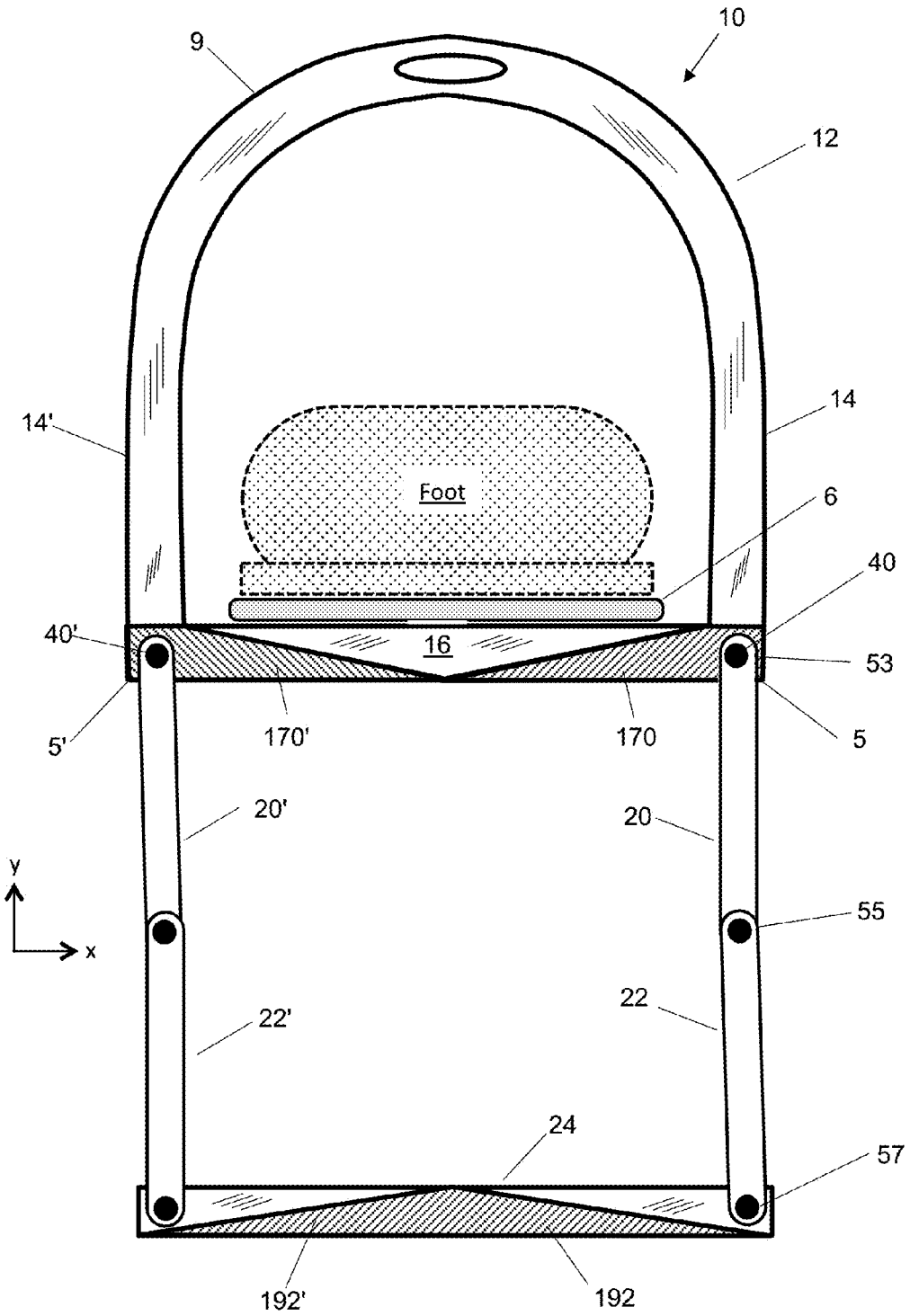
FIG. 38 shows an elevation view of the front of an example of a retractable stirrup extension in the open position, according to the present invention.

FIG. 38 shows an elevation view of the front of the example of FIG. 37 of a retractable stirrup extension in the open position, according to the present invention. Top foot plate 16 has a left end 5' and a right end 5 comprising left and right top transverse hinge pin holes 40', 40, respectively.

All sharp edges and corners of metal parts should be machined and rounded off to have corners with a radius greater than or equal to 1 mm. This is for preventing any sharp edges from hurting the horse.

The upper and lower stirrups can be powder-coated with one or more colorful coatings. Optionally, aluminum alloy parts can be anodized with various colors.

What is claimed is:

1. A retractable stirrup extension assembly comprising:

a fixed upper stirrup for use with a horse and a saddle, comprising: left and right side legs, each side leg having a top and a bottom; an upper arch bridging across the two side legs at the top; and a top foot plate bridging across the two side legs at the bottom; wherein the top foot plate has a long dimension and a long axis defining an X-axis that is aligned with said long dimension; and further wherein the top foot plate comprises a left end and a right end; and a retractable lower stirrup extension comprising:

a retractable bottom foot plate comprising left and right ends with left and right bottom transverse hinge pin holes, respectively;

a left upper hinge plate, comprising upper and lower ends with corresponding upper and lower transverse hinge pin holes, respectively;

a left lower hinge plate, comprising upper and lower ends with corresponding upper and lower transverse hinge pin holes, respectively; and wherein the upper end of the left lower hinge plate is pivotally attached to the lower end of the left upper hinge plate with a transverse hinge pin; and wherein the lower end of the left lower hinge plate is pivotally attached to the left end of the bottom foot plate with a transverse hinge pin inserted in the left bottom transverse hinge pin hole; and wherein the upper end of the left hinge assembly is pivotally attached to the left end of the top foot plate with a transverse hinge pin inserted in the left upper transverse hinge pin hole;

a right upper hinge plate, comprising upper and lower ends with corresponding upper and lower transverse hinge pin holes, respectively;

a right lower hinge plate, comprising upper and lower ends with corresponding upper and lower transverse hinge pin holes, respectively; and wherein the upper end of the right lower hinge plate is pivotally attached to the lower end of the right upper hinge plate with a transverse hinge pin;

wherein the upper end of the right upper hinge plate is pivotally attached to the right end of the top foot plate with a transverse hinge pin inserted in the right upper transverse hinge pin hole; and wherein the lower end of the right lower hinge plate is pivotally attached to the right end of the bottom foot plate with a transverse hinge pin inserted in the right bottom transverse hinge pin hole;

whereas rotation of the hinge plates about their respective hinge pins causes the bottom foot plate to extend vertically downwards in a linear direction along a Y-axis which is perpendicular to the X-axis of the top foot plate; and whereas reversed rotation of the hinge plates about their respective hinge pins causes the bottom foot plate to retract vertically upwards in a linear direction along the Y-axis; and further wherein: when (a) the bottom foot plate is positioned in a fully retracted, closed position where the bottom foot plate is retracted to a smallest distance from the top foot plate, then (b) the left upper hinge plate and the right upper hinge plate are both oriented parallel to the long dimension of the top foot plate.

2. The assembly of claim 1, further comprising:

a left side hinge block, attached to a lower end of the left side leg and to the left end of the top foot plate, with a pair of screws;

a right side hinge block, attached to a lower end of the right side leg and to the right end of the top foot plate, with a pair of screws;

wherein left and right upper transverse hinge pin holes are disposed in the left and right side hinge blocks, respectively.

3. The assembly of claim 1, wherein an extension ratio, which is a length of travel that the bottom foot plate travels when fully extended divided by a width of the top foot plate of the upper stirrup, ranges from 1 to 2.

4. The assembly of claim 1, further comprising one or more latching mechanisms attached to the upper stirrup for securely latching the bottom foot plate in the closed, retracted position when riding the horse.

5. The assembly of claim 4, wherein the latching mechanism comprises a semi-spherical latching element mounted on a spring strip; wherein an upper end of the spring strip is attached to one of the side legs of the upper stirrup; and wherein each semi-spherical latching element, at a lower end of the spring strip, rests inside of a semi-spherical recess cut out of a side wall of the bottom foot plate when the bottom foot plate is retracted in a closed and latched configuration.

6. The assembly of claim 1, wherein the bottom foot plate comprises a long, flat central portion; an open central volume, a plurality of weight-reducing holes; and a pair of short, vertical side legs that each comprise: one of the bottom transverse hinge pin holes, a recessed notch for receiving a lower end of the left or right lower hinge plate; and a side recess for receiving a latching element; and further wherein the long, flat central portion of the bottom foot plate is mechanically roughened to provide increased friction to hold a riders foot during mounting up.

7. The assembly of claim 1, wherein the upper stirrup and the lower stirrup extension are powder-coated with one or more colorful coatings.

8. The assembly of claim 1, wherein the upper stirrup and the lower stirrup extension are made of a rigid material selected from the group consisting of steel, aluminum alloy, plastic, a polymer, and a fiber-reinforced polymer.

9. The assembly of claim 1, wherein the left end and the right end of the top foot plate comprise left and right top transverse hinge pin holes, respectively, for holding the transverse hinge pins that pivotally connect the top foot plate to the left and right upper hinge plates, respectively.

10. A retractable stirrup extension for use with a saddle and a horse or other rideable animal, the extension comprising:

an upper stirrup with a fixed top foot plate;

a retractable bottom foot plate retractably attached to the upper stirrup;

two pairs of upper and lower linked hinge plates pivotally connecting the retractable bottom foot plate to the upper stirrup, wherein each pair of linked hinge plates comprises an upper hinge plate adjacent to a lower hinge plate; and a connecting hinge pin pivotally connecting each adjacent upper linked hinge plate and lower linked hinge plate;

wherein rotary motion of the linked hinge plates about their respective hinge pins is converted into a linear displacement of the bottom foot plate in a vertical direction; and further wherein: when (a) the bottom foot plate is positioned in a fully retracted, closed position where the bottom foot plate is located at a smallest distance from the top foot plate, then (b) the upper hinge plates are oriented parallel to a long dimension of the top foot plate.

11. The retractable stirrup extension of claim 10, further comprising a latching mechanism for holding the bottom foot plate in the closed position against the upper stirrup while riding.

12. The retractable stirrup extension of claim 11, wherein the latching mechanism comprises a semi-spherical latching element that is inserted into a semi-spherical recess in a vertical sidewall of the bottom foot plate when the bottom foot plate is retracted into the closed position.

* * * * *